US010661582B2

(12) United States Patent
Inoue et al.

(10) Patent No.: US 10,661,582 B2
(45) Date of Patent: May 26, 2020

(54) TAPE, PRINTER AND PRINTER SYSTEM

(71) Applicant: Brother Kogyo Kabushiki Kaisha, Nagoya-shi, Aichi-ken (JP)

(72) Inventors: Harumitsu Inoue, Toki (JP); Shimako Nakai, Nagoya (JP)

(73) Assignee: Brother Kogyo Kabushiki Kiasha, Nagoya-shi, Aichi-ken (JP)

( * ) Notice: Subject to any disclaimer, the term of this patent is extended or adjusted under 35 U.S.C. 154(b) by 121 days.

(21) Appl. No.: 15/714,182

(22) Filed: Sep. 25, 2017

(65) Prior Publication Data

US 2018/0015742 A1 Jan. 18, 2018

Related U.S. Application Data

(63) Continuation-in-part of application No. PCT/JP2016/074679, filed on Aug. 24, 2016.

(30) Foreign Application Priority Data

Aug. 31, 2015 (JP) ..... 2015-171109

(51) Int. Cl.
*B41J 11/68* (2006.01)
*G09F 3/14* (2006.01)
(Continued)

(52) U.S. Cl.
CPC ..... *B41J 11/68* (2013.01); *B41J 3/36* (2013.01); *B41J 3/4075* (2013.01); *B41J 11/663* (2013.01);
(Continued)

(58) Field of Classification Search
CPC ... B41J 11/68; B41J 3/36; B41J 3/4075; B41J 11/663; B41J 11/666; B41J 11/703;
(Continued)

(56) References Cited

U.S. PATENT DOCUMENTS 4,363,685 A * 12/1982 White ..... B31D 1/027 156/212
5,254,381 A * 10/1993 Hoffmann ..... G09F 3/02 283/101

(Continued)

FOREIGN PATENT DOCUMENTS

CN 1998036 A 7/2007
CN 101085559 A 12/2007

(Continued)

OTHER PUBLICATIONS

Mar. 11, 2019—U.S. Non-Final Office Action—U.S. Appl. No. 15/853,244.

(Continued)

*Primary Examiner* — David H Banh
(74) *Attorney, Agent, or Firm* — Banner & Witcoff, Ltd.

(57) ABSTRACT

A tape has one or more first areas and one or more second areas. One of the second areas is connected to each of the first areas, and is shorter than the first areas in a direction. A control unit controls to print on a first area of the tape and to cut a second area. In some examples, the tape is divided into two portions by pre-cut contours. A control unit controls to divide one of the portions into two parts and to print on at least one of the parts. Additionally or alternatively, a tape may include a first sheet and a second sheet. The second sheet pasted on the first sheet, is divided into a first area and a second area by a slit, and has a perforation line. A control unit controls to print on the second sheet, and to cut partially through the tape.

14 Claims, 19 Drawing Sheets

(51) Int. Cl.

| | |
|---|---|
| ***B41J 11/66*** | (2006.01) |
| ***B41J 3/407*** | (2006.01) |
| ***B41J 3/36*** | (2006.01) |
| ***B41J 25/20*** | (2006.01) |
| ***G09F 3/02*** | (2006.01) |
| ***G09F 3/10*** | (2006.01) |
| ***B41J 11/70*** | (2006.01) |

(52) U.S. Cl.
CPC ..... *B41J 11/666* (2013.01); *B41J 11/703* (2013.01); *B41J 25/20* (2013.01); *G09F 3/02* (2013.01); *G09F 3/10* (2013.01); *G09F 3/14* (2013.01); *G09F 2003/0201* (2013.01)

(58) Field of Classification Search
CPC .... B41J 25/20; G09F 3/02; G09F 3/10; G09F 3/14; G09F 2003/0201
See application file for complete search history.

(56) References Cited

U.S. PATENT DOCUMENTS

| | | | | |
|---|---|---|---|---|
| 5,662,976 | A * | 9/1997 | Popat | B32B 38/00 283/101 |
| 6,364,364 | B1 * | 4/2002 | Murphy | B42D 15/006 283/101 |
| 6,413,604 | B1 * | 7/2002 | Matthews | G09F 3/02 281/2 |
| 7,121,751 | B2 | 10/2006 | Harada et al. | |
| 9,082,321 | B2 | 7/2015 | Nahm et al. | |
| 9,483,962 | B2 | 11/2016 | Nahm et al. | |
| 9,539,832 | B2 | 1/2017 | Sasaki | |
| 9,852,665 | B2 | 12/2017 | Nahm et al. | |
| 10,297,172 | B2 | 5/2019 | Nahm et al. | |
| 2007/0015659 | A1 * | 1/2007 | O'Kell | B41J 11/0065 503/201 |
| 2007/0082163 | A1 * | 4/2007 | Bolnick | G09F 3/0288 428/42.3 |
| 2008/0025778 | A1 * | 1/2008 | Ito | B41J 3/4075 400/76 |
| 2008/0231423 | A1 | 9/2008 | Maeda et al. | |
| 2009/0285617 | A1 * | 11/2009 | Vandermeulen | B41J 3/4075 400/621 |
| 2011/0100539 | A1 * | 5/2011 | Suehara | G09F 3/10 156/234 |
| 2013/0051891 | A1 | 2/2013 | Nahm et al. | |
| 2015/0287347 | A1 | 10/2015 | Nahm et al. | |
| 2016/0292541 | A1 * | 10/2016 | Yasui | G06K 15/024 |
| 2016/0297217 | A1 | 10/2016 | Sasaki | |
| 2017/0046987 | A1 | 2/2017 | Nahm et al. | |
| 2018/0012522 | A1 | 1/2018 | Nahm et al. | |
| 2018/0015748 | A1 | 1/2018 | Kato et al. | |

FOREIGN PATENT DOCUMENTS

| | | | |
|---|---|---|---|
| CN | 101516628 | A | 8/2009 |
| CN | 103057300 | A | 4/2013 |
| JP | 2001-137017 | A | 5/2001 |
| JP | 2003-058062 | A | 2/2003 |
| JP | 2004-291534 | A | 10/2004 |
| JP | 2005-106952 | A | 4/2005 |
| JP | 2008-111926 | A | 5/2008 |
| JP | 2010-014929 | A | 1/2010 |
| JP | 2012-040879 | A | 3/2012 |
| JP | 2015-049479 | A | 3/2015 |
| WO | 2014/148060 | A1 | 9/2014 |
| WO | 2017/018249 | A1 | 2/2017 |

OTHER PUBLICATIONS

May 7, 2019—U.S. Notice of Allowance—U.S. Appl. No. 15/852,702.
Dec. 22, 2017—Co-pending U.S. Appl. No. 15/853,244.
Dec. 22, 2017—Co-pending U.S. Appl. No. 15/853,159.
Dec. 22, 2017—Co-pending U.S. Appl. No. 15/852,702.
Dec. 22, 2017—Co-pending U.S. Appl. No. 15/852,831.
Dec. 22, 2013—Co-pending U.S. Appl. No. 15/852,987.
Jul. 17, 2018—(EP) Extended Search Report—App 17210644.5.
Jul. 17, 2018—(EP) Extended Search Report—App 17210672.6.
Jul. 17, 2018—(EP) Extended Search Report—App 17210694.0.
Jul. 3, 2018—(JP) Notice of Reasons for Rejection—App 2015-171109.
Brady Identification Solutions & Specialty Tapes, General Catalog, 2003, 292 pages.
Sep. 27, 2016—International Search Report—App PCT/JP2016/074679.
Sep. 27, 2016—Written Opinion—PCT/JP2016/074679.
Nov. 15, 2018—U.S. Notice of Allowance—U.S. Appl. No. 15/853,159.
Nov. 30, 2018—U.S. Non-final Office Action—U.S. Appl. No. 15/852,702.
Jan. 25, 2019—U.S. Notice of Allowance—U.S. Appl. No. 15/852,987.
Jan. 28, 2019—(CN) The First Office Action—App 201680037009.7.
Sep. 12, 2018—U.S. Non-Final Office Action—U.S. Appl. No. 15/852,987.
Oct. 18, 2018—U.S. Non-Final Office Action—U.S. Appl. No. 15,853,244.
Sep. 27, 2019—(CN) The Second Office Action—App 201680037009.7.
Jul. 15, 2019—U.S. Notice of Allowance—U.S. Appl. No. 15/853,244.
May 29, 2019—U.S. Notice of Allowance—U.S. Appl. No. 15/853,159.
Dec. 4, 2019—U.S. Notice of Allowance—U.S. Appl. No. 15/853,244.
Mar. 19, 2020—U.S. Non-finl Office Action—U.S. Appl. No. 15/852,831.

* cited by examiner

TAPE, PRINTER AND PRINTER SYSTEM

CROSS-REFERENCE TO RELATED APPLICATION

This application is a continuation of International Application PCT/JP2016/074679, filed on Aug. 24, 2016, which claims the benefit of priority of Japanese Patent Application No. 2015-171109, filed on Aug. 31, 2015, each of which is incorporated herein by reference.

FIELD OF DISCLOSURE

Aspects disclosed herein relate to a tape and a printer for performing printing on the tape.

BACKGROUND

For using known printed labels (e.g., adhesive tags to be folded when used), each of the printed labels is removed from a sheet (e.g., a release paper) of a tape (e.g., a continuous member having tags). Each printed label includes, for example, a printing tape portion (e.g., an indication portion) and an attaching tape portion (e.g., an attaching portion). The printing tape portion has an indication (e.g., a bar code) printed thereon. The attaching tape portion is used for attaching the printing tape portion to an object (e.g., a product).

SUMMARY

A user may use each known printed label in such a manner that an attaching portion of the printed label is attached to an object with a printing tape portion of the printed label extending from the attaching portion. In this state, an indication printed on the printing tape portion is oriented in a desired direction relative to the object. The tape may include printing tape portions and attaching tape portions, each of which may have a predetermined size and may be positioned at a predetermined position. The known printed labels may be created by a printer using such a tape. Thus, only the same variety of printed labels may be created using the same tape.

Accordingly, some embodiments of the disclosure provide for a tape and a printer that may enable easy creation of multiple varieties of printed labels using the same tape.

A tape has some of a first area and some of a second area. One side of one of the second area in a tape length direction integrally connected to one of the first area. The other side of the one of the second area in a tape length direction integrally connected to another of the first area. The second area is shorter than the first area in a tape width direction.

A printer has a conveyor unit, a printing unit, a cutting unit, and a control unit. The control unit controls to print on a first area of a tape and to cut a second area except the first area in the tape.

A printer has a conveyor unit, a printing unit, a cutting unit, and a control unit. The conveyor unit conveys a tape. The tape divided into an inside portion and an outside portion by pre-cut contours. The control unit controls to divide the inside portion into two parts and to print the one part of the inside portion.

A tape includes a first sheet and a second sheet. The second sheet pasted on a first surface of the first sheet. The second sheet is divided into a first area and a second area by a slit. The second sheet has a perforation line in a first area.

A printer has a conveyor unit, a printing unit, a cutting unit, and a control unit. The control unit controls to convey a tape having a first sheet and a second sheet, to print on the second sheet, and to cut halfway through the tape in the second sheet.

According to the one or more aspects of the disclosure, the printer and the tape may enable easy creation of multiple varieties of printed labels using the same tape.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Hereinafter, illustrative embodiments of the disclosure will be described with reference to the accompanying drawings. Indications "front", "rear", "left", "right", "top", and "bottom" in drawings may be referred to in the specification as respective directions.

First Illustrative Embodiment

Hereinafter, a first illustrative embodiment will be described.

<Overall Configuration of Printer>

Figure 1:
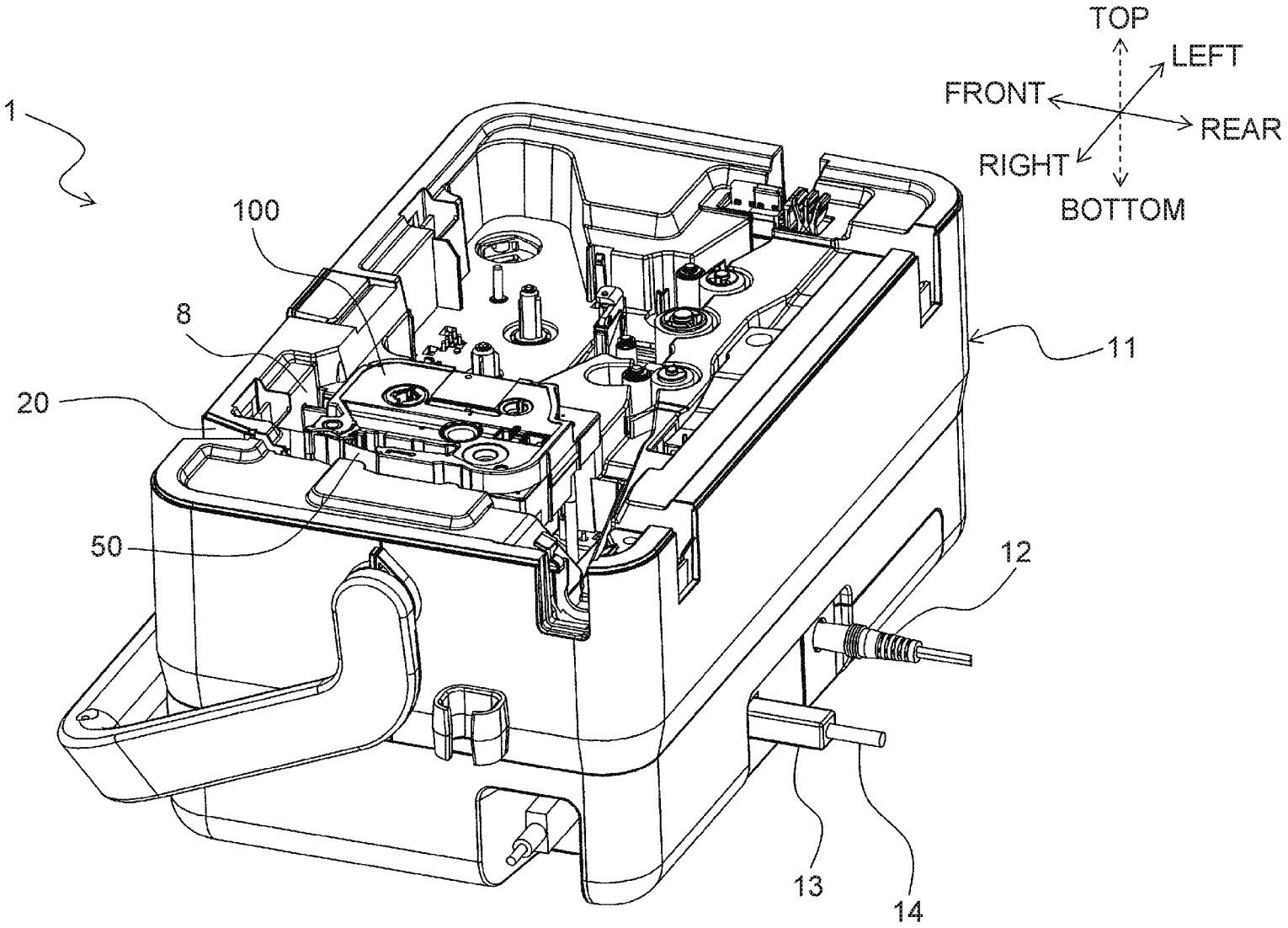
FIG. 1 is a perspective view of a printer in a first illustrative embodiment according to one or more aspects of the disclosure.

Referring to FIG. 1, an overall configuration of a printer 1 according to the first illustrative embodiment will be described.

The printer 1 is configured to perform printing selectively on a printing tape 50, which corresponds to a tape, or on a printing tubing (not illustrated). Nevertheless, the printer 1 might not necessarily be capable of performing printing on each of the printing tape 50 and the printing tubing. In other embodiments, for example, the printer 1 may be configured to perform printing on the printing tape 50 only.

Various types of tape cartridges 100 may be available to the printer 1. For example, the tape cartridges 100 include laminated type tape cartridges and non-laminated type tape cartridges. The non-laminated type tape cartridges include, for example, heat-sensitive paper type tape cartridges (for thermal printing requiring no ink) and receptor-type tape cartridges (for thermal printing requiring ink). Hereinafter, one example case of using a receptor type tape cartridge 100 will be described. The tape cartridge 100 may be either one of a die-cut-label type tape cartridge and a continuous-label type tape cartridge 100, which may be both available to the printer 1. The die-cut-label type tape cartridge may store a printing tape 50 having pre-cut lines and/or pre-cut contours in its adhesive sheet. The continuous-label type tape cartridge may store a printing tape 50 having neither pre-cut lines nor pre-cut contours in its adhesive sheet. In the first illustrative embodiment, the tape cartridge 100 used in FIG. 1 may be a continuous-label type tape cartridge.

As illustrated in FIG. 1, the printer 1 includes a body 11 and a cover (not illustrated). The body 11 has a rectangular parallelepiped or box shape. The cover is configured to conceal and expose an upper opening of the body 11. In FIG. 1, the cover is removed from the body 11. In a state where the cover is attached to the body 11, the cover is pivotably supported by an upper rear end portion of the body 11. The body 11 includes a power connector 12 and a universal serial bus ("USB") connector 13 at a lower portion of its rear surface. The printer 1 may be connected to a control terminal 300 (refer to FIG. 4), e.g., a personal computer, via a USB cable 14 connected to the USB connector 13. The printer 1 is configured to, in response to receipt of a print instruction signal transmitted from the control terminal 300, perform printing on the printing tape 50 based on the print instruction signal. In other embodiments, for example, the printer 1 and the control terminal 300 may be wirelessly connected to each other. Further, the printer 1 might not necessarily be configured to perform printing based on an operation performed on the control terminal 300. In other embodiments, for example, the printer 1 may include an operation unit and may be configured to perform printing based on an operation performed on the operation unit. That is, the printer 1 may be a standalone printer.

The body 11 further includes a cartridge holder 8 in its upper right portion. The cartridge holder 8 may be a recessed portion where the tape cartridge 100 storing the printing tape 50 is attached to and detached from. For purposes of illustrating the various parts of the configuration, in FIG. 1, the tape cartridge 100 is positioned higher than a position where the tape cartridge 100 is actually installed in the cartridge holder 8.

The body 11 has a discharge port 20 in its front surface. The discharge port 20 is disposed close to a right end of the body 11. The discharge port 20 may be an opening for allowing a portion of a printing tape 50, on which printing has been performed by a thermal head 22, to be discharged to the outside of the printer 1 from the cartridge holder 8 by a platen roller 25.

<Internal Configuration of Printer>

Figure 2:
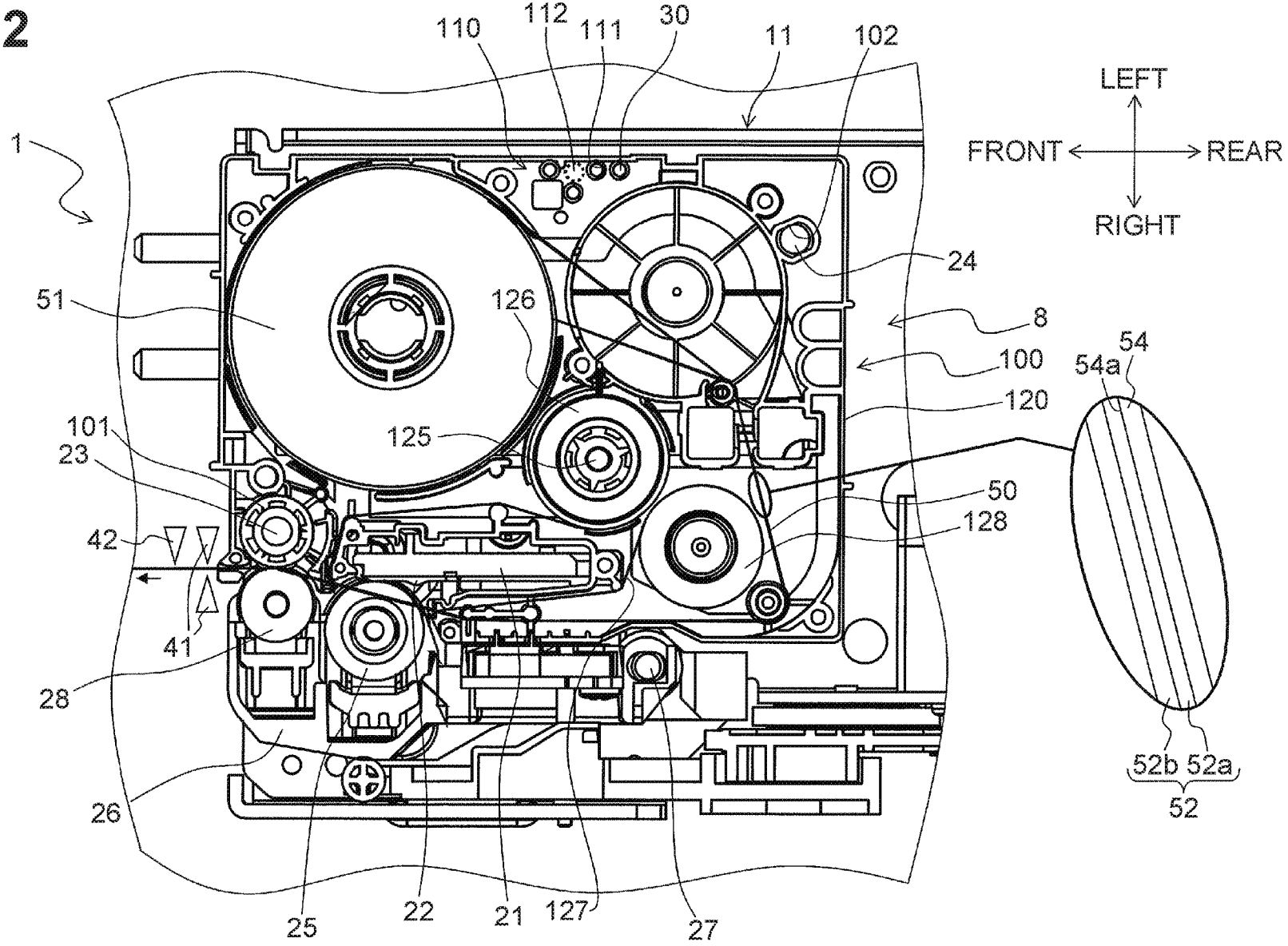
FIG. 2 is a plan view of a cartridge holder and its surrounding configuration in the printer in the first illustrative embodiment according to one or more aspects of the disclosure.

Referring to FIG. 2, an internal configuration of the printer 1 will be described.

As described above, the cartridge holder 8 to or from which the tape cartridge 100 is attachable or detachable, respectively, is disposed in the upper portion of the body 11. As illustrated in FIG. 2, the cartridge holder 8 includes a head holder 21 that extends upward from its middle portion in a front-rear direction and that is offset to the right in the right-left direction. The head holder 21 has a plane surface extending in the front-rear direction. The thermal head 22, which corresponds to a printing unit, is disposed on a right surface of the head holder 21. The thermal head 22 has a plurality of heating elements (not illustrated). The thermal head 22 performs printing, using an ink ribbon 127, on a portion of a printing tape 50 that has been supplied from the tape cartridge 100 and that is being conveyed by the platen roller 25 along a predetermined conveyance path.

The cartridge holder 8 further includes a ribbon winding shaft 125 that is disposed further to the left than the head holder 21. The ribbon winding shaft 125 is configured to engage with a ribbon winding roller 126 of the tape cartridge 100 by insertion and rotate the ribbon winding roller 126. The tape cartridge 100 includes an ink supply roll 128 that is rotatably supported therein. An ink ribbon 127 is wound around the ink supply roll 128. The ribbon winding roller 126 is configured to rotate by driving of the ribbon winding shaft 125 to draw a used portion of the ink ribbon 127 from the ink supply roll 128 and to wind a used portion of the ink ribbon 127 around itself.

The cartridge holder 8 further includes a conveyor roller drive shaft 23 that is disposed further to the front than the head holder 21. The conveyor roller drive shaft 23 is configured to engage with and disengage from a conveyor roller 100 of the tape cartridge 100. The cartridge holder 8 further includes a guide shaft 24 at a rear left corner portion of the cartridge holder 8. The guide shaft 24 is configured to engage with and disengage from a guide hole 102 (also refer to FIG. 3) of the tape cartridge 100.

The body 11 further includes a drive motor 66 (refer to FIG. 4), e.g., a stepping motor, below the cartridge holder 8. The ribbon winding shaft 125 and the conveyor roller drive shaft 23 are connected to the drive motor 66 via gears (not illustrated). In accordance with the driving of the drive motor 66, the ribbon winding shaft 125 and the conveyor roller drive shaft 23 rotate. In accordance with the driving of the ribbon winding shaft 125, the ribbon winding roller 126 rotates. The conveyor roller drive shaft 23 is connected to the platen roller 25 and a pressing roller 28 via a gear mechanism (not illustrated). In accordance with driving of the conveyor roller drive shaft 23, a conveyor roller 101, the platen roller 25, and the pressing roller 28 rotate.

The cartridge holder 8 includes a cartridge sensor 31 (refer to FIG. 4) including a plurality (e.g., 5) of protrusions 30 to be selectively pressed. The cartridge sensor 31 is disposed at a lower support surface of the cartridge holder 8. The cartridge sensor 31 is positioned at a middle portion of the cartridge holder 8 in the front-rear direction and at a left end portion of the cartridge holder 8 in the right-left direction. The sensor protrusions 30 protrude from the support surface. In a state where the tape cartridge 100 is installed in the cartridge holder 8, a detected portion 100 of the tape cartridge 100 faces the sensor protrusions 39 and presses one or more of the sensor protrusions 39 based on a type of the tape cartridge 100. Based on a combination of on and off states of the sensor protrusions 30, the cartridge sensor 31 outputs a detection signal indicating the type of the tape cartridge 100.

The body 11 further includes a platen holder 26 at an upper right portion of the cartridge holder 8. The platen holder 26 has an arm-like shape and extends in the front-rear direction. The platen holder 26 is supported by a shaft 27 so as to be pivotable thereon. The platen roller 25 and the pressing roller 28 are rotatably supported by a front end portion of the platen holder 26. The conveyor roller drive shaft 23, the platen roller 25, and the pressing roller 28 constitute a conveyor unit. The platen roller 25 faces the thermal head 22 and may contact and separate from the thermal head 22. The pressing roller 28 faces the conveyor roller 101 and may contact and separate from the conveyor roller 101. The platen holder 26 is configured to move to a printing position, at which the platen roller 25 contacts the thermal head 22, by pivoting toward the cartridge holder 8. When the platen holder 26 is located at the printing position, the platen roller 25 presses the thermal head 22 via the printing tape 50 and the ink ribbon 127, and the pressing roller 28 presses the conveyor roller 10 via the printing tape 50. In this state, the printing tape 50 is conveyed in response to rotation of the conveyor roller 101, the platen roller 25, and the pressing roller 28. Additionally, the ink ribbon 127 is also drawn from the ink supply roll 128 in response to rotation of the ribbon winding roller 126. Thus, printing is performed on the printing tape 50 by the thermal head 22.

The body 11 further includes a full cutter 41 and a half cutter 42 in the vicinity of the discharge port 20. The full cutter 41 and the half cutter 42 constitute a cutting unit. The full cutter 41 is configured to perform full cutting of the printing tape 50, in which the full cutter 41 cuts the printing tape 50 completely (i.e., entirely) in a tape thickness direction along a tape width direction by driving of a drive motor 71 (refer to FIG. 4) disposed at a predetermined position in the body 11. More specifically, for example, the full cutter 41 is configured to cut all the way through a base 52*b* and an adhesive layer 52*a* of an adhesive sheet 52 and a release sheet 54. The half cutter 42 is configured to perform partial cutting of the printing tape 50, in which the half cutter 42 cuts the printing tape 50 incompletely (i.e., partially) in the tape thickness direction along the tape width direction by driving of a drive motor 73 (refer to FIG. 4) disposed at a predetermined position in the body 11. More specifically, for example, the half cutter 41 may be configured to cut the base 52*b* and the adhesive layer 52*a* of the adhesive sheet 52 only without cutting the release sheet 54 (or a part thereof). Multiple varieties of one or more printed labels (e.g., printed labels L1 of FIG. 5B or printed labels L2 of FIG. 5C) may be created by appropriate cutting of the same pre-formed printing tape 50 (e.g., partial cutting or full cutting) using the half cutter 42 or the full cutter 41.

<Configuration of Tape Cartridge>

Figure 3:
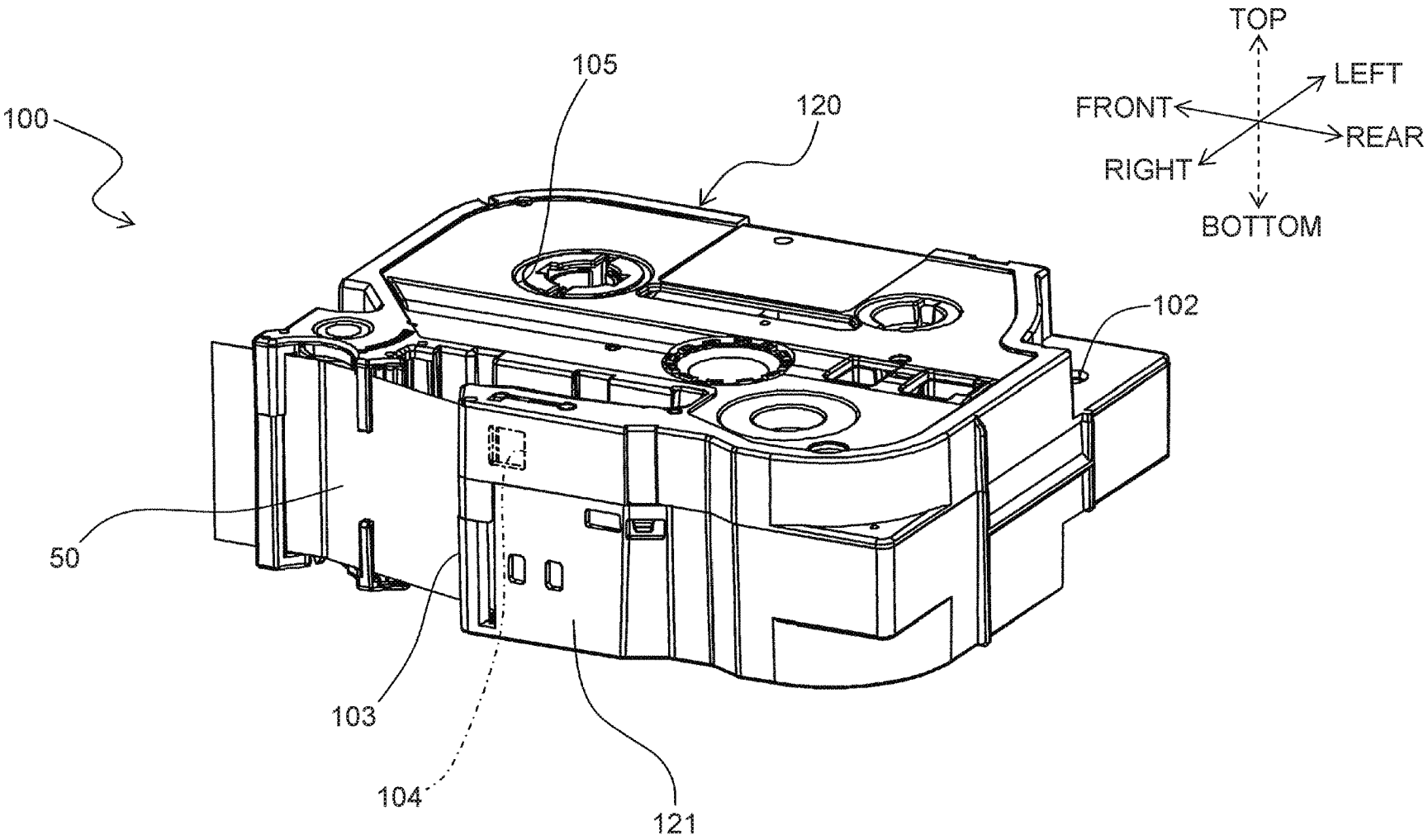
FIG. 3 is a perspective view of an external appearance of a tape cartridge in the first illustrative embodiment according to one or more aspects of the disclosure.

Referring to FIGS. 2 and 3, a configuration of the tape cartridge 100 will be described.

As illustrated in FIGS. 2 and 3, the tape cartridge 100 includes a casing 120 having a rectangular parallelepiped or box shape with rounded corners in plan view. The casing 120 has a tape outlet 103 at a front portion of a right surface portion. The printing tape 50 is drawn and supplied from the casing 120 through the tape outlet 103.

The casing 120 has a tape roll support recess 105 at its upper front portion. The tape roll support recess 105 supports a printing tape roll 51 so as to be rotatable within the casing 20. The printing tape roll 51 has the printing tape 50 that is wound around the printing tape roll 51. As illustrated in an enlarged view in FIG. 2, the printing tape 50 includes the adhesive sheet 52 and the release sheet 54 adhered to each other. In a roll of the printing tape 50, the adhesive sheet 52 is inside and the release sheet 54 is outside. In some instances, a side of each sheet facing left in the enlarged view of FIG. 2 may be a front side, while a side of each sheet facing right in the enlarged view of FIG. 2 may be a back side. The adhesive sheet 52 includes the base 52*b* on its front side. The adhesive sheet 52 is subjected to printing. More specifically, printing is performed on a front surface of the base 52*b* by the thermal head 22. The adhesive sheet 52 includes the adhesive layer 52*a* on the back side of the base 52*b*. The release sheet 54 may be adhered to the adhesive layer 52*a* in an easily releasable manner. That is, the adhesive sheet 52 is releasably adhered to a front surface 54*a*, which corresponds to a first surface, of the release sheet 54. In the first illustrative embodiment, a strip of adhesive sheet 52 is adhered to an entire portion of a strip of release sheet 54 to constitute the printing tape 50. In some examples, the release sheet 54 has a greater dimension in the tape conveyance direction (e.g., the direction in which the platen roller 25 conveys the printing tape 50) than in the tape width direction. In the printing process, the printing tape 50 is partially drawn from the printing tape roll 51 and printing is performed on a portion of the printing tape 50 by the thermal head 22. Then, the printed portion of the printing tape 50 is directed toward the discharge port 20 of the body 11.

The casing 120 includes the detected portion 110 at its lower surface. The detected portion 110 is disposed at a left end portion of the casing 120 in the right-left direction and at a middle portion of the casing 120 in the front-rear direction. The detected portion 110 represents type information on the tape cartridge 100. In one example, the detected portion 110 represents and indicates the type of the tape cartridge 100 by a position or pattern of insertion holes 111 on a surface 112 of the lower surface that may face the sensor protrusions 30 of the cartridge sensor 31 provided at the body 11 of the printer 1.

In some arrangements, the insertion holes 111 may be circular. In a state where the tape cartridge 100 is installed in the cartridge holder 8, the insertion holes 111 each function as a non-pressing portion that does not press any of the sensor protrusions 30. Thus, one or more sensor protrusions 30 facing the corresponding insertion holes 111 are in the off state (i.e., a non-pressed state)_. In a state where the tape cartridge 100 is installed in the cartridge holder 8, a portion of the surface 112 not having insertion holes 111 function as a pressing portion that presses one or more of the sensor protrusions 30. Thus, those pressed one or more sensor protrusions 30 facing the surface 112 are in the on state (i.e., a pressed state).

<Control Systems of Printer and Control Terminal>

Figure 4:
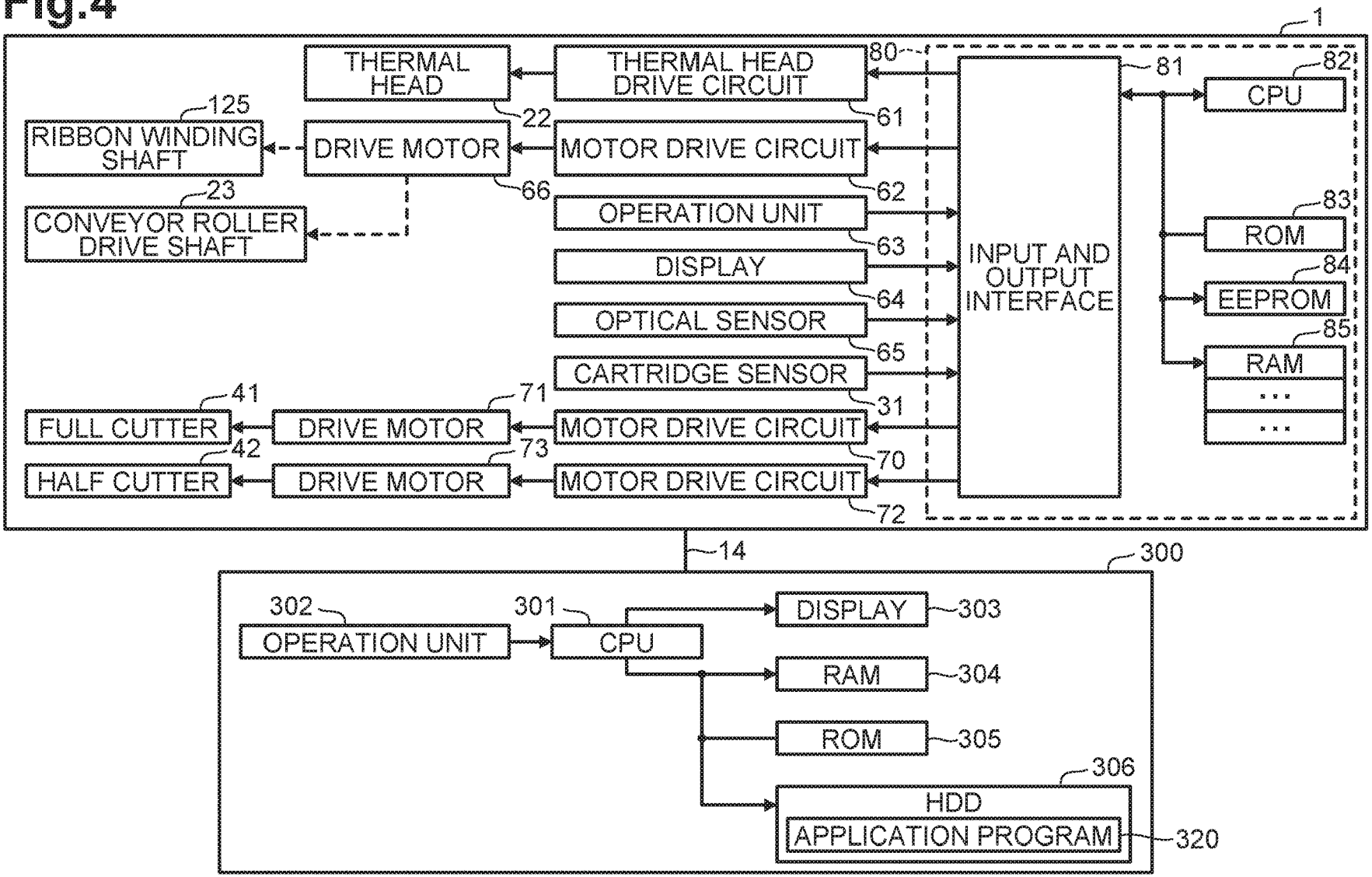
FIG. 4 is a block diagram of a control system of the printer and a control system of a control terminal in the first illustrative embodiment according to one or more aspects of the disclosure.

Referring to FIG. 4, a control system of the printer 1 and a control system of the control terminal 300 will be described.

As illustrated in FIG. 4, the printer 1 includes a control circuit 80 including a central processing unit ("CPU") 82, which corresponds to a controller. In the control circuit 80, a read-only memory ("ROM") 83, an electrically erasable programmable read-only memory ("EEPROM") 84, and a random access memory ("RAM") 85, and an input and output interface 81 are connected to the CPU 82 via a data bus. In other embodiments, for example, a nonvolatile memory, e.g., a flash memory, may be used instead of the EEPROM 84.

The ROM 83 stores various programs (e.g., computer-readable instructions) necessary for controlling the printer 1. The programs include a control program for implementing steps of a flowchart of FIG. 10. The CPU 82 is configured to perform overall control of the printer 1 by executing signal processing in accordance with the program stored in the ROM 83 while using a temporary storage function of the RAM 85.

The EEPROM 84 stores various information regarding different varieties or types of printing tapes 50. The information may be a stored correspondence or association between various positions or patterns of the insertion holes 111 on the surface 112 that may be detected and type information of tape cartridges 100. Thus, the CPU 82 may obtain the type information on the tape cartridge 100 installed in the cartridge holder 8 by referring to the correspondence based on a detection result of the tape cartridge 100.

Connected to the input and output interface 81 are a thermal head drive circuit 61, a motor drive circuit 62, an operation unit 63, a display 64, an optical sensor 65, the cartridge sensor 31, and the motor drive circuits 70 and 72.

The thermal head drive circuit 61 is configured to control driving of the thermal head 22.

The motor drive circuit 62 is configured to control driving of the drive motor 66 that drives the ribbon winding shaft 125 and the conveyor roller drive shaft 23.

The optical sensor 65 is provided for a die-cut type tape cartridge 100 storing a printing tape 50 having pre-printed sensor marks M. The optical sensor 65 is configured to irradiate the printing tape 50 with sensor light and detect the presence or absence of reflected light in response to the irradiation to determine a conveying status of the printing tape 50. The die-cut type tape cartridge 100 has a through hole 104 (which is illustrated by a dotted-and-dashed line in a sidewall portion 121 of the continuous-label type tape cartridge 100 in FIG. 3) at an upper portion of the tape outlet 103 in a sidewall portion 121. The irradiated sensor light passes through the through hole 104 of the tape cartridge 100 to reach the printing tape 50. Through the sensor light irradiation, the optical sensor 65 optically detects one of the sensor marks M (refer to FIG. 16) used for controlling positioning of the printing tape 50 during conveyance.

The motor drive circuit 70 is configured to control driving of the drive motor 71 for driving the full cutter 41.

The motor drive circuit 72 is configured to control driving of the drive motor 73 for driving the half cutter 42.

The control terminal 300 includes a control system including a CPU 301. Connected to the CPU 301 are an operation unit 302, a display 303, a RAM 304, a ROM 305, and a hard disk drive ("HDD") 306.

The control terminal 300 is connected to the printer 1 via the USB cable 14 and is configured to transmit and receive signals to and from the printer 1.

In the control terminal 300, an appropriate application program (e.g., an application program 320) stored in the HDD 306 is executed. The application program 320 may enable a user to specify and transmit data on the number of printed labels to be created by the printer 1 (hereinafter, referred to as quantity data) and print content data to be used for printing on the printed labels to the printer 1. For example, the user may specify and transmit such data by operating the operation unit 302 of the control terminal 300.

In one arrangement, in response to output of a print instruction signal including the label quantity data and print content data by user operation of the operation unit 302, the ribbon winding shaft 125 and the conveyor roller drive shaft 23 are driven by the motor drive circuit 62 and the drive motor 66. Thus, the printing tape 50 is drawn from the printing tape roll 51 and the ink ribbon 127 is drawn from the ink supply roller 128. In connection with the above driving, printing is performed on the printing tape 50 based on the print content data. More specifically, the heating elements of the thermal head 22 are driven selectively via the thermal head drive circuit 61 to transfer ink from the ink ribbon 127 onto the printing tape 50 being conveyed. Cutting is also performed one or more times on the printing tape 50 using the half cutter 42 driven via the motor drive circuit 72 and the drive motor 73 to cut the printing tape 50 incompletely/partially or using the full cutter 41 driven via the motor drive circuit 70 and the drive motor 71 to cut the printing tape 50 completely. Thus, one or more printed labels are created based on the quantity data.

<Features of First Illustrative Embodiment>

In the first illustrative embodiment, one or more printed labels each including a label body and an attaching portion are created. The label body has, for example, a desired indication/content printed thereon by the thermal head 22. The attaching portion is used for attaching the label body to an object. That is, a user uses each printed label in such a manner that an attaching portion of the printed label is attached to an object with a label body of the printed label being joined to the attaching portion. In this state, an indication or content printed on the label body is oriented in a desired direction relative to the object to which the label is attached.

In the first illustrative embodiment, in order to create one or more printed labels based on control of the CPU 82, as the thermal head 22 performs printing one or more times on the printing tape 50, each printed portion of the printing tape 50 is separated from its following printed portion or the remainder of the printing tape 50 by cutting using the half cutter 42 or by cutting using the full cutter 41. Thus, one or more label bodies and one or more attaching portions are formed. That is, printing and cutting (e.g., partial cutting or full cutting) are performed appropriately on a single printing tape 50 to form one or more label bodies and one or more attaching portions in the single printing tape 50. Therefore, in the first illustrative embodiment, applying different cutting intervals by the printer 1 on the single printing tape 50 may be used to easily create multiple varieties of printed labels using the same printing tape 50.

<Printing Tape Structure>

Figure 5A:
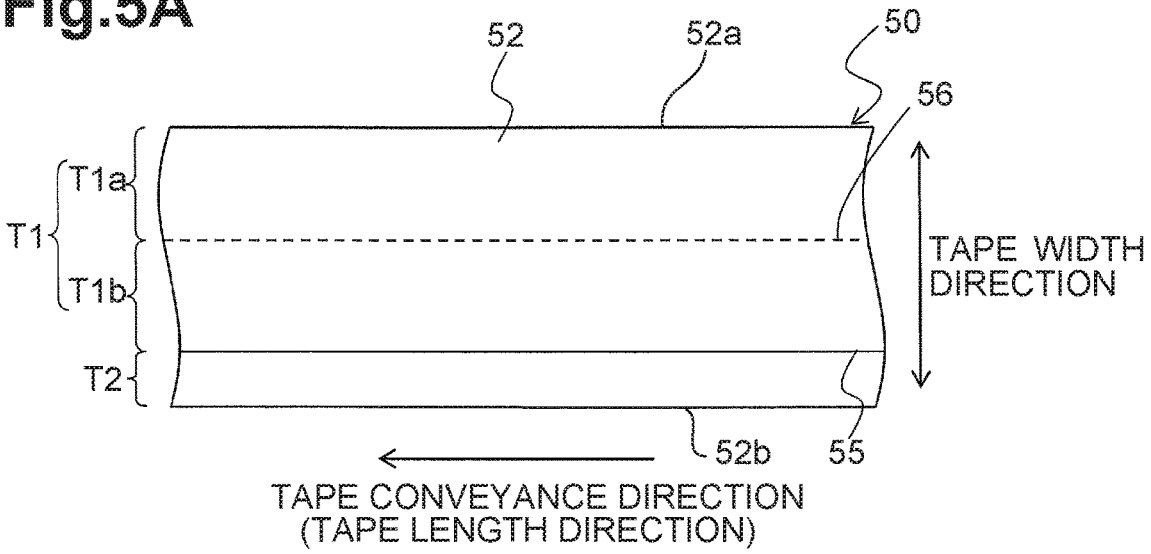
FIG. 5A is a partial plan view of a printing tape in the first illustrative embodiment according to one or more aspects of the disclosure.

Referring to FIG. 5A, a structure of the printing tape 50 according to the first illustrative embodiment will be described. FIG. 5A is a plan view of a portion of the printing tape 50 on which printing and cutting have not been performed. In FIG. 5A, a right-left direction corresponds to the tape conveyance direction (i.e., a tape length direction), the top-bottom direction corresponds to the tape width direction, and a direction from the near side to the far side or from the far side to the near side (i.e., a direction orthogonal to the right-left direction and the top-bottom direction) corresponds to the tape thickness direction. The printing tape 50 has one end 52*a* and the other end 52*b* with respect to the tape width direction. The one end 52*a* and the other end 52*b* correspond to an upper end and a lower end of the printing tape 50 with respect to the tape width direction.

As illustrated in FIG. 5A, the adhesive sheet 52 of the printing tape 50 has a split line 55, which corresponds to a slit, and a perforation line 56. The split line 55 is a straight line extends along the tape conveyance direction. The perforation line 56 is a dotted line extends along the tape conveyance direction and includes small holes that are spaced from each other at regular intervals in a row. The split line 55 and the small holes of the perforation line 56 both penetrate the adhesive sheet 52 in the tape thickness direction.

The split line 55 is offset to the other end 52*b* of the adhesive sheet 52 in the tape width direction such that a portion of the adhesive sheet 52 between the other end 52*b* and the split line 55 has a predetermined dimension in the tape width direction. The split line 55 divides the adhesive sheet 52 into a plurality of areas, for example, a first area T1 and a second area T2. The first area T1 is positioned on one-end side (e.g., an upper-end side in FIG. 5A) of the adhesive sheet 52 relative to the split line 55 in the tape width direction, while the second area T2 is positioned on the other-end side (e.g., a lower-end side in FIG. 5A) of the adhesive sheet 52 relative to the split line 55 in the tape width direction. Accordingly, the first area T1 and the second area T2 are positioned on opposite sides of the split line 55 in the tape width direction. The first area T1 is where desired print content is to be printed by the thermal head 22. The perforation line 56 is pre-formed at a middle portion of the first area T1 in the tape width direction. The perforation line 56 divides the first area T1 further into a plurality of sections such as a one-end side section T1*a* and the other-end side section T1*b*. The one-end side section T1*a* is positioned on the one-end side of the first area T1 relative to the perforation line 56 in the tape width direction. The other-end side section T1*b* is positioned on the other-end side of the first area T1 relative to the perforation line 56 in the tape width direction. The one-end side section T1*a* has a dimension equal to the other-end side section T1*b* in the tape width direction. The second area T2 has a dimension smaller than each of the one-end side section T1*a* and the other-end side section T1*b* in the tape width direction.

<Printed Label Creation>

In the first illustrative embodiment, based on control of the CPU 82 in response to the print instruction signal, one or more printed labels each including a label body and an attaching portion may be created based on the quantity data. More specifically, while the thermal head 22 prints content one or more times on the first area T1 of the printing tape 50 being conveyed by the platen roller 25, the half cutter 42 or the full cutter 41 cuts the printing tape 50 to separate each printed label from the subsequent printed label or the remainder of the printing tape 50. While the one or more printed labels are created, cutting might not be performed if unnecessary and/or cutting intervals may be changed. Such a control may enable creation of multiple varieties of printed labels using the same printing tape 50.

<One Example of Printed Labels to be Created>

Figure 5B:
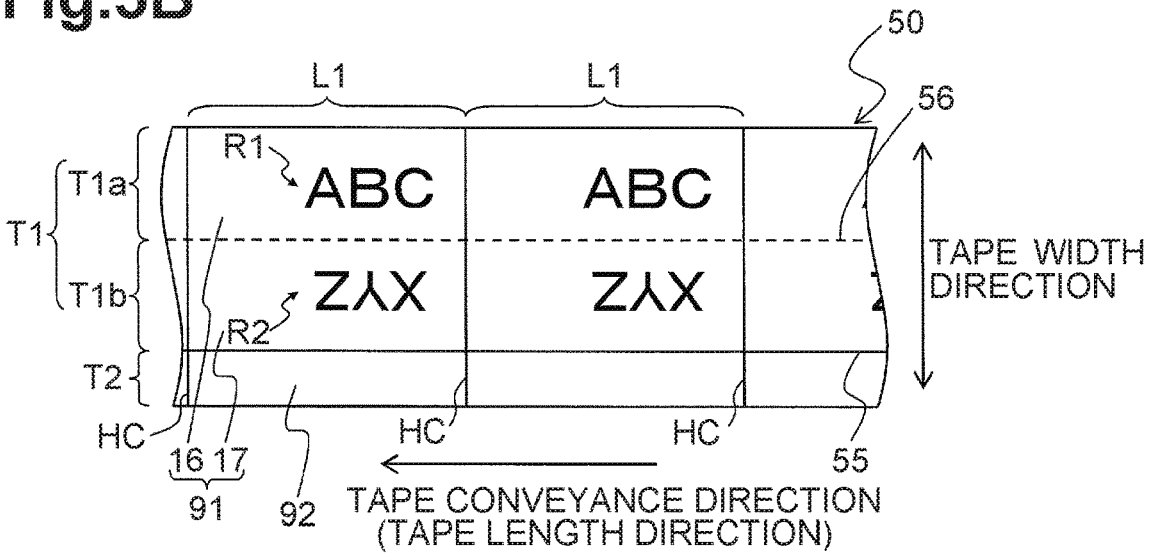
FIG. 5B is a partial plan view of the printing tape having printed labels of one example variety in the first illustrative embodiment according to one or more aspects of the disclosure.

FIG. 5B is a partial plan view of the printing tape 50 having printed labels of one example variety according to the first illustrative embodiment.

In this example, the one-end side section T1*a* has print contents R1 printed at regular intervals along the tape conveyance direction based on the print content data. Likewise, the other-end side section T1*b* has print contents R2 printed at regular intervals along the tape conveyance direction based on the print content data. As illustrated in FIG. 5B, as the print content R1 (e.g., a letter string "ABC"), is printed in the upright position along the tape conveyance direction. As the print content R2 (e.g., another letter string "XYZ"), is printed in the inverted orientation (e.g., in a 180-rotated orientation) relative to the orientation of print content R1 along the conveyance direction. The printing tape 50 has half cut lines HC, each of which is formed upstream from a respective pair of print contents R1 and R2, printed opposite to each other relative to the perforation line 56, in the conveyance direction. Each of the half cut lines HC may be a slit formed by partial cutting using the half cutter 42. Between each adjacent half cut lines HC formed at regular intervals, or between a downstream or leading end of the printing tape 50 and a most downstream half cut line HC in the tape conveyance direction, a printed label L1 including a label body 91 and an attaching portion 92 has been created. That is, the printing tape 50 has a plurality of printed labels L1 along the tape conveyance direction. The label body 91 corresponds to a printed tape portion, and the attaching portion 92 corresponds to an attaching tape portion. When creating the last printed label L1, the full cutter 41 cuts the printing tape 50 completely (i.e., full cutting) in contrast to the half cut lines HC in the printing tape 50B formed by half cutter 42.

A label body 91 may be formed in the following manner. For example, a print content R1 and a print content R2 are printed on the one-end side section T1*a* and the other-end side section T1*b*, respectively. Then, a half cut line HC is formed in or full cutting is performed on a particular portion of the printing tape 50 upstream from the printed area of the print contents R1 and R2 in the tape conveyance direction. Thus, a label body 91 is formed between adjacent half cut lines HC positioned on opposite sides of the first area T1 in which print contents R1 and R2 are printed or between a downstream or leading end of the printing tape 50 and the most downstream half cut line HC in the tape conveyance direction. The split line 55 and the half cut lines HC formed around the label body 91 may enable the label body 91 to be removed from the release sheet 54. The perforation line 56 is formed at a middle portion of the label body 91 in the tape width direction. The perforation line 56 may facilitate folding of the label body 91. In some arrangements, the label body 91 may be symmetric with respect to the perforation line 56.

The label body 91 includes a first label section 16 corresponding to the one-end side section T1*a* on which the print content R1 has been printed, and a second label section 17 corresponding to the other-end side section T1*b* on which the print content R2 has been printed. The first and second label sections 16 and 17 each have a rectangular shape with its longer sides extending along the tape conveyance direction and its shorter sides extending along the tape width direction. In the illustrated example, on a front side of the first label section 16 of each of the printed labels L1, the letter string "ABC" is printed as a print content R1 in the upright position along the conveyance direction. While the letter string "ABC" is positioned at a middle portion of the first label section 16 in the tape width direction, the letter string "ABC" is offset to an upstream end of the first label section 16 in the tape conveyance direction. On a front side of the second label section 17 of each of the printed labels L1, the letter string "XYZ" is printed as a print content R2 in the inverted orientation (i.e., in a 180-rotated orientation relative to the orientation of print content R1 in first label section 16) along the conveyance direction. While the letter string "XYZ" is positioned at a middle portion of the second label section 17 in the tape width direction, the letter string "XYZ" is offset to an upstream end of the second label section 17 in the tape conveyance direction.

An attaching portion 92 may be formed in a similar manner to forming the label body 91. For example, a print content R1 and a print content R2 are printed on the one-end side section T1*a* and the other-end side section T1*b*, respectively. Then, a half cut line HC is formed in or full cutting is performed on a particular portion of the printing tape 50 upstream from the printed area of the print contents R1 and R2 in the tape conveyance direction. Thus, an attaching portion 92 is formed between adjacent half cut lines HC positioned on opposite sides of the printed area of the print contents R1 and R2 printed on the first area T1 or between a downstream or leading end of the printing tape 50 and the most downstream half cut line HC in the tape conveyance direction. That is, the attaching portion 92 is positioned further to the other side than the label body 91 in the tape width direction. In other words, the attaching portion 92 is positioned on either side of the label body 91 in the tape width direction. The split line 55 and the half cut lines HC formed around the attaching portion 92 may enable the attaching portion 92 to be removed from the release sheet 54. The attaching portion 92 may be attached to an object 19 while being joined to the label body 91. The attaching portion 92 has a rectangular shape with its longer sides extending along the tape conveyance direction and its shorter sides extending along the tape width direction.

<Another Example of Printed Labels to be Created>

Figure 5C:
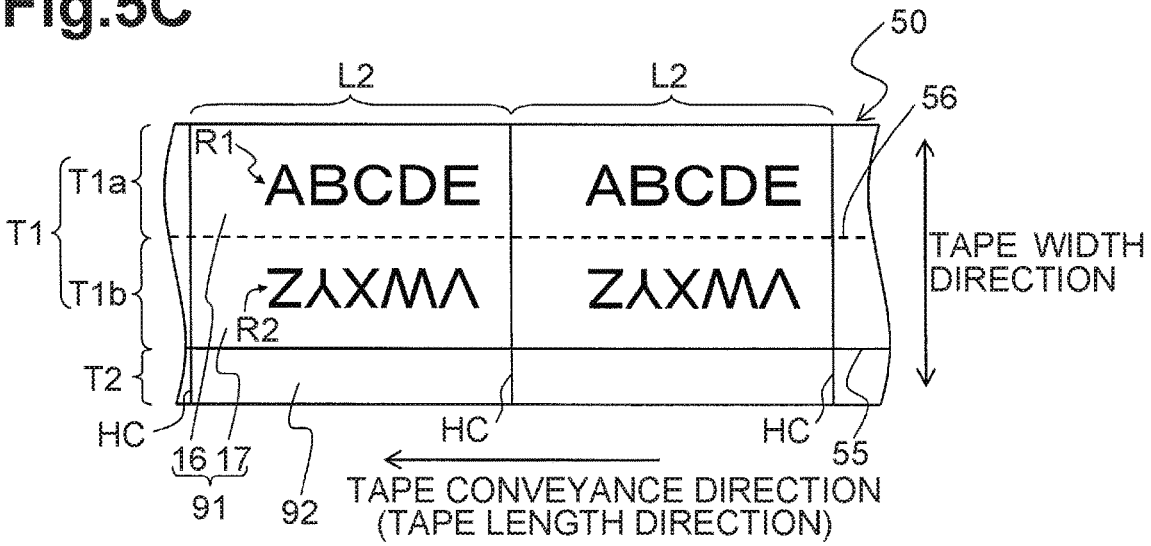
FIG. 5C is a partial plan view of the printing tape having printed labels of another example variety that is different from the variety of the printed labels of FIG. 5B in the first illustrative embodiment according to one or more aspects of the disclosure.

FIG. 5C is a partial plan view of the printing tape 50 having printed labels of another example type that is different from the type of the printed labels L1, according to the first illustrative embodiment.

Similar to the arrangement illustrated in FIG. 5B, in the example shown in FIG. 5C, the one-end side section T1*a* has print contents R1 printed based on the print content data at regular intervals along the tape conveyance direction. Likewise, the other-end side section T1*b* has print contents R2 printed based on the print content data at regular intervals along the tape conveyance direction. As illustrated in FIG. 5C, the print content R1 (e.g., a letter string "ABCDE") is printed in the upright state along the tape conveyance direction. The print content R2 (e.g., another letter string "VWXYZ") is printed along the conveyance direction in the inverted orientation relative to the orientation in which print content R1 is printed (e.g., in a 180-rotated orientation). A printing length of the letter string "ABCDE" is longer than a printing length of the letter string "ABC". A printing length of the letter string "VWXYZ" is longer than a printing length of the letter string "XYZ". Similar to the example illustrated in FIG. 5B, the printing tape 50 has half cut lines HC, each of which is formed upstream from a respective one of a pair of print contents R1 and R2 printed opposite to each other relative to the perforation line 56, in the conveyance direction. As described above, the printing length of each of the print contents R1 and R2 illustrated in FIG. 5C is longer than the printing length of a corresponding one of the print contents R1 and R2 illustrated in FIG. 5B. Therefore, intervals between half cut lines HC in the printing tape 50 are different from the intervals between half cut lines HC in the printing tape 50 of FIG. 5B. In this case, full cutting is performed on the printing tape 50 at a different timing from the example of FIG. 5B. Between each adjacent two of the half cut lines HC formed at regular intervals or between a downstream or leading end of the printing tape 50 and a most downstream half cut line HC in the tape conveyance direction, a printed label L2 including a label body 91 and an attaching portion 92, which is different from the printed label L1, has been created. That is, the printing tape 50 has a plurality of printed labels L2 along the tape conveyance direction. In this example, the intervals between half cut lines HC are greater than those in the example illustrated in FIG. 5B. When creating the last printed label L2, the full cutter 41 cuts the printing tape 50 completely (i.e., full cutting/through an entire thickness) rather than the half cutter 42 forming a half cut line HC in the printing tape 50.

Each printed label L2 has a similar structure to the printed label L1. Nevertheless, the label body 91 and the attaching portion 92 of the printed label L2 are longer in length than the label body 91 and the attaching portion 92 of the printed label L1 in the tape conveyance direction. On a front side of the first label section 16 of each of the printed labels L2, the letter string "ABCDE" is printed as a print content R1 in the upright state along the conveyance direction. While the letter string "ABCDE" is positioned at a middle portion of the first label section 16 in the tape width direction, the letter string "ABC" is offset to an upstream end of the first label section 16 in the tape conveyance direction. On a front side of the second label section 17 of each of the printed labels L2, the letter string "VWXYZ" is printed as a print content R2 in the inverted orientation (i.e., in a 180-rotated orientation) along the conveyance direction. While the letter string "VWXYZ" is positioned at a middle portion of the second label section 17 in the tape width direction, the letter string "VWXYZ" is offset to an upstream end of the second label section 17 in the tape conveyance direction.

<Usage Examples of Printed Labels>

Referring to FIGS. 6 to 9, usage examples of printed labels, such as those discussed with respect to FIGS. 5A-5C, will be described. Hereinafter, a printed label L1 is used for explaining the below usage examples.

<Using Printed Label as P-Type Label>

In FIGS. 6A, 6B, 7A, and 7B, a printed label L1 removed from the release sheet 54 in the printing tape 50 may be used as a P-type label which is the object 19 and the printed label L1 formed a P-like shape.

Figure 6A:
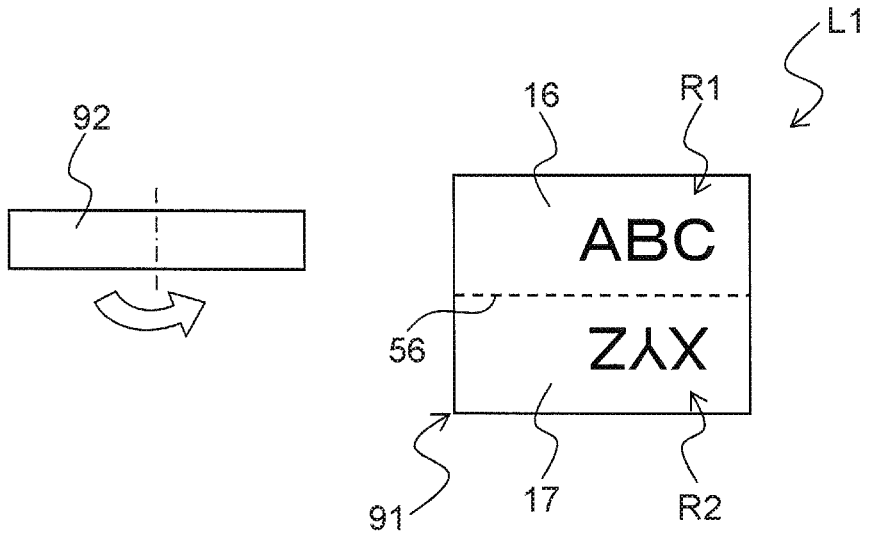
FIGS. 6A and 6B illustrate an usage example of a printed label in the first illustrative embodiment according to one or more aspects of the disclosure, wherein the printed label is used as a P-type label.
Figure 6B:
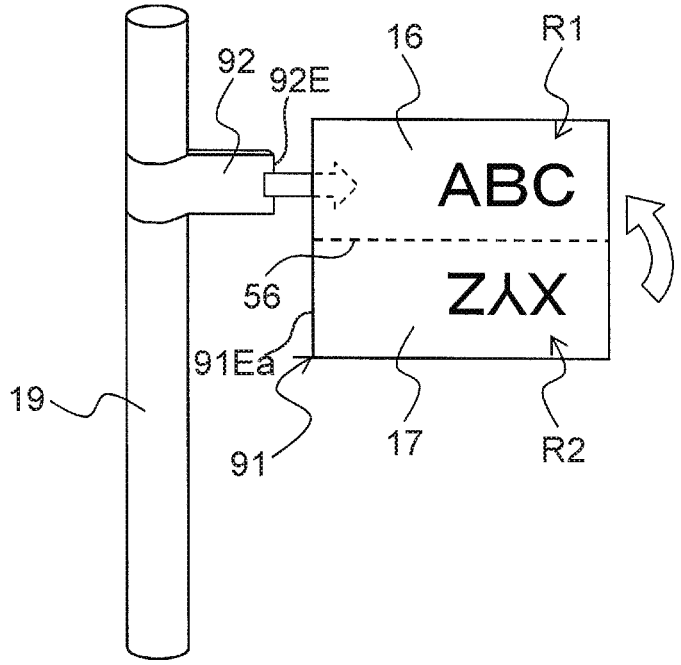

For using a printed label L1 as a P-type label, as illustrated in FIG. 6A, a label body 91 and an attaching portion 92 of the printed label L1 are removed from the release sheet 54 of the printing tape 50. Then, as illustrated in FIG. 6B, the attaching portion 92 is placed around an object, e.g., a cable-like or cylindrical object 19 having an axis extending in a top-bottom direction, and folded in half (refer to a hollow arrow in FIG. 6A) to adhere the back sides of facing portions of the attaching portion 92 to each other via the adhesive layer 52*a*. Subsequent to this, the label body 91 is folded along the perforation line 56, and the back sides of the first and second label sections 16 and 17 are adhered to each other via the adhesive layer 52*a*. Before the back sides of the first and second label sections 16 and 17 are adhered to each other when the label body 91 is mountain-folded, a distal end portion 92E (e.g., a right end portion in FIG. 6A) of the attaching portion 92 is inserted between the first and second label sections 16 and 17 from a side of the first end 91Ea of the label body 91 to be sandwiched therebetween.

Figure 7A:
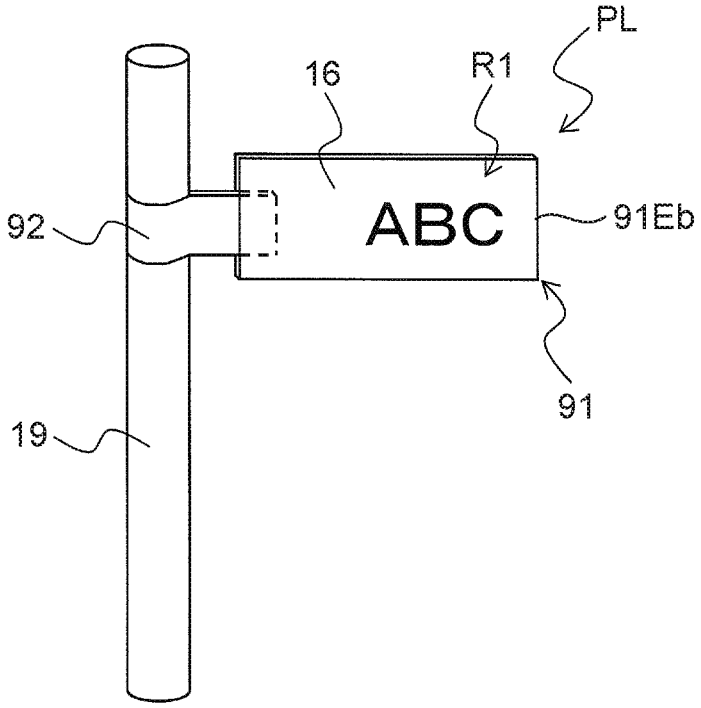
FIGS. 7A and 7B illustrate an appearance of the printed label used as the P-type label in the first illustrative embodiment according to one or more aspects of the disclosure.
Figure 7B:
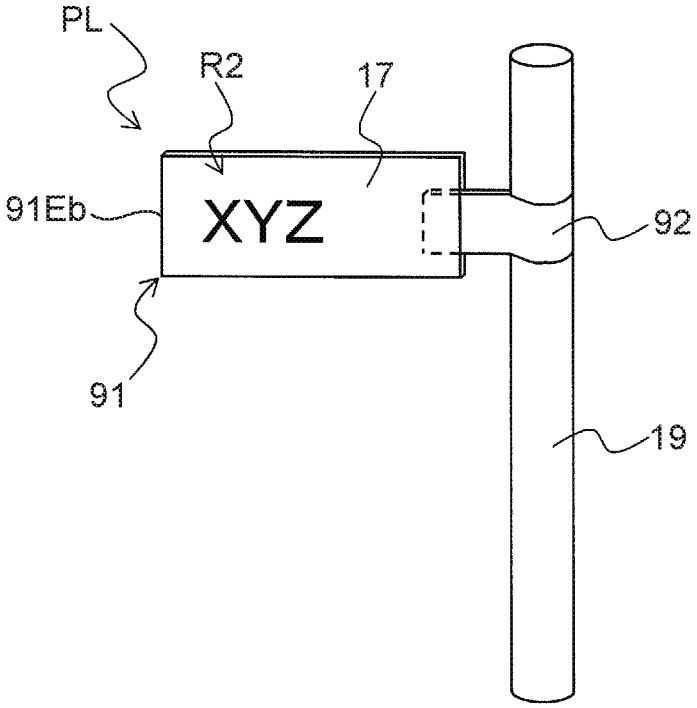

Thus, as illustrated in FIGS. 7A and 7B, the printed label L1 may be used as a P-type label PL. More specifically, the attaching portion 92 joined to the label body 91 is attached to the object 19 and the first and second label sections 16 and 17 adhered to each other extend from the attaching portion 92 in a direction perpendicular to the axial direction of the object 19.

FIG. 7A is a front view (e.g., the first label section 16 side) of the P-type label PL attached to the object 19. As illustrated in FIG. 7A, in the first label section 16, print content R1 includes the letter string "ABC" on a front side in the upright state and is offset to a second end 91Eb opposite to the first end 91Ea that is joined to the attaching portion 92.

FIG. 7B is a rear view (e.g., the second label area 17 side) of the P-type label PL attached to the object 19. As illustrated in FIG. 7B, in the second label section 17, print content R2 includes the letter string "XYZ" on a front side in the upright state and is offset to the second end 91Eb opposite to the first end 91Ea that is joined to the attaching portion 92.

<Using Printed Label as T-Type Label>

In FIGS. 8A, 8B, 9A, and 9B, a printed label L1 removed from the release sheet 54 of the printing tape 50 may be used as a T-type label which is the object 19 and the printed label L1 formed a T-like shape.

Figure 8A:
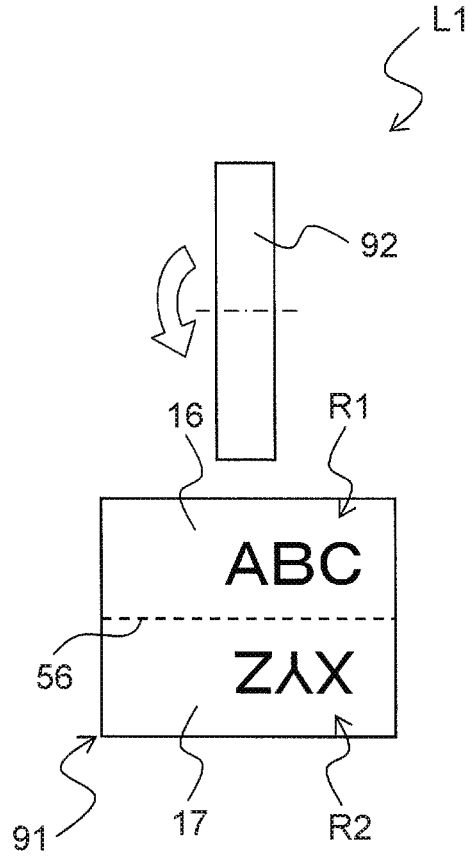
FIGS. 8A and 8B illustrate another usage example of the printed label in the first illustrative embodiment according to one or more aspects of the disclosure, wherein the printed label is used as a T-type label.
Figure 8B:
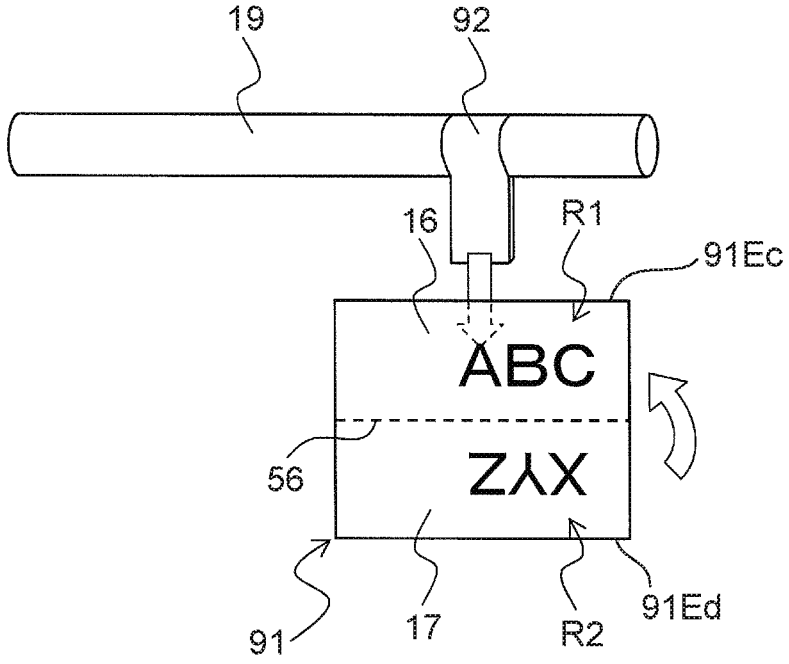

When the printed label L1 is used as the P-type label PL, the distal end portion 92E of the attaching portion 92 that is placed around the object 19 and whose back sides of the facing portions are adhered to each other is sandwiched between the first and second label sections 16 and 17 at the first end 91Ea of the label body 91. When the printed label L1 is used as the T-type label TL, the attaching portion 92 is placed around the object 19 and folded in half to adhere the back sides of facing portions of the attaching portion 92 to each other, as illustrated in FIGS. 8A and 8B. Subsequent to this, the distal end portion 92E of the attaching portion 92 is inserted between an end 91Ec of the first label section 16 and an end 91Ed the second label section 17 of the incompletely or partially folded label body 91. When label body 91 is folded along the perforation line 56, the end 91Ec of the first label section 16 and the end 91Ed of the second label section 17 face each other and may be an upper end of the printed label L1.

Figure 9A:
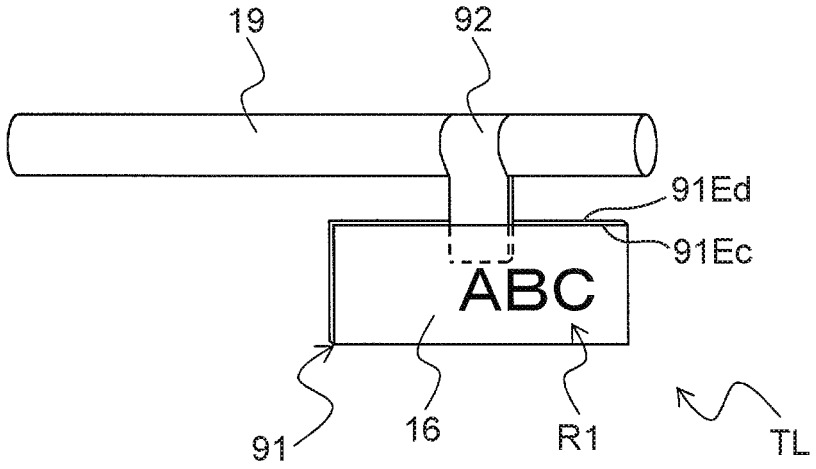
FIGS. 9A and 9B illustrate an appearance the printed label used as the T-type label in the first illustrative embodiment according to one or more aspects of the disclosure.
Figure 9B:
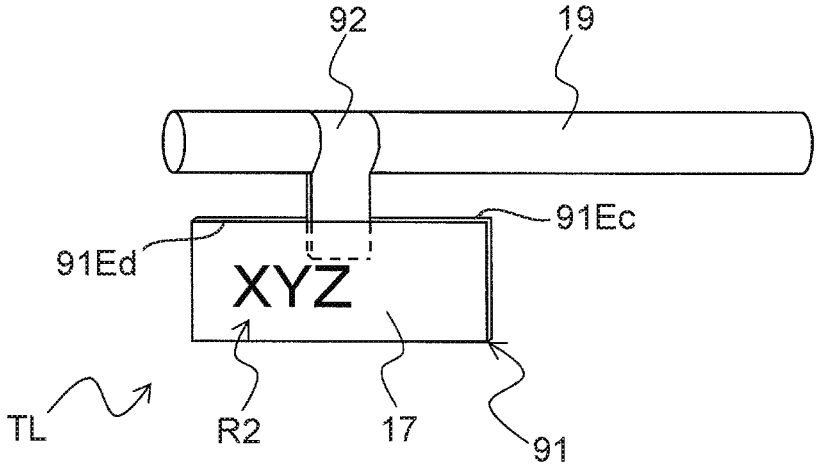

Thus, as illustrated in FIGS. 9A and 9B, the printed label L1 may be used as a T-type label TL. More specifically, the attaching portion 92 joined to the label body 91 is attached to the object 19 and the longer sides (e.g., the ends 91Ec and 91Ed) of the first and second label sections 16 and 17 adhered to each other extend parallel to the axial direction of the object 19.

<Control Procedure>

Figure 10:
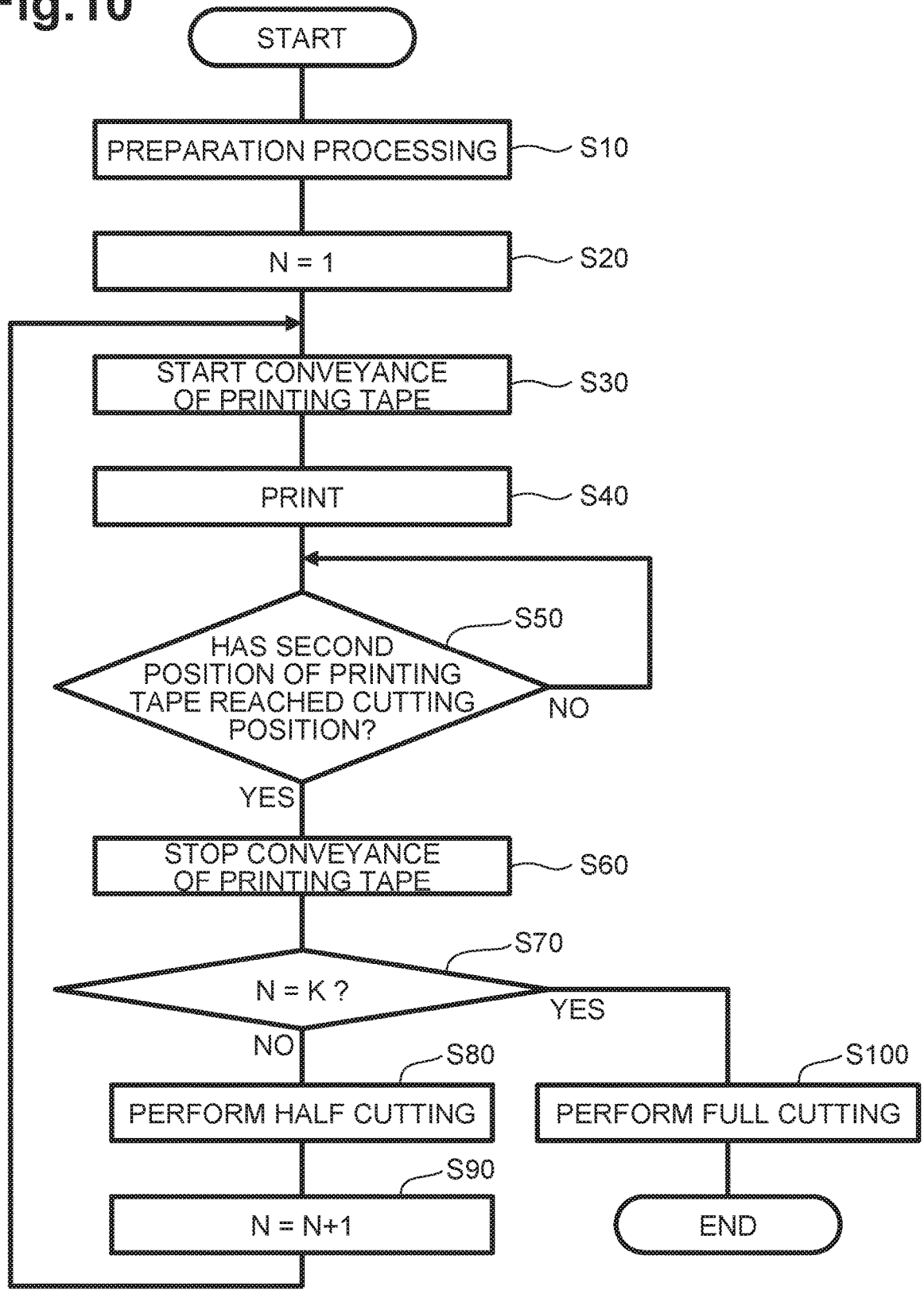
FIG. 10 is a flowchart of a control procedure executed by a CPU of the printer in the first illustrative embodiment according to one or more aspects of the disclosure.

Referring to FIG. 10, a control procedure executed by the CPU 82 of the printer 1 for creating one or more printed labels L1 or L2 using the printing tape 50 will be described.

In some arrangements, the process of FIG. 10 starts in response to input of a print instruction signal to the printer 1 from the control terminal 300.

In step S10, the CPU 82 executes preparation processing. In the preparation processing, for example, based on label quantity data and print content data included in the print instruction signal, the CPU 82 determines a first position and a second position with respect to the printing tape 50. The first position may be where printing is performed when the first position reaches a printing position of the printer 1. The second position may be where cutting is performed when the second position reaches a cutting position of the printer 1.

In step S20, the CPU 82 initializes a value of a counter variable N, which corresponds to a printing order number, to 1 (one) (e.g., N=1). Value K indicates the last printing order number that corresponds to the value indicated by the label quantity data. That is, the printing order number N indicates an order number of the current printing within the print content data on the printing tape 50 to be printed on the printing tape 50.

In step S30, the CPU 82 controls the drive motor 66 via the motor drive circuit 62 to start conveyance of the printing tape 50.

In step S40, in response to arrival of the first position of the printing tape 50 at the printing position, the CPU 82 controls the thermal head 22 via the thermal head drive circuit 61 to print print contents R1 and R2 on the end side sections T1*a* and T1*b*, respectively, of the printing tape 50 based on the print content data.

In step S50, the CPU 82 determines whether the second position of the printing tape 50 has reached the cutting position. The second position is located upstream from the printed portion of the print contents R1 and R2 in the tape conveyance direction. In step S50, the CPU 82 makes a negative determination (e.g., NO in step S50) until the second position of the printing tape 50 reaches the cutting position. The process loops until the CPU 82 makes a positive determination (e.g., YES in step S50). In particular, the CPU 82 makes a positive determination (e.g., YES in step S50) When the second position of the printing tape 50 has reached the cutting position. The routine then proceeds to step S60.

In step S60, the CPU 82 controls the drive motor 66 via the motor drive circuit 62 to stop conveyance of the printing tape 50.

In step S70, the CPU 82 determines whether the current value of the counter variable N is equal to the value K corresponding to the label quantity data. In step S70, when the current value of the counter variable N is not equal to the value K, the CPU 82 makes a negative determination (e.g., NO in step S70) and the routine proceeds to step S80.

In step S80, the CPU 82 controls the drive motor 73 via the motor drive circuit 77 to cut the printing tape 50 incompletely (e.g., perform partial cutting) to form a half cut line HC in the printing tape 50 at the cutting position. Thus, between a half cut line HC formed at the immediately preceding cutting and the half cut line HC formed at this-time partial cutting or between a downstream or leading end of the printing tape 50 in the tape conveyance direction and the half cut line HC formed at this-time partial cutting, a printed label including a label body 91 having the print contents R1 and R2 printed thereon and an attaching portion 92 is created.

In step S90, the CPU 82 adds 1 (one) to the current value of the counter variable N. Then, the routine returns to step S30 and proceeds in the same or similar procedure.

In step S70, when the value of the counter variable N is equal to the value K, the CPU 82 makes a positive determination (e.g., YES in step S70) and the routine proceeds to step S100.

In step S100, the CPU 82 controls the drive motor 71 via the motor drive circuit 70 to cut the printing tape 50 completely (e.g., perform full cutting). Thus, between the half cut line HC formed at the immediately preceding cutting and the full cut line formed at the current or present full cutting, a printed label including a label body 91 having the print contents R1 and R2 printed thereon and an attaching portion 92 is created. Simultaneously with this, a portion of the printing tape 50 having one or more created printed labels is separated from the printing tape 50. The number of created labels that the separated portion of the printing tape 50 has corresponds to the value represented by the label quantity data. Then, the routine of the flowchart of FIG. 10 ends.

<Effects Obtained by First Illustrative Embodiment>

In the first illustrative embodiment, as described above, based on control of the CPU 82, while a label body 91 is formed by printing that is performed by the thermal head 22 on the printing tape 50 being conveyed by the platen roller 25, an attaching portion 92 is formed by cutting that is performed by the half cutter 42 or by the full cutter 41 on the printing tape 50 being conveyed. That is, the label body 91 is formed by printing at an appropriate position of the printing tape 50 and the attaching portion 92 is formed by cutting at an appropriate position of the printing tape 50. Therefore, in the first illustrative embodiment, changing the cutting intervals in the single printing tape 50 may enable easy creation of multiple different varieties of printed labels using the same printing tape 50.

In particular, in the first illustrative embodiment, while the printing tape 50 having the split line 55 extending in the tape conveyance direction is conveyed, the attaching portion 92 is formed on the other-end side portion opposite to the label body 91 relative to the split line 55 in the tape width direction. Thus, waste portions are either not created or minimized.

Second Illustrative Embodiment

Hereinafter, a second illustrative embodiment will be described. An explanation will be given mainly for the components different from the first illustrative embodiment, and an explanation will be omitted for the common components by assigning the same reference numerals thereto.

<Printing Tape Structure>

Figure 11A:
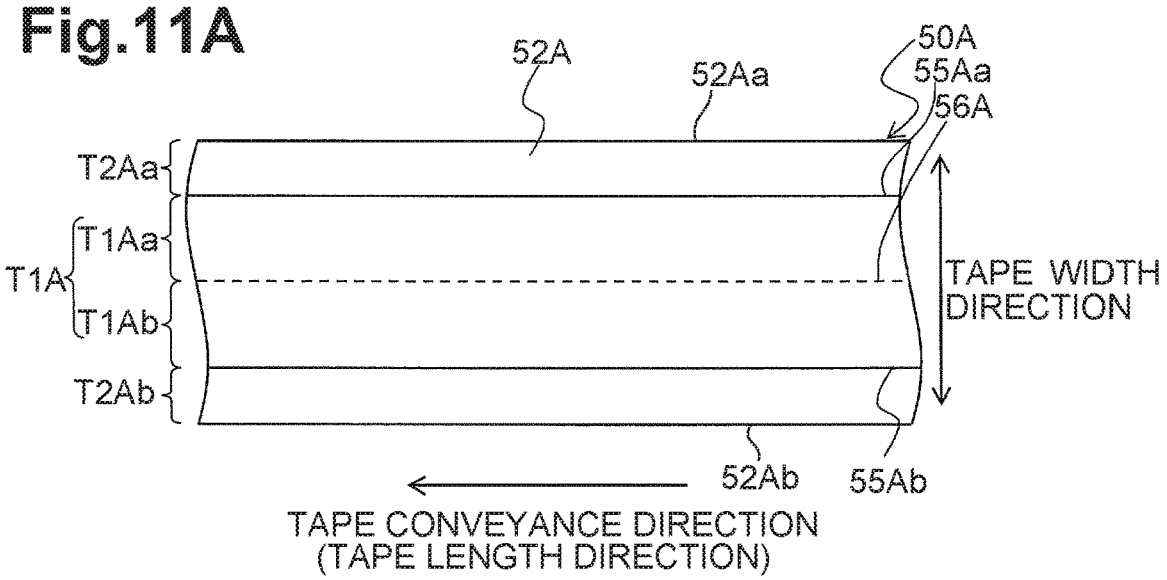
FIG. 11A is a partial plan view of a printing tape in a second illustrative embodiment according to one or more aspects of the disclosure.

Referring to FIG. 11A, a structure of a printing tape according to the second illustrative embodiment will be described.

As illustrated in FIG. 11A, a printing tape 50A has a similar structure to the printing tape 50 of the first illustrative embodiment. More specifically, the printing tape 50A includes an adhesive sheet 52A, which corresponds to a second sheet, and a release sheet 54. The adhesive sheet 52A has a base 52*b* on its front side and an adhesive layer 52*a* on its back side. The adhesive sheet 52A is removably adhered to a surface 54*a* of the release sheet 54.

As illustrated in FIG. 11A, the adhesive sheet 52A of the printing tape 50A has a plurality (e.g., two) of split lines 55Aa and 55Ab, each of which corresponds to the slit, and a perforation line 56A. The split lines 55Aa and 55Ab extend along the tape conveyance direction. The perforation line 56A extends along the tape conveyance direction. The split lines 55Aa and 55Ab and the perforation line 56A each penetrate the adhesive sheet 52A in the tape thickness direction.

The printing tape 50A has one end 52Aa (e.g., an upper end in FIG. 11A) and the other end 55Ab (e.g., a lower end in FIG. 11B) in the tape width direction. The split line 55Aa is offset to the one end 52Aa of the adhesive sheet 52A in the tape width direction to have a portion of the adhesive sheet 52A between the one end 52Aa of the adhesive sheet 52A and the split line 55Aa have a predetermined dimension in the tape width direction. The split line 55Ab is offset to the other end 52Ab of the adhesive sheet 52A in the tape width direction such that a portion of the adhesive sheet 52A disposed between the other end 52Ab of the adhesive sheet 52A and the split line 55Ab have a predetermined dimension in the tape width direction. The split lines 55Aa and 55Ab divide the adhesive sheet 52A into a plurality of areas such as a first area T1A and second areas T2Aa and T2Ab. The first area T1A is positioned between the split lines 55Aa and 55Ab in the tape width direction. The second area T2Aa is positioned on one-end side (e.g., an upper-end side in FIG. 11A) of the adhesive sheet 52A relative to the split line 55Aa in the tape width direction. The second area T2Ab is positioned on the other-end side (e.g., a lower-end side in FIG. 11A) of the adhesive sheet 52A relative to the split line 55Ab in the tape width direction. That is, the second area T2Aa is positioned opposite to the first area T1A relative to the split line 55Aa, and the second area T2Ab is positioned opposite to the first area T1A relative to the split line 55Ab. In other words, while the second areas T2Aa and T2Ab sandwich the first area T1A and the split lines 55Aa and 55Ab in the tape width direction, the second areas T2Aa and T2Ab are positioned opposite to each other relative to the first area T1A in the tape width direction. The first area T1A is subject to printing of a desired print content by the thermal head 22. The perforation line 56A is formed at a middle portion of the first area T1A in the tape width direction. The perforation line 56A divides the first area T1A further into a plurality of sections such as a one-end side section T1Aa and another-end side section T1Ab. The one-end side section T1Aa is positioned on the one-end side of the first area T1A relative to the perforation line 56A in the tape width direction. The other-end side section T1Ab is positioned on the other-end side of the first area T1A relative to the perforation line 56A in the tape width direction. The one-end side section T1Aa and the other-end side section T1Ab have an equal dimension in the tape width direction. The second sections T2Aa and T2Ab have a dimension in the tape width direction smaller than that of the one-end side section T1Aa and the other-end side section T1Ab.

<Printed Label Creation>

In the second illustrative embodiment, based on control of the CPU 82 in response to the print instruction signal, one or more printed labels, each including a label body and an attaching portion, may be created based on the quantity data. More specifically, while the thermal head 22 prints print content based on the print content data one or more times on the first area T1A of the printing tape 50A being conveyed by the platen roller 25, the half cutter 42 or the full cutter 41 cuts the printing tape 50A to separate each printed label from its subsequent printed label or the remainder of the printing tape 50. While the one or more printed labels are created, cutting might not be performed if unnecessary and/or cutting intervals may be changed. Such a control may enable creation of different varieties of printed labels using the same printing tape 50.

<One Example of Printed Labels to be Created>

Figure 11B:
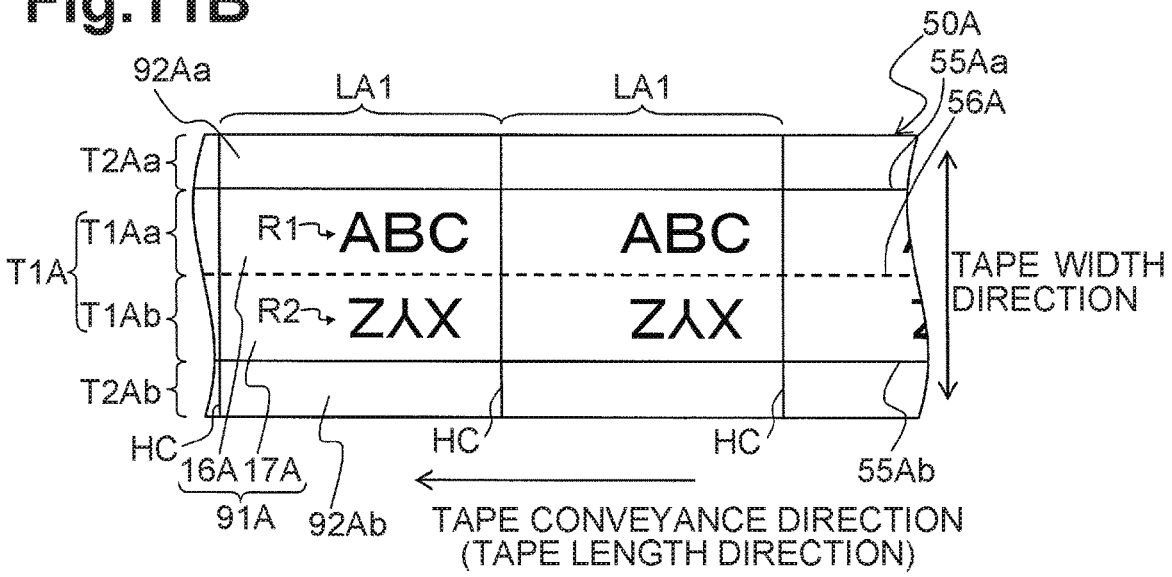
FIG. 11B is a partial plan view of the printing tape having printed labels of one example variety in the second label second illustrative embodiment according to one or more aspects of the disclosure.

FIG. 11B is a partial plan view of the printing tape 50A having printed labels of one example type according to the second illustrative embodiment.

In this example, the one-end side section T1Aa has print contents R1 printed at regular intervals along the tape conveyance direction based on the print content data. Likewise, the other-end side section T1Ab has print contents R2 printed at regular intervals along the tape conveyance direction based on the print content data. As illustrated in FIG. 11B, as the print content R1 (e.g., a letter string "ABC"), is printed in the upright position along the tape conveyance direction. As the print content R2 (e.g., another letter string "XYZ"), is printed in the inverted orientation (e.g., in a 180°-rotated orientation) relative to the orientation of content R1 along the conveyance direction. The printing tape 50A has half cut lines HC, each of which is formed upstream, in the conveyance direction, from each respective pair of print contents R1 and R2 printed opposite to each other relative to the perforation line 56. Between each adjacent two of the half cut lines HC formed at regular intervals or between a downstream or leading end of the printing tape 50A and a most downstream half cut line HC in the tape conveyance direction, a printed label LA1 including a label body 91A and a plurality of (e.g., two) attaching portions 92Aa and 92Ab are created. Accordingly, the printing tape 50A may include a plurality of printed labels LA1 along the tape conveyance direction. The label body 91A corresponds to the printed tape portion, and the attaching portions 92Aa and 92Ab each correspond to the attaching tape portion. When creating the last printed label LA1, the full cutter 41 cuts the printing tape 50 completely (i.e., full cutting) rather than the half cutter 42 forming a half cut line HC in the printing tape 50A.

A label body 91A may be formed in the following manner. For example, a print content R1 and a print content R2 are printed on the one-end side section T1Aa and the other-end side section T1Ab, respectively. Then, a half cut line HC is formed in or full cutting is performed on a particular portion of the printing tape 50 upstream from the printed area (containing the print contents R1 and R2) in the tape conveyance direction. Thus, a label body 91A is formed between adjacent half cut lines HC positioned on opposite sides of the printed area having the print contents R1 and R2 or between a downstream or leading end of the printing tape 50A and the most downstream half cut line HC in the tape conveyance direction. The split lines 55Aa and 55Ab and the half cut lines HC formed around the label body 91A may enable (or otherwise facilitate) the removal of the label body 91A from the release sheet 54. The perforation line 56A is formed at a middle portion of the label body 91A in the tape width direction. The perforation line 56A may be a fold line that facilitates folding of the label body 91A. The label body 91A is symmetric with respect to the perforation line 56A.

The label body 91A includes a first label section 16A corresponding to the one-end side section T1Aa on which the print content R1 has been printed, and a second label section 17A corresponding to the other-end side section T1Ab on which the print content R2 has been printed. The first and second label sections 16A and 17A each have a rectangular shape with its longer sides extending along the tape conveyance direction and its shorter sides extending along the tape width direction.

Attaching portions 92Aa and 92Ab may be formed in a similar manner to forming the label body 91A. For example, a print content R1 and a print content R2 are printed on the one-end side section T1Aa and the other-end side section T1Ab, respectively. Then, a half cut line HC is formed in or full cutting is performed on a particular portion of the printing tape 50A upstream from the printed area having the print contents R1 and R2 in the tape conveyance direction. Thus, an attaching portion 92Aa is formed in the second area T2Aa between adjacent half cut lines HC positioned on opposite sides of the printed area having the print contents R1 and R2 or between a downstream or leading end of the printing tape 50A and the most downstream half cut line HC in the tape conveyance direction. Another attaching portion 92Ab is formed in the second area T2Ab between adjacent half cut lines HC positioned on opposite sides of the printed area of the print contents R1 and R2 printed on the first area T1A or between the downstream or leading end of the printing tape 50A and the most downstream half cut line HC in the tape conveyance direction. That is, the attaching portion 92Aa is positioned further to the one side than the label body 91A in the tape width direction, and the attaching portion 92Ab is positioned further to the other side than the label body 91A in the tape width direction. In other words, the attaching portions 92Aa and 92Ab are opposite sides of the label body 91A in the tape width direction. The attaching portions 92Aa and 92Ab each have a rectangular shape with its longer sides extending along the tape conveyance direction and its shorter sides extending along the tape width direction.

<Another Example of Printed Labels to be Created>

Figure 11C:
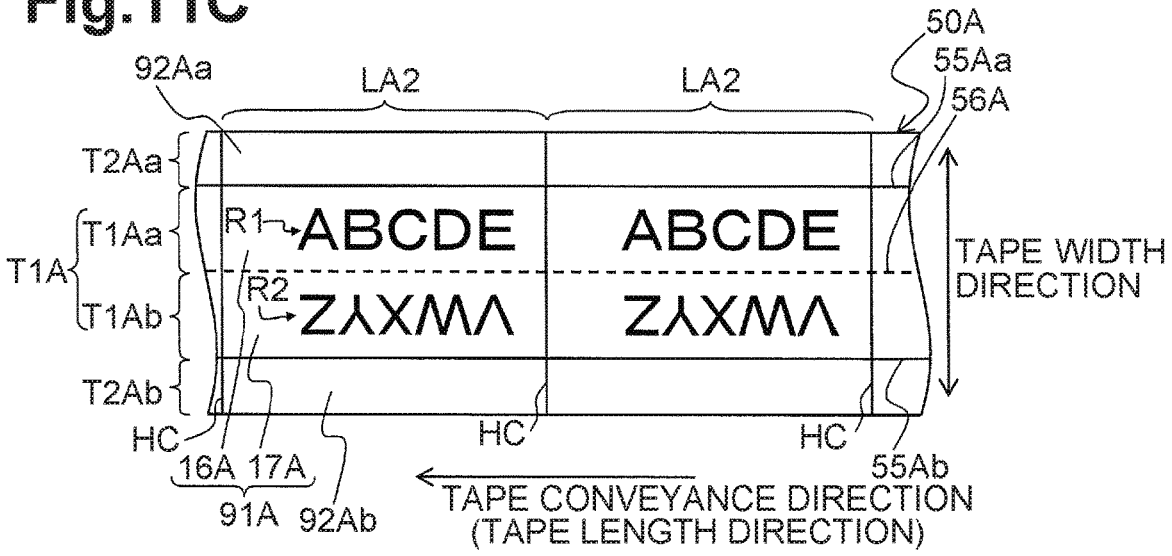
FIG. 11C is a partial plan view of the printing tape having printed labels of another example variety that is different from the variety of the printed labels of FIG. 11B in the second illustrative embodiment according to one or more aspects of the disclosure.

FIG. 11C is a partial plan view of the printing tape 50A having printed labels of another example type that is different from the type of the printed labels LA1, according to the second illustrative embodiment.

Similar to the example illustrated in FIG. 11B, in as the example shown in FIG. 11C, the one-end side section T1Aa has print content R1 printed at regular intervals along the tape conveyance direction based on the print content data. Likewise, the other-end side section T1Ab has print content R2 printed at regular intervals along the tape conveyance direction based on the print content data. As further illustrated in FIG. 11C, as the print content R1 (e.g., a letter string "ABCDE") is printed in the upright position along the tape conveyance direction. As the print content R2 (e.g., another letter string "VWXYZ") is printed in the inverted orientation (e.g., in a 180-rotated orientation), relative to the orientation in which print content R1 is printed, along the conveyance direction. Similar to the example illustrated in FIG. 11B, the printing tape 50A has half cut lines HC, each of which is formed upstream from each pair of print contents R1 and R2 printed opposite to each other relative to the perforation line 56, in the conveyance direction. Because the printing length of each of the print contents R1 and R2 illustrated in FIG. 11C is longer than the printing length of a corresponding one of the print contents R1 and R2 illustrated in FIG. 11B, intervals between half cut lines HC in the printing tape 50A of FIG. 11C are different from the intervals between half cut lines HC in the printing tape 50A of FIG. 11B. In this case, full cutting is performed on the printing tape 50A at a different timing from the example of FIG. 11B. Between each adjacent two of the half cut lines HC formed at regular intervals or between a downstream or leading end of the printing tape 50A and a most downstream half cut line HC in the tape conveyance direction, a printed label LA2 including a label body 91 and attaching portions 92Aa and 92Ab, which is different from the printed label LA1, is created. That is, the printing tape 50A has a plurality of printed labels L2 along the tape conveyance direction. In this example, the interval between each adjacent two of the half cut lines HC is greater than that of the example illustrated in FIG. 11B. When creating the last printed label LA2, the full cutter 41 cuts the printing tape 50A completely (i.e., full cutting) rather than the half cutter 42 forms a half cut line HC in the printing tape 50A.

Each printed label LA2 has a similar structure to the printed label LA1. However, the label body 91A and the attaching portions 92Aa and 92Ab of the printed label LA2 are longer in length than the label body 91 and the attaching portions 92Aa and 92Ab of the printed label LA1 in the tape conveyance direction in view of the relative lengths of the respective content printed on each label.

<Effects Obtained by Second Illustrative Embodiment>

In the second illustrative embodiment, and similar to the first illustrative embodiment, the intervals of cutting performed by the half cutter 42 or the full cutter 41 may be changed. The ability to modify the cutting interval may enable creation of multiple varieties or types of printed labels using the single printing tape 50D. Thus, waste portions (e.g., portions not used as part of a printed label) may be minimized or not produced from the adhesive sheet 52A.

In particular, while the printing tape 50A having the split lines 55Aa and 55Ab extending in the tape conveyance direction is conveyed, the attaching portion 92Aa is formed at a position further to the one side than the label body 91A in the tape width direction and the attaching portion 92Ab is formed at a position further to the other side than the label body 91A in the tape width direction. Thus, printing may be performed on a middle portion of the printing tape 50A in the tape width direction.

Third Illustrative Embodiment

Hereinafter, a third illustrative embodiment will be described. An explanation will be given for the components which differ from the first illustrative embodiment, and description will be omitted for common components by assigning the same reference numerals thereto.

<Printing Tape Structure>

Figure 12A:
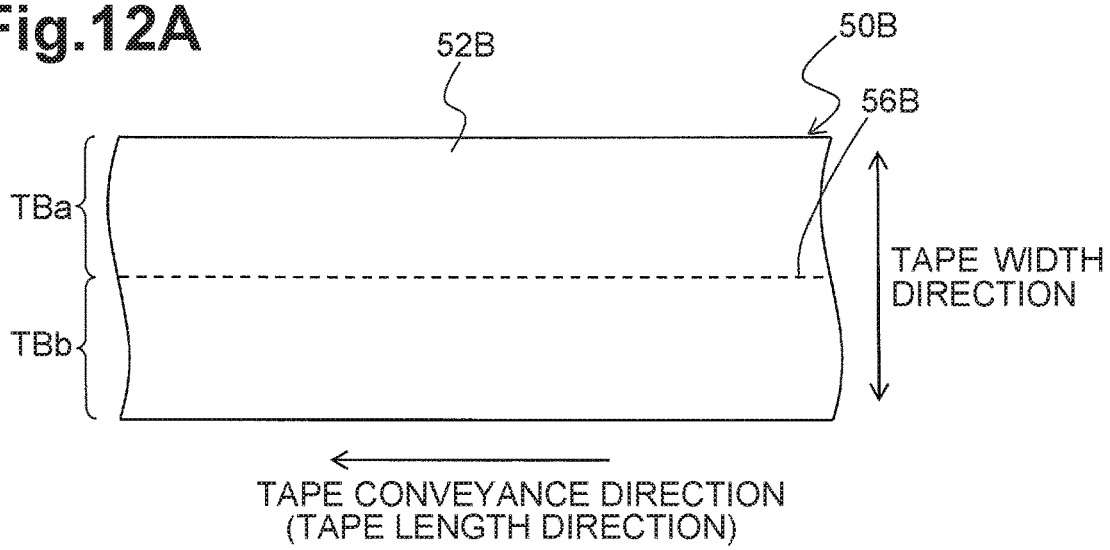
FIG. 12A is a partial plan view of a printing tape in a third illustrative embodiment according to one or more aspects of the disclosure.

Referring to FIG. 12A, a structure of a printing tape according to the third illustrative embodiment will be described.

As illustrated in FIG. 12A, a printing tape 50B has a similar structure to the printing tape 50 of the first illustrative embodiment. More specifically, the printing tape 50B includes an adhesive sheet 52B and a release sheet 54. The adhesive sheet 52B has a base 52*b* on its front side and an adhesive layer 52*a* on its back side. The adhesive sheet 52B is removably adhered to a surface 54*a* of the release sheet 54.

As illustrated in FIG. 12A, the adhesive sheet 52B of the printing tape 50B has a perforation line 56B that extends along the tape conveyance direction. The perforation line 56B penetrates the adhesive sheet 52B in the tape thickness direction.

The perforation line 56B is formed at a middle portion of the printing tape 50B in the tape width direction. The perforation line 56B divides the printing tape 50B into a plurality of sections, for example, a one-end side section TBa and an other-end side section TBb. The one-end side section TBa is positioned on one-end side of the printing tape 50B relative to the perforation line 56B in the tape width direction. The other-end side section TBb is positioned on the other-end side of the printing tape 50B relative to the perforation line 56S in the tape width direction. The one-end side section TBa and the other-end side section TBb have an equal width.

<Printed Label Creation>

In the third illustrative embodiment, based on control of the CPU 82 in response to a print instruction signal, one or more printed labels each including at least a label body may be created based on label quantity data. More specifically, while the thermal head 22 prints, based on the print content data, content on each first area T1B (refer to FIG. 12B) of the printing tape 50A being conveyed by the platen roller 25, the half cutter 42 or the full cutter 41 cuts the printing tape 50B in each second area T2B (refer to FIG. 12B) that is different from the first area T1B on which printing has been performed. The cutting by the half cutter 42 or the full cutter 41 separates each printed label from its subsequent printed label or the remainder of the printing tape 50B. While the one or more printed labels are created, cutting might not be performed if unnecessary and/or cutting intervals may be changed. Such a control may enable creation of multiple types of printed labels using the same printing tape 50.

<One Example of Printed Labels to be Created>

Figure 12B:
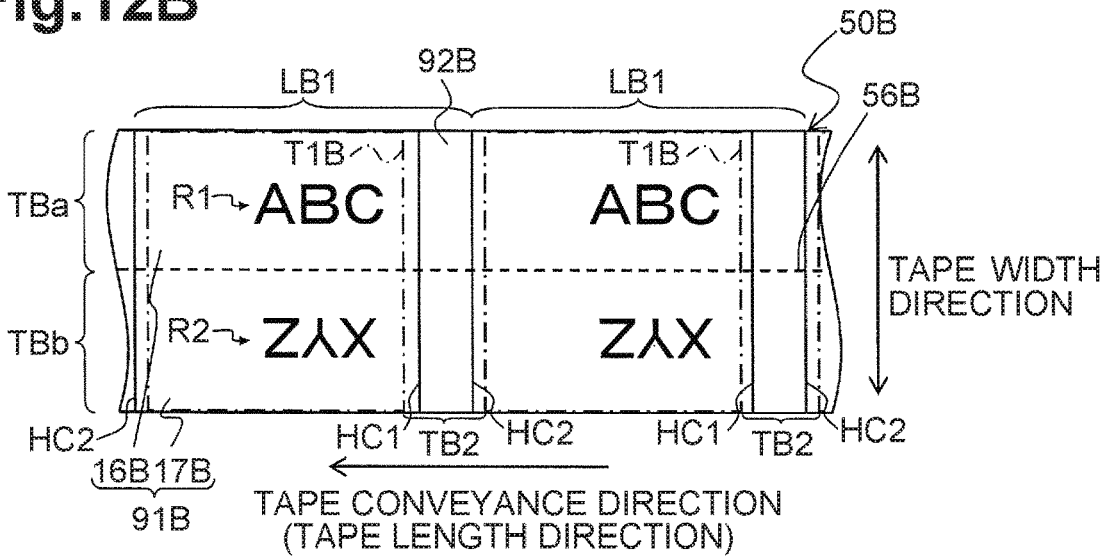
FIG. 12B is a partial plan view of the printing tape having printed labels of one example variety in the third illustrative embodiment according to one or more aspects of the disclosure.

FIG. 12B is a partial plan view of the printing tape 50B having printed labels of one example type according to the third illustrative embodiment.

In this example, the one-end side section TBa of each of the first areas T1B of the printing tape 50B has content R1 printed based on the print content data. Likewise, the other-end side section TBb of each of the first areas T1B of the printing tape 50B has content R2 printed based on the print content data. The first areas T1B are spaced from each other at regular intervals in the tape conveyance direction. As illustrated in FIG. 12B, as content R1 (e.g., a letter string "ABC") is printed in the upright position along the tape conveyance direction. As also illustrated in FIG. 12B, content R2 (e.g., another letter string "XYZ") is printed in the inverted orientation (e.g., in a 180-rotated orientation) relative to content R1 along the conveyance direction. The printing tape 50B has a plurality of, for example, two half cut lines HC1 and HC2 in each second area T2B that is positioned upstream from a corresponding first area T1B in the tape conveyance direction. Each of the half cut lines HC1 and HC2 may be a slit formed by partial cutting using the half cutter 42. The half cut lines HC1 and HC2 are spaced apart from each other to leave a predetermined clearance therebetween in the tape conveyance direction. Between each adjacent two of the half cut lines HC2 formed at regular intervals or between a downstream or leading end of the printing tape 50B and a most downstream half cut line HC2 in the tape conveyance direction, a printed label LB1 including a label body 91B and an attaching portion 92B has been created. That is, the printing tape 50B has a plurality of printed labels LB1 along the tape conveyance direction. The label body 91B corresponds to the printed tape portion, and the attaching portion 92B corresponds to the attaching tape portion. When creating the last printed label LB1, the full cutter 41 cuts the printing tape 50B completely (i.e., full cutting) rather than the half cutter 42 forming a half cut line HC2 in the printing tape 50B.

A label body 91B may be formed in the following manner. For example, print content R1 and print content R2 are printed on the one-end side section TBa and the other-end side section TBb, respectively, of one of the first areas T1B. Then, a half cut line HC1 and a half cut line HC2 are formed in in the second area T2B that is positioned immediately upstream from the first area T1B having the print contents R1 and R2 in the tape conveyance direction. Alternatively, full cutting may be performed twice in the second area T2B. Thus, a label body 91B is formed between the half cut line HC2 formed downstream from the first area T1B and the half cut line HC1 formed upstream from the first area T1B or between a downstream or leading end of the printing tape 50B and the most downstream half cut line HC1 in the tape conveyance direction. The half cut lines HC1 and HC2 formed around the label body 91B may enable the label body 91B to be removed from the release sheet 54. The perforation line 56B is formed at a middle portion of the label body 91B in the tape width direction. The perforation line 56B may be a fold line that facilitates folding of the label body 91B. The label body 91B is symmetrical with respect to the perforation line 56B.

The label body 91B includes a first label section 16B corresponding to the one-end side section TBa on which the print content R1 has been printed, and a second label section 17B corresponding to the other-end side section TBb on which the print content R2 has been printed. The first and second label sections 16B and 17B each have a rectangular shape with its longer sides extending along the tape conveyance direction and its shorter sides extending along the tape width direction.

An attaching portion 92B may be formed in a similar manner to forming the label body 91B. For example, a print content R1 and a print content R2 are printed on the one-end side section TBa and the other-end side section TBb, respectively, of one of the first areas T1B. Then, a half cut line HC1 and a half cut line HC2 are formed in or full cutting is performed twice in the second area T2B that is positioned immediately upstream from the first area T1B having the print contents R1 and R2 in the tape conveyance direction. Thus, an attaching portion 92B is formed between the half cut lines HC1 and HC2 formed in the second area T2B or between a downstream or leading end of the printing tape 50B and the most downstream half cut line HC1 in the tape conveyance direction. That is, the attaching portion 92B is positioned upstream from the label body 91B in the tape conveyance direction in each printed label LB1. Nevertheless, in other embodiments, for example, the attaching portion 92B may be positioned downstream from the label body 91B in the tape conveyance direction in each printed label LB1. The perforation line 56B is formed at a middle portion of the attaching portion 92B in the tape width direction. The attaching portion 92B is symmetric with respect to the perforation line 56B. The attaching portion 92B has a rectangular shape with its shorter sides extending along the tape conveyance direction and its longer sides extending along the tape width direction.

<First Alternate Type of Printed Labels to be Created>

Figure 12C:
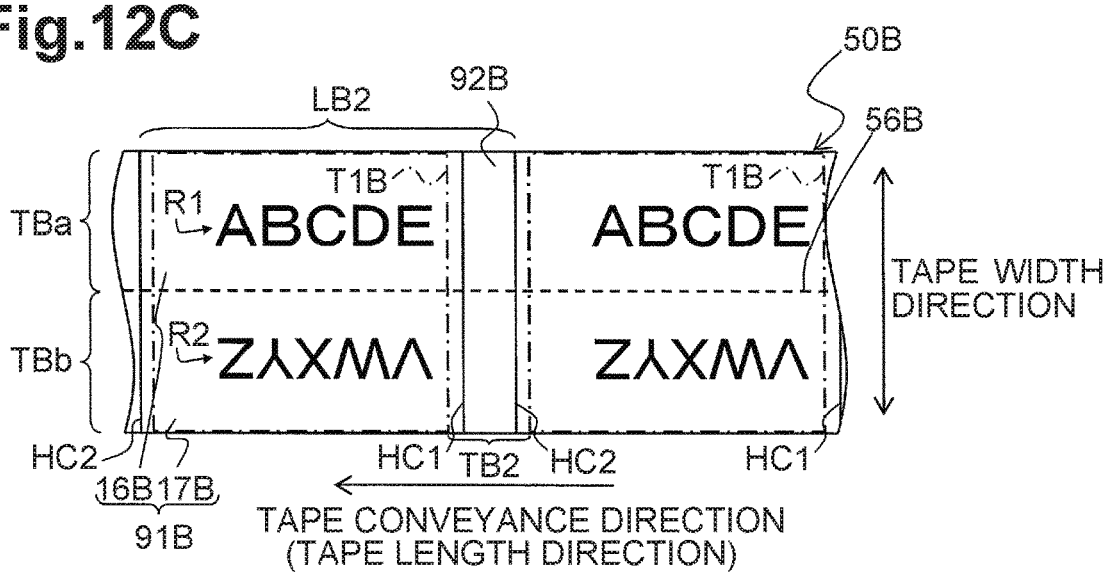
FIG. 12C is a partial plan view of the printing tape having printed labels of another example variety that is different from the variety of the printed labels of FIG. 12B in the third illustrative embodiment according to one or more aspects of the disclosure.

FIG. 12C is a partial plan view of the printing tape 50B having printed labels of another example type that is different from the type of the printed labels LB1, according to the third illustrative embodiment.

Similar to FIG. 12B and as illustrated in FIG. 12C, in this example, the one-end side section TBa of each of the first areas T1B of the printing tape 50B has a print content R1 printed based on the print content data. Likewise, the other-end side section TBb of each of the first areas T1B of the printing tape 50B has a print content R2 printed based on the print content data. A printing length of the letter string "ABCDE" of content R1 is longer than a printing length of the letter string "ABC" of content R1 in the embodiment shown in FIG. 12B. A printing length of the letter string "VWXYZ" of content R2 is longer than a printing length of the letter string "XYZ" of content R2 in the embodiment of FIG. 12B. The printing tape 50B has a plurality of, for example, two half cut lines HC1 and HC2 in each second area T2B that is positioned upstream from a corresponding first area T1B in the tape conveyance direction. As described above, the printing length of each of the print contents R1 and R2 illustrated in FIG. 12C is longer than the printing length of a corresponding one of the print contents R1 and R2 illustrated in FIG. 12B. Therefore, intervals between half cut lines HC2 and HC1 that are opposite to each other relative to a first area T1B in the printing tape 50B are different from the intervals between half cut lines HC2 and HC1 that are opposite to each other relative to a first area T1B of printing tape 50B of FIG. 12B. In this case (i.e., embodiment of FIG. 12C), full cutting is performed on the printing tape 50B at a different timing from the example of FIG. 12B. Between each adjacent two of the half cut lines HC2 formed at regular intervals or between a downstream or leading end of the printing tape 50B and a most downstream half cut line HC2 in the tape conveyance direction, a printed label LB2 including a label body 91B and an attaching portion 92B, which is different from the printed label LB1, has been created. That is, the printing tape 50B has a plurality of printed labels LB2 along the tape conveyance direction. In this example, the interval between each adjacent two of the half cut lines HC2 is greater than that of the example illustrated in FIG. 12B. When creating the last printed label LB2, the full cutter 41 cuts the printing tape 50B completely (i.e., full cutting) rather than the half cutter 42 forming a half cut line HC2 in the printing tape 50B.

Each printed label LB2 has a similar structure to the printed label LB1. However, the label body 91B of the printed label LB2 is longer than the label body 91B of the printed label LB1 in the tape conveyance direction. In other embodiments, for example, the attaching portion 92B may be positioned downstream from the label body 91B in the tape width direction in each printed label LB2.

<Second Alternate Type of Printed Labels to be Created>

Figure 13A:
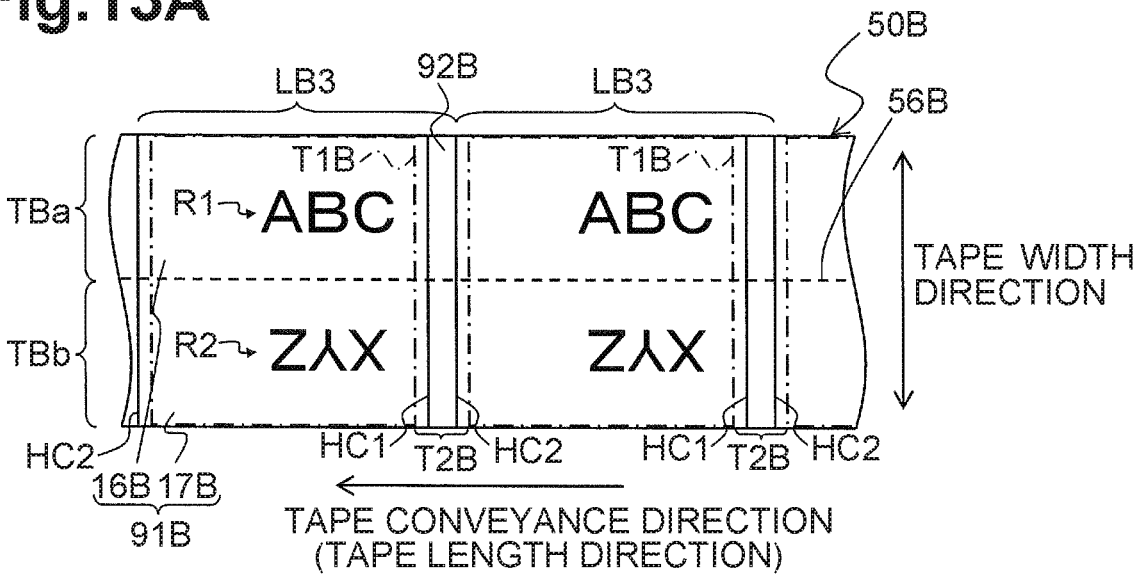
FIG. 13A is a partial plan view of the printing tape having printed labels of another example variety that is different from the varieties of the printed labels of FIGS. 12B and 12C in the third illustrative embodiment according to one or more aspects of the disclosure.

FIG. 13A is a partial plan view of the printing tape 50B having printed labels of another example type that is different from the types of the printed labels LB1 and LB2, according to the third illustrative embodiment.

Similar to the example illustrated in FIG. 12B and as shown in FIG. 13A, in this example, the one-end side section TBa of each of the first areas T1B of the printing tape 50B has a print content R1 (e.g., a letter string "ABC"). Likewise, the other-end side section TBb of each of the first areas T1B of the printing tape 50B has a print content R2 (e.g., a letter string "XYZ"). Further, the printing tape 50B has a plurality of, for example, two half cut lines HC1 and HC2 in each second area T2B that is positioned upstream from a corresponding first area T1B in the tape conveyance direction. In FIG. 13A, a distance between the half cut line HC1 and the half cut line HC2 in the tape conveyance direction is shorter than a distance between the half cut line HC1 and the half cut line HC2 in the tape conveyance direction in the example of FIG. 12B. Therefore, intervals between half cut lines HC1 and HC2 that are opposite to each other relative to an attaching portion 92B in the printing tape 50B are different from the intervals between half cut lines HC2 and HC1 that are opposite to each other relative to an attaching portion 92B of printing tape 50B of FIG. 12B. In this case, full cutting is performed on the printing tape 50B at a different timing from the example of FIG. 12B. Between each adjacent two of the half cut lines HC2 formed at regular intervals or between a downstream or leading end of the printing tape 50B and a most downstream half cut line HC2 in the tape conveyance direction, a printed label LB3 including a label body 91B and an attaching portion 92B, which is different from the printed labels LB1 and LB2, has been created. That is, the printing tape 50B has a plurality of printed labels LB3 along the tape conveyance direction. In this example, the interval between each adjacent two of the half cut lines HC2 is shorter than that of the example illustrated in FIG. 12B. When creating the last printed label LB3, the full cutter 41 cuts the printing tape 50B completely (i.e., full cutting) rather than the half cutter 42 forming a half cut line HC2 in the printing tape 50B.

Each printed label LB3 has a similar structure to the printed label LB1. Nevertheless, the attaching portion 92B of the printed label LB3 is narrower than the attaching portion 92B of the printed label LB1 in the tape conveyance direction. In other embodiments, for example, the attaching portion 92B may be positioned downstream from the label body 91B in the tape conveyance direction in each printed label LB3.

<Third Alternate Type of Printed Labels to be Created>

Figure 13B:
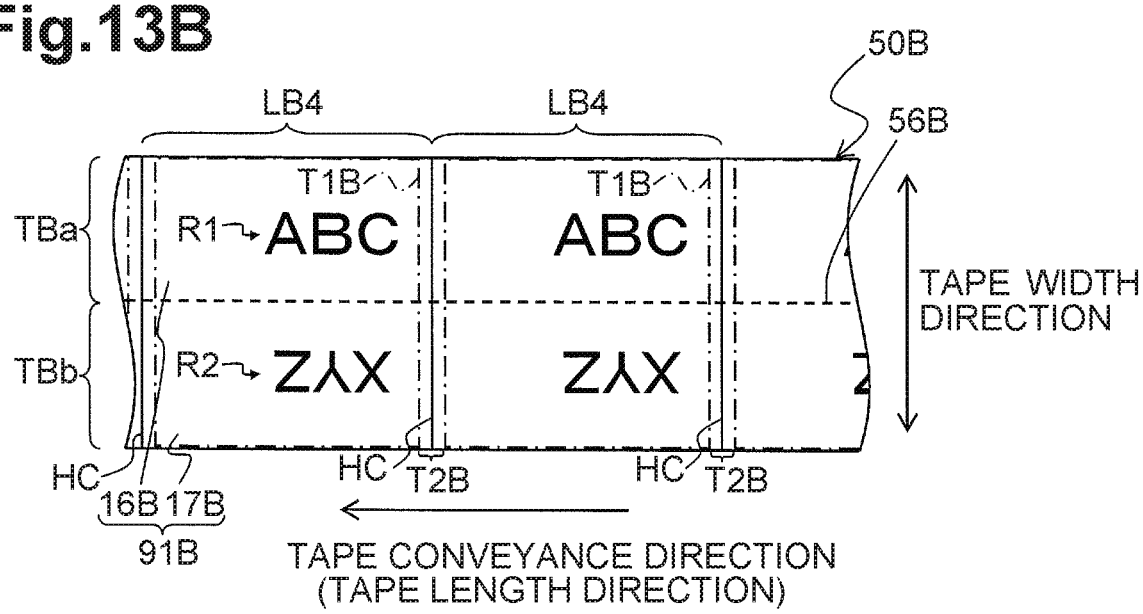
FIG. 13B is a partial plan view of the printing tape having printed labels of another example variety that is different from the varieties of the printed labels of FIGS. 12B, 12C, and 13A in the third illustrative embodiment according to one or more aspects of the disclosure.

FIG. 13B is a partial plan view of the printing tape 50B having printed labels of another example type that is different from the types of the printed labels LB1, LB2, and LB3, according to the third illustrative embodiment.

Similar to the example illustrated in FIG. 12B and as shown in FIG. 13B, in this example, the one-end side section TBa of each of the first areas T1B of the printing tape 50B has a print content R1, e.g., a letter string "ABC". Likewise, the other-end side section TBb of each of the first areas T1B of the printing tape 50B has a print content R2, e.g., a letter string "XYZ". Further, the printing tape 50B has a single half cut line HC in each second area T2B that is positioned upstream from a corresponding first area T1B in the tape conveyance direction. That is, the number of half cut lines included in the second area T2B, intervals of half cut lines formed in the printing tape 50B, and a timing at which full cutting is performed on the printing tape 50B are different between the example of FIG. 12B and the example of FIG. 13B. Between each adjacent two of the half cut lines HC formed at regular intervals or between a downstream or leading end of the printing tape 50B and a most downstream half cut line HC in the tape conveyance direction, a printed label LB4 including a label body 91B without an attaching portion 92B, which is different from the printed labels LB1, LB2, and LB3, has been created. That is, the printing tape 50B has a plurality of printed labels LB4 along the tape conveyance direction. When creating the last printed label LB4, the full cutter 41 cuts the printing tape 50 completely (i.e., full cutting) rather than the half cutter 42 forming a half cut line HC in the printing tape 50B.

Each printed label LB4 (e.g., the label body 91B) has a similar structure to the label body 91B of the printed label LB1.

<Effects Achieved by Third Illustrative Embodiment>

In the third illustrative embodiment, similar to the first illustrative embodiment, while the predetermined number of printed labels are created, cutting might not be performed if unnecessary and/or the intervals of cutting performed by the half cutter 42 or the full cutter 41 may be changed appropriately. This may therefore enable creation of multiple types of printed labels using the single printing tape 50B.

In particular, in the third illustrative embodiment, the attaching portion 92B is formed upstream from the label body 91B in the tape conveyance direction in each printed label (e.g., the printed labels LB1, LB2, and LB3). Thus, waste portion (e.g., a portion that is not used as a portion of a printed label) might not be produced from the adhesive sheet 52B, which may save the adhesive sheet 52B.

Fourth Illustrative Embodiment

Hereinafter, a fourth illustrative embodiment will be described. An explanation will be given for the components that differ from the first illustrative embodiment, and an explanation will be omitted for the common components by assigning the same reference numerals thereto.

<Printing Tape Structure>

Figure 14A:
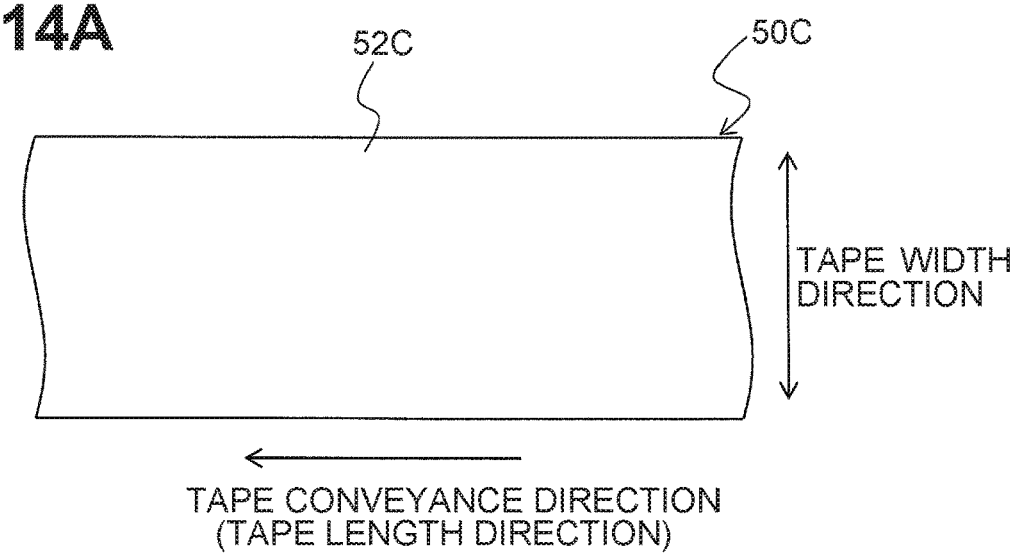
FIG. 14A is a partial plan view of a printing tape in a fourth illustrative embodiment according to one or more aspects of the disclosure.

Referring to FIG. 14A, a structure of a printing tape according to the fourth illustrative embodiment will be described.

As illustrated in FIG. 14A, a printing tape 50C has a similar structure to the printing tape 50 of the first illustrative embodiment. More specifically, the printing tape 50C includes an adhesive sheet 52C and a release sheet 54. The adhesive sheet 52C has a base 52B on its front side and an adhesive layer 52*a* on its back side. The adhesive sheet 52C is adhered to a surface 54*a* of the release sheet 54 removably.

As illustrated in FIG. 14A, the adhesive sheet 52C of the printing tape 50C has a different structure from the adhesive sheet 52. More specifically, the adhesive sheet 52C has no split line nor perforation line.

<Printed Label Creation>

In the fourth illustrative embodiment, based on control of the CPU 82 in response to the print instruction signal, one or more printed labels each including at least a label body may be created based on the label quantity data. More specifically, while the thermal head 22 prints, based on the print content data, a print content and a fold line on each first area T1C (refer to FIG. 14B) of the printing tape 50C being conveyed by the platen roller 25, the half cutter 42 or the full cutter 41 cuts the printing tape 50C in each second area T2C (refer to FIG. 14B) that is different from the first area T1C on which printing has been performed. This cutting separates each printed label from its subsequent printed label or the remainder of the printing tape 50C. While the one or more printed labels are created, cutting might not be performed if unnecessary and/or cutting intervals may be changed. Such a control may enable creation of multiple types of printed labels using the same printing tape 50.

<One Example of Printed Labels to be Created>

Figure 14B:
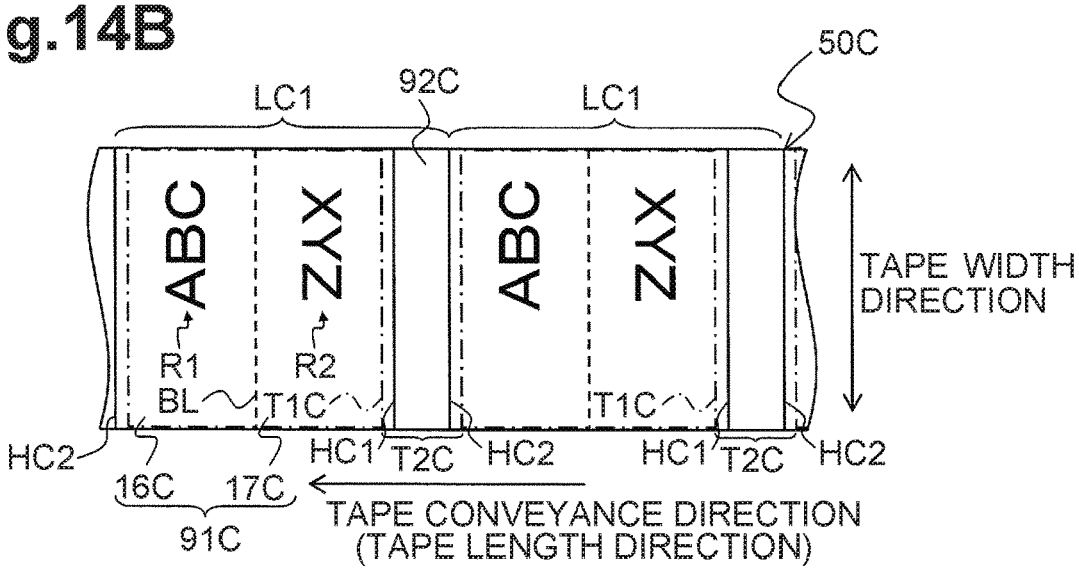
FIG. 14B is a partial plan view of the printing tape having printed labels of one example variety in the fourth illustrative embodiment according to one or more aspects of the disclosure.

FIG. 14B is a partial plan view of the printing tape 50C having printed labels of one example variety according to the fourth illustrative embodiment.

In this example, each of the first areas T1C of the printing tape 50C has print contents R1 and R2 and a fold line BL printed based on the print content data. The fold line BL extends along the tape width direction. The first areas T1C are spaced from each other at regular intervals in the tape conveyance direction. In each of the first areas T1C, the fold line BL is printed at a middle portion thereof in the tape conveyance direction. The print content R1 is printed on a downstream portion thereof with respect to the fold line BL in the tape conveyance direction. The print content R2 is printed on an upstream portion with respect to the fold line BL in the tape conveyance direction. As illustrated in FIG. 14B, as the print content R1 (e.g., a letter string "ABC") is printed in a 90°-rotated orientation in a counterclockwise direction relative to the upright position so as to extend along the conveyance direction. As the print content R2 (e.g., another letter string "XYZ"), is printed in a 90°-rotated orientation in the clockwise direction relative to the upright position so as to extend along the conveyance direction. The printing tape 50C has a plurality of, for example, two half cut lines HC1 and HC2 in each second area T2C that is positioned upstream from a corresponding first area T1C in the tape conveyance direction. The half cut lines HC1 and HC2 are spaced apart from each other to have a portion therebetween have a predetermined dimension in the tape conveyance direction. Between each adjacent two of the half cut lines HC2 formed at regular intervals or between a downstream or leading end of the printing tape 50C and a most downstream half cut line HC2 in the tape conveyance direction, a printed label LC1 including a label body 91C and an attaching portion 92C has been created. That is, the printing tape 50C has a plurality of printed labels LC1 along the tape conveyance direction. The label body 91C corresponds to the printed tape portion, and the attaching portion 92C corresponds to the attaching tape portion. When creating the last printed label LC1, the full cutter 41 cuts the printing tape 50C completely (i.e., full cutting) rather than the half cutter 42 forming a half cut line HC2 in the printing tape 50C.

A label body 91C may be formed in the following manner. For example, print contents R1 and R2 and a fold line BL are printed on one of the first areas T1C. Then, a half cut line HC1 and a half cut line HC2 are formed in or full cutting is performed twice in the second area T2C that is positioned immediately upstream from the first area T1C in the tape conveyance direction. Thus, a label body 91C is formed between the half cut line HC2 formed downstream from the first area T1C and the half cut line HC1 formed upstream from the first section T1B or between a downstream or leading end of the printing tape 50C and the most downstream half cut line HC1 formed upstream from the first section T1B in the tape conveyance direction. The half cut lines HC1 and HC2 formed around the label body 91C may enable the label body 91C to be removed from the release sheet 54. The fold line BL is printed at a middle portion of the label body 91C in the tape conveyance direction. The fold line BL may be used as a reference line for folding the label body 91C. The label body 91C is symmetrical with respect to the fold line BL.

The label body 91C includes a first label section 16C and a second label section 17C. The first label section 16C has the print content R1 printed thereon and is positioned downstream from the fold line BL. The second label section 17C has the print content R2 printed thereon and is positioned upstream portion from the fold line BL. The first and second label sections 16C and 17C each have a rectangular shape with its shorter sides extending along the tape conveyance direction and its longer sides extending along the tape width direction.

An attaching portion 92C may be formed in a similar manner to forming the label body 91C. For example, print contents R1 and R2 and a folded line BL are printed on one of the first areas T1C. Then, a half cut line HC1 and a half cut line HC2 are formed in or full cutting is performed twice in the second area T2C that is positioned immediately upstream from the first area T1C in the tape conveyance direction. Thus, an attaching portion 92C is formed between the half cut lines HC1 and HC2 formed in the second area T2C or between a downstream or leading end of the printing tape 50B and the most downstream half cut line HC1 in the tape conveyance direction. That is, the attaching portion 92C is positioned upstream from the label body 91C in the tape conveyance direction in each printed label LC1. Nevertheless, in other embodiments, for example, the attaching portion 92C may be positioned downstream from the label body 91B in the tape conveyance direction in each printed label LC1. The attaching portion 92C has a rectangular shape with its shorter sides extending along the tape conveyance direction and its longer sides extending along the tape width direction.

<First Alternate Type of Printed Labels to be Created>

Figure 14C:
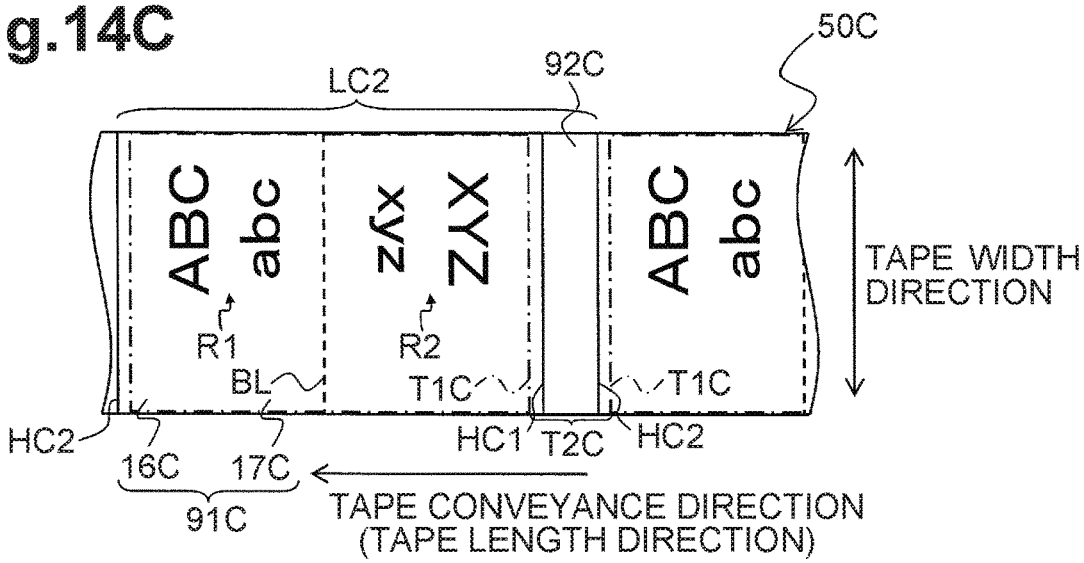
FIG. 14C is a partial plan view of the printing tape having printed labels of another example variety that is different from the variety of the printed labels of FIG. 14B in the fourth illustrative embodiment according to one or more aspects of the disclosure.

FIG. 14C is a partial plan view of the printing tape 50C having printed labels of another example type that is different from the variety of the printed labels LC1, according to the fourth illustrative embodiment.

Similar to the example illustrated in FIG. 14B and as illustrated in FIG. 14C, in this example, each of the first areas T1C of the printing tape 50C has print contents R1 and R2 and a fold line BL printed based on the print content data. As illustrated in FIG. 14C, as the print content R1, letter strings "ABC" and "abc" are printed in two rows in a 90°-rotated orientation in a counterclockwise direction relative to the upright position so as to extend along the conveyance direction. As the print content R2, additional letter strings "XYZ" and "xyz" are printed in two rows in a 90°-rotated orientation in the clockwise direction relative to the upright position so as to extend along the conveyance direction. The printing tape 50C has a plurality of, for example, two half cut lines HC1 and HC2 in each second area T2C that is positioned upstream from a corresponding first area T1C in the tape conveyance direction. As described above, the printing length of each of the print contents R1 and R2 illustrated in FIG. 14C in the tape conveyance direction is greater than the printing length of a corresponding one of the print contents R1 and R2 illustrated in FIG. 14B. Therefore, intervals between half cut lines HC2 and HC1 that are opposite to each other relative to a first area T1B in the printing tape 50C are different from the intervals between half cut lines HC2 and HC1 that are opposite to each other relative to a first area T1B of printing tape 50C of FIG. 14B. In this case, full cutting is performed on the printing tape 50C at a different timing from the example of FIG. 14B. Between each adjacent two of the half cut lines HC2 formed at regular intervals or between a downstream or leading end of the printing tape 50C and a most downstream half cut line HC2 in the tape conveyance direction, a printed label LC2 including a label body 91C and an attaching portion 92C, which is different from the printed label LC1, has been created. That is, the printing tape 50C has a plurality of printed labels LC2 along the tape conveyance direction. In this example, the interval between each adjacent two of the half cut lines HC2 is greater than the that in the example illustrated in FIG. 14B. When creating the last printed label LC2, the full cutter 41 cuts the printing tape 50B completely (i.e., full cutting) rather than the half cutter 42 forming a half cut line HC2 in the printing tape 50C.

Each printed label LC2 has a similar structure to the printed label LC1. However, the label body 91C of the printed label LC2 is longer in length than the label body 91C of the printed label LC1 in the tape conveyance direction. In other embodiments, for example, the attaching portion 92C may be positioned downstream from the label body 91C in the tape conveyance direction in each printed label LC2.

<Second Alternate Type of Printed Labels to be Created>

Figure 15A:
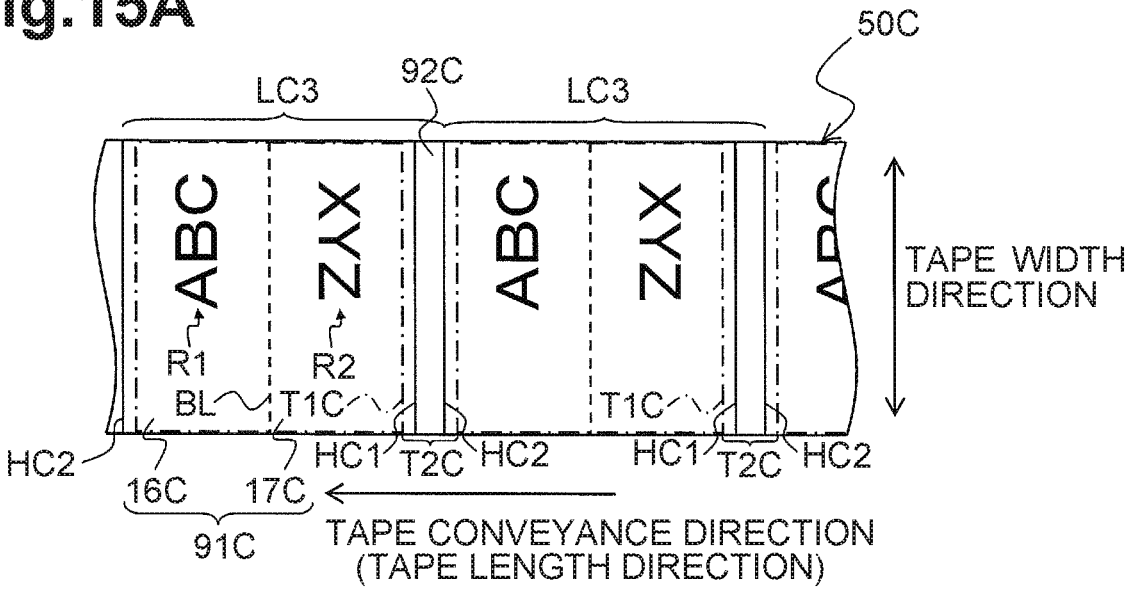
FIG. 15A is a partial plan view of the printing tape having printed labels of another example variety that is different from the varieties of the printed labels of FIGS. 14B and 14C in the fourth illustrative embodiment according to one or more aspects of the disclosure.

FIG. 15A is a partial plan view of the printing tape 50C having printed labels of another example type that is different from the types of the printed labels LC1 and LC2, according to the fourth illustrative embodiment.

Similar to the example illustrated in FIG. 14B and as shown in FIG. 15A, in this example, each of the first areas T1C of the printing tape 50C has a print content R1, e.g., a letter string "ABC", a print content R2, e.g., a letter string "XYZ", and a fold line BL. The printing tape 50C has a plurality of, for example, two half cut lines HC1 and HC2 in each second area T2C that is positioned upstream from a corresponding first area T1C in the tape conveyance direction. In FIG. 15A, a distance between the half cut line HC1 and the half cut line HC2 in the tape conveyance direction is shorter than a distance between the half cut line HC1 and the half cut line HC2 in the tape conveyance direction in FIG. 14B. Therefore, intervals between the half cut line HC1 and the half cut line HC2 in the tape conveyance direction are different from the intervals between the half cut line HC1 and the half cut line HC2 in the tape conveyance direction of FIG. 14B. In this case, full cutting is performed on the printing tape 50C at a different timing from the example of FIG. 14B. Between each adjacent two of the half cut lines HC2 formed at regular intervals or between a downstream or leading end of the printing tape 50C and a most downstream half cut line HC2 in the tape conveyance direction, a printed label LC3 including a label body 91C and an attaching portion 92C, which is different from the printed labels LC1 and LC2, has been created. That is, the printing tape 50C has a plurality of printed labels LC3 along the tape conveyance direction. In this example, the interval between each adjacent two of the half cut lines HC2 is smaller than that of the example illustrated in FIG. 14B. When creating the last printed label LC3, the full cutter 41 cuts the printing tape 50B completely (i.e., full cutting) rather than the half cutter 42 forming a half cut line HC2 in the printing tape 50C.

Each printed label LC3 has a similar structure to the printed label LC1. However, the attaching portion 92C of the printed label LC3 is narrower than the attaching portion 92C of the printed label LC1 in the tape conveyance direction. In other embodiments, for example, the attaching portion 92C may be positioned downstream from the label body 91C in the tape conveyance direction in each printed label LC3.

<Third Alternate Type of Printed Labels to be Created>

Figure 15B:
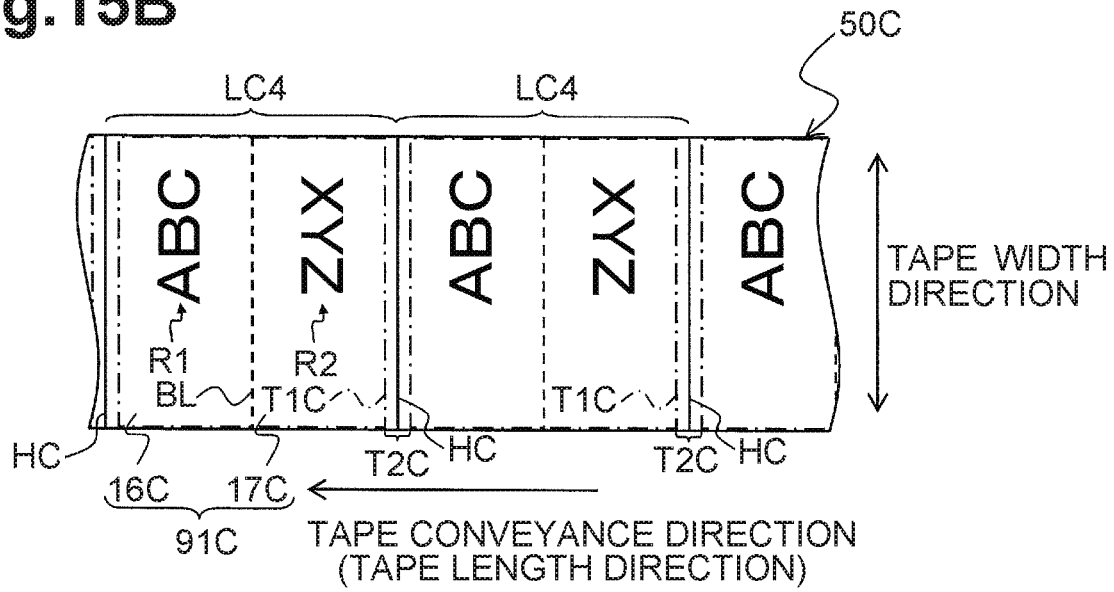
FIG. 15B is a partial plan view of the printing tape having printed labels of another example variety that is different from the varieties of the printed labels of FIGS. 14B, 14C, and 15A in the fourth illustrative embodiment according to one or more aspects of the disclosure.

FIG. 15B is a partial plan view of the printing tape 50C having printed labels of another example variety that is different from the varieties of the printed labels LC1, LC2, and LC3, according to the fourth illustrative embodiment.

Similar to the example illustrated in FIG. 14B and as shown in FIG. 15B, in this example, each of the first areas T1C of the printing tape 50C has a print content R1, e.g., a letter string "ABC", a print content R2, e.g., a letter string "XYZ", and a fold line BL. In this example, the printing tape 50C has a single half cut line HC in each second area T2C that is positioned upstream from a corresponding first area T1C in the tape conveyance direction. That is, the number of half cut lines included in the second area T2B, intervals of half cut lines formed in the printing tape 50C, and a timing at which full cutting is performed on the printing tape 50B are different between the example of FIG. 14B and the example of FIG. 15B. Between each adjacent two of the half cut lines HC formed at regular intervals or between a downstream or leading end of the printing tape 50C and a most downstream half cut line HC in the tape conveyance direction, a printed label LC4 including a label body 91C without an attaching portion 92C, which is different from the printed labels LC1, LC2, and LC3, has been created. That is, the printing tape 50C has a plurality of printed labels LC4 along the tape conveyance direction. When creating the last printed label LC4, the full cutter 41 cuts the printing tape 50 completely (i.e., full cutting) rather than the half cutter 42 forming a half cut line HC in the printing tape 50C.

Each printed label LC4 (e.g., the label body 91C) has a similar structure to the label body 91C of the printed label LC1.

<Effects Achieved by Fourth Illustrative Embodiment>

In the fourth illustrative embodiment, similar to the first illustrative embodiment, while the predetermined number of printed labels are created, cutting might not be performed if unnecessary and/or the intervals of cutting performed by the half cutter 42 or the full cutter 41 may be changed appropriately. This may therefore enable creation of multiple types of printed labels using the single printing tape 50C.

In particular, in the fourth illustrative embodiment, the attaching portion 92C is formed upstream from the label body 91C in the tape conveyance direction in each printed label (e.g., the printed labels LC1, LC2, and LC3). Thus, waste portion (e.g., a part of the tape that is not used as a portion of a printed label) might not be produced from the adhesive sheet 52C, which may save the adhesive sheet 52C.

Fifth Illustrative Embodiment

Hereinafter, a fifth illustrative embodiment will be described. An explanation will be given for the components that differ from the first illustrative embodiment, and an explanation will be omitted for the common components by assigning the same reference numerals thereto.

<Printing Tape Structure>

Figure 16A:
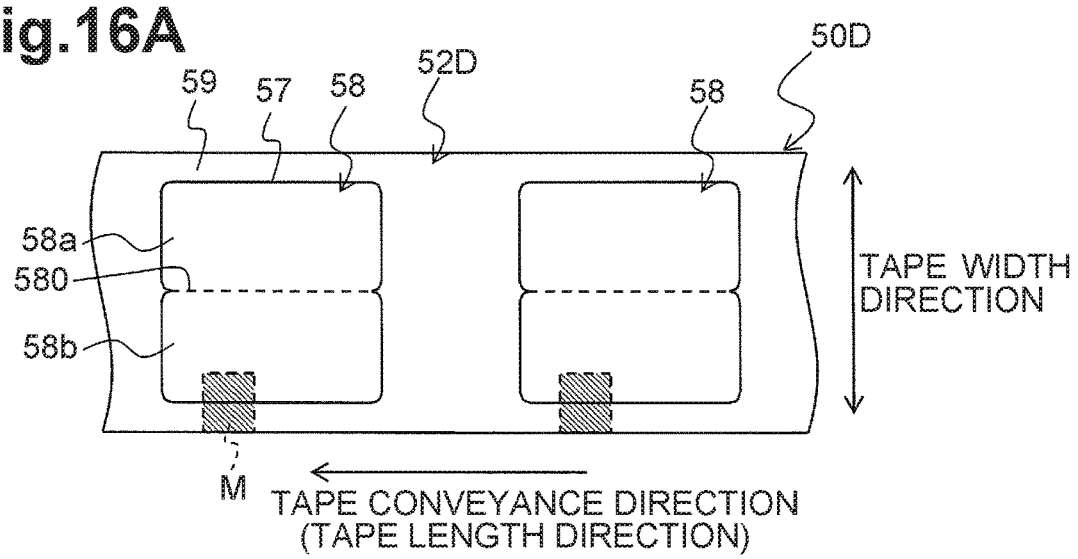
FIG. 16A is a partial plan view of a printing tape in a fifth illustrative embodiment according to one or more aspects of the disclosure.

Referring to FIG. 16A, a structure of a printing tape according to the fifth illustrative embodiment will be described.

As illustrated in FIG. 16A, a printing tape 50D has a similar structure to the printing tape 50 of the first illustrative embodiment. More specifically, the printing tape 50D includes an adhesive sheet 52D and a release sheet 54. The adhesive sheet 52D has a base 52*b* on its front side and an adhesive layer 52*a* on its back side. The adhesive sheet 52D is removably adhered to a surface 54*a* of the release sheet 54.

As illustrated in FIG. 16A, the adhesive sheet 52D of the printing tape 50D has pre-cut contours 57 each enclosing a predetermined area to define a boundary between an inside portion 58 and an outside portion 59. The pre-cut contours 57 penetrate the adhesive sheet 52D in the tape thickness direction. The pre-cut contours 57 formed in the adhesive sheet 52D may therefore enable the inside portions 58 enclosed with the respective pre-cut contours 57 to be removed from the printing tape 50D. The inside portions 58 each corresponds to a first area. In the adhesive sheet 52D, the inside portions 58 are spaced apart from each other at regular intervals in the tape conveyance direction. That is, the adhesive sheet 52D has the plurality of inside portions 58 while the outside portion 59 is the portion of the adhesive sheet 52D other than the inside portions 58. The outside portion 59 corresponds to a second area.

The release sheet 54 of the printing tape 50D has sensor marks M preprinted on its back side. The sensor marks M are spaced apart from each other at predetermined intervals along the tape conveyance direction. The intervals between sensor marks M may be equal to the intervals between the inside portions 58. Each of the sensor marks M is formed on a respective particular area of the back side of the release sheet 54 in the tape width direction. The particular area may be exposed when facing the through hole 104 (refer to FIG. 3) during conveyance of the printing tape 50D. In the printer 1, the position of the printing tape 50 during conveyance of the printing tape 50 is controlled using the sensor marks M. More specifically, for example, the optical sensor 65 detects one of the sensor marks M optically through the through hole 104 and the CPU 82 determines, based on the detection result, the position of an inside portion 58 corresponding the detected sensor mark M.

Each of the inside portions 58 has a perforation line 580 preformed at a middle portion in the tape width direction. The perforation line 580 extends along the tape conveyance direction. The perforation line 580 penetrates the adhesive sheet 52D in the tape thickness direction. In other embodiments, for example, each of the inside portions 58 may have a perforation line at a middle portion in the tape conveyance direction, and the perforation line may extend along the tape width direction. The inside portion 58 is symmetrical with respect to the perforation line 580. The perforation line 580 divides the inside portion 58 into a plurality of sections, for example, a one-end side section 58*a* and an other-end side section 58*b*. The one-end side section 58*a* is positioned on the one-end side of the inside portion 58 relative to the perforation line 580 in the tape width direction. The other-end side section 58*b* is positioned on the other-end side of the inside portion 58 relative to the perforation line 580 in the tape width direction. The one-end side section 58*a* and the other-end side section 58*b* have equal dimensions in the tape width direction. The one-end side section 58*a* and the other-end side section 58*b* each have a rectangular shape with its longer sides extending along the tape conveyance direction and its shorter sides extending along the tape width direction.

<Printed Label Creation>

In the fifth illustrative embodiment, based on control of the CPU 82 in response to the print instruction signal, one or more printed labels each including a label body and an attaching portion may be created based on the label quantity data. More specifically, while the thermal head 22 prints, based on the print content data, a print content on each inside portion 58 of the printing tape 50D being conveyed by the platen roller 25, the half cutter 42 or the full cutter 41 cuts the printing tape 50D between adjacent inside portions 58 in each particular portion of an outside portion 59 of the printing tape 50D to separate each printed label from its subsequent printed label or the remainder of the printing tape 50D. While the one or more printed labels are created, cutting might not be performed if unnecessary and/or cutting intervals may be changed. Such a control may enable creation of multiple varieties of printed labels using the same printing tape 50.

<One Example of Printed Labels to be Created>

Figure 16B:
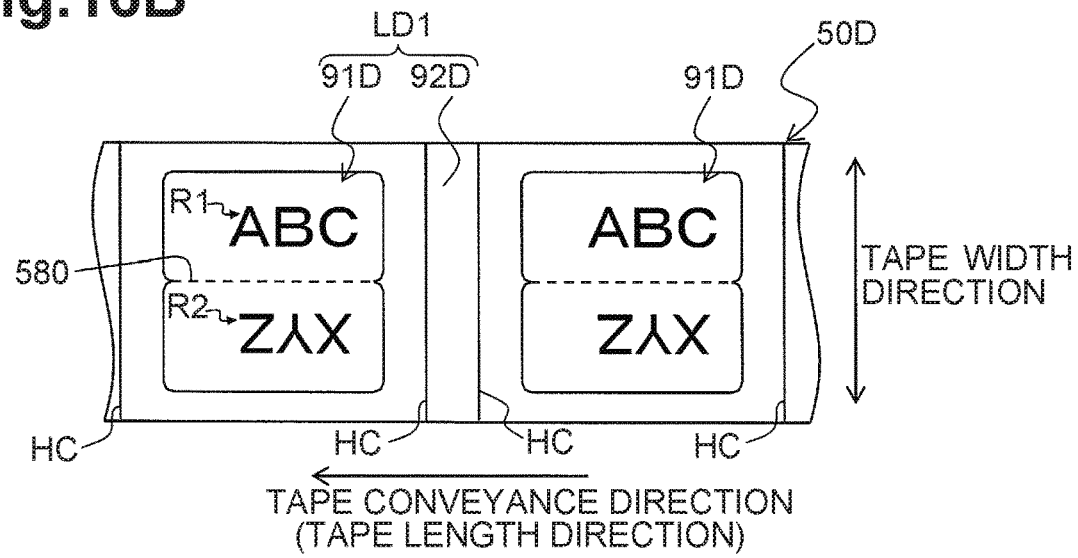
FIG. 16B is a partial plan view of the printing tape having printed labels of one example variety in the fifth illustrative embodiment according to one or more aspects of the disclosure.

FIG. 16B is a partial plan view of the printing tape 50D having printed labels of one example type according to the fifth illustrative embodiment.

In this example, the one-end side section 58*a* of each of the inside portions 58 of the printing tape 50D has print content R1 printed based on the print content data. Likewise, the other-end side section 58*b* of each of the inside portions 58 of the printing tape 50D has print content R2 printed based on the print content data. Each inside portion 58 having the print contents R1 and R2 may constitute a label body 91D, which corresponds to the printed tape portion. As illustrated in FIG. 16B, as the print content R1 (e.g., a letter string "ABC") is printed in the upright position along the tape conveyance direction. As the print content R2 (e.g., another letter string "XYZ") is printed in the inverted orientation (e.g., in a 180°-rotated orientation relative to the orientation of R1) along the conveyance direction. Between each adjacent two of the inside portions 58 of the printing tape 50D, a plurality of, for example, two half cut lines HC are formed in a particular portion of the outside portion 59. A portion defined between the half cut lines HC in the outside portion 59 of the printing tape 50D may be an attaching portion 92D, which corresponds to the attaching tape portion. The half cut lines HC are spaced apart from each other to have a portion (e.g., an attaching portion 92D) therebetween in the printing tape 50D have a predetermined dimension in the tape conveyance direction. In this example, a single label body 91D and a single attaching portion 92D constitute a printed label LD1. When creating the last printed label LD1, the full cutter 41 cuts the printing tape 50D completely (i.e., full cutting) rather than the half cutter 42 forming a second half cut line HC in the printing tape 50D. The attaching portion 92D has a rectangular shape with its shorter sides extending along the tape conveyance direction and its longer sides extending along the tape width direction.

<Another Example of Printed Labels to be Created>

Figure 16C:
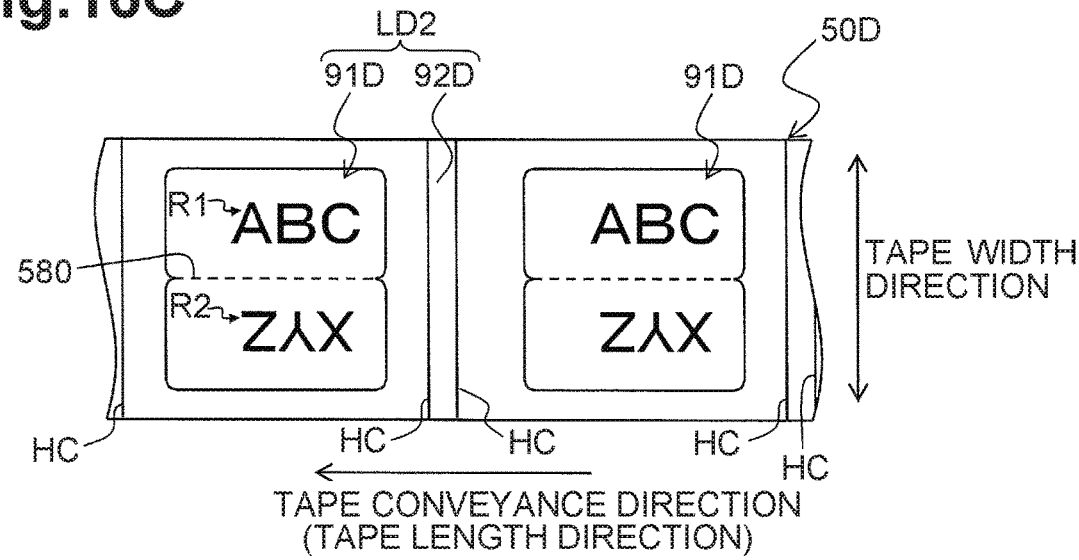
FIG. 16C is a partial plan view of the printing tape having printed labels of another example variety that is different from the variety of the printed labels of FIG. 16B in the fifth illustrative embodiment according to one or more aspects of the disclosure.

FIG. 16C is a partial plan view of the printing tape 50D having printed labels of another example type that is different from the variety of the printed labels LD1, according to the fifth illustrative embodiment.

Similar to the example illustrated in FIG. 16B, in this example, as illustrated in FIG. 16C, the one-end side section 58*a* of each of the inside portions 58 has a print content R1, e.g., a letter string "ABC. Likewise, the other-end side section 58*b* of each of the inside portions 58 has a print content R2, e.g., another letter string "XYZ". This may constitute a label body 91D. Between each adjacent two of the inside portions 58 of the printing tape 50D, a plurality of, for example, two half cut lines HC are formed in a particular portion of the outside portion 59. A portion defined between the half cut lines HC in the outside portion 59 of the printing tape 50D may be an attaching portion 92D. In FIG. 16C, a distance between adjacent half cut lines HC (e.g., a dimension of the attaching portion 92D) in the tape conveyance direction is shorter than a distance between adjacent half cut lines HC in the tape conveyance direction in FIG. 16B. Therefore, intervals between the half cut lines HC in the printing tape 50D are different from the intervals between half cut lines HC of FIG. 16B. In this case, full cutting is performed on the printing tape 50E at a different timing from the example of FIG. 16B. In this example, a single label body 91D and a single attaching portion 92D constitute a printed label LD2 that is different from the printed label LD1. When creating the last printed label LD2, the full cutter 41 cuts the printing tape 50D completely (i.e., full cutting) rather than the half cutter 42 forming a second half cut line HC in the printing tape 50D.

<Effects Achieved by Fifth Illustrative Embodiment>

In the fifth illustrative embodiment, similar to the first illustrative embodiment, while the predetermined number of printed labels are created, the intervals of cutting performed by the half cutter 42 or the full cutter 41 may be changed appropriately. This may therefore enable creation of multiple types of printed labels using the single printing tape 50D.

Sixth Illustrative Embodiment

Hereinafter, a sixth illustrative embodiment will be described. An explanation will be given for the components that differ from the first illustrative embodiment, and an explanation will be omitted for the common components by assigning the same reference numerals thereto.

<Printing Tape Structure>

Figure 17A:
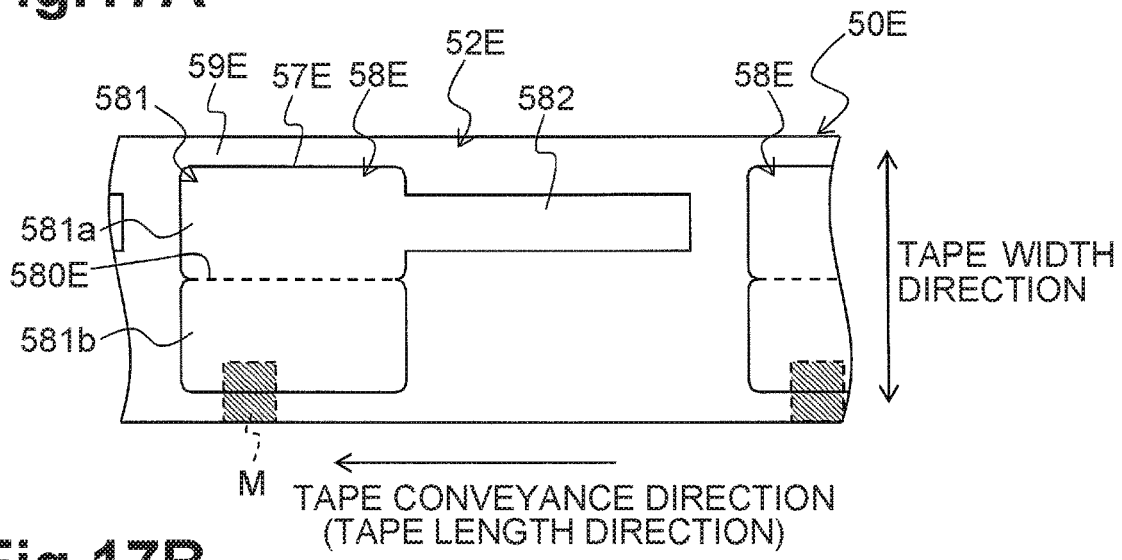
FIG. 17A is a partial plan view of a printing tape in a sixth illustrative embodiment according to one or more aspects of the disclosure.

Referring to FIG. 17A, a structure of a printing tape according to the sixth illustrative embodiment will be described.

As illustrated in FIG. 17A, a printing tape 50E, which corresponds to the tape, has a similar structure to the printing tape 50 of the first illustrative embodiment. More specifically, the printing tape 50E includes an adhesive sheet 52E and a release sheet 54. The adhesive sheet 52E has a base 52*b* on its front side and an adhesive layer 52*a* on its back side. The adhesive sheet 52E is adhered to a surface 54*a* of the release sheet 54 removably.

As illustrated in FIG. 17A, the adhesive sheet 52E of the printing tape 50E has pre-cut contours 57 each enclosing a predetermined area to define a boundary between an inside portion 58 and an outside portion 59. The pre-cut contours 57 penetrate the adhesive sheet 52E in the tape thickness direction. In the adhesive sheet 52E, the inside portions 58 defined by the respective pre-cut contours 57E are spaced apart from each other at regular intervals in the tape conveyance direction. That is, the adhesive sheet 52E has the plurality of inside portions 58E and the outside portion 59E that is the other portion than the inside portions 58E in the adhesive sheet 52E.

Similar to the printing tape 50D, the release sheet 54 of the printing tape 50E has sensor marks M on its back side. The sensor marks M are spaced apart from each other at predetermined intervals along the tape conveyance direction. The interval between sensor marks M may be equal to the interval between first inside portions 58E.

Each of the inside portions 58E includes a first inside portion 581, which corresponds to a printing area, and a second inside portion 582 contiguous to the first inside portion 581.

The inside portions 581 each have a perforation line 580E preformed at a middle portion in the tape width direction. The perforation line 580E extends along the tape conveyance direction. The perforation line 580E penetrates the adhesive sheet 52E in the tape thickness direction. In other embodiments, for example, each of the first inside portions 581 may have a perforation line at a middle portion in the tape conveyance direction, and the perforation line may extend along the tape width direction. The first inside portion 581 is symmetrical with respect to the perforation line 580E. The perforation line 580E divides the first inside portion 581 into a plurality of sections, for example, a one-end side section 581*a* and an other-end side section 581*b*. The one-end side section 581*a* is positioned on the one-end side of the first inside portion 581 relative to the perforation line 580E in the tape width direction. The other-end side section 581*b* is positioned on the other-end side of the first inside portion 581 relative to the perforation line 580E in the tape width direction. The one-end side section 581*a* and the other-end side section 581*b* have equal dimensions in the tape width direction. The one-end side section 581*a* and the other-end side section 581*b* each have a rectangular shape with its longer sides extending along the tape conveyance direction and its shorter sides extending along the tape width direction.

The second inside portion 582 extends along the tape conveyance direction from an upstream end of the one-end side section 581*a* in the tape conveyance direction. Nevertheless, in other embodiments, for example, the second inside portion 582 may extend along the tape conveyance direction from an upstream end of the other-end side section 581*b* in the tape conveyance direction. In still other embodiments, for example, the second inside portion 582 may extend along the tape conveyance direction from a downstream end of one of the one-end side section 581*a* and the other-end side section 581*b* in the tape conveyance direction. The second inside portion 582 has a rectangular shape with its longer sides extending along the tape conveyance direction and its shorter sides extending along the tape width direction.

<Printed Label Creation>

In the sixth illustrative embodiment, based on control of the CPU 82 in response to the print instruction signal, one or more printed labels each including a label body and an attaching portion may be created based on the quantity data. More specifically, while the thermal head 22 prints, based on the print content data, a print content on each first inside portion 581 of the printing tape 50E being conveyed by the platen roller 25, the half cutter 42 or the full cutter 41 cuts the printing tape 50E in an inside portion 58E to separate a first inside portion 581 and a second inside portion 582 from each other in the inside portion 58E. While the one or more printed labels are created, cutting might not be performed if unnecessary and/or cutting intervals may be changed. Such a control may enable creation of multiple varieties of printed labels using the same printing tape 50.

<One Example of Printed Labels to be Created>

Figure 17B:
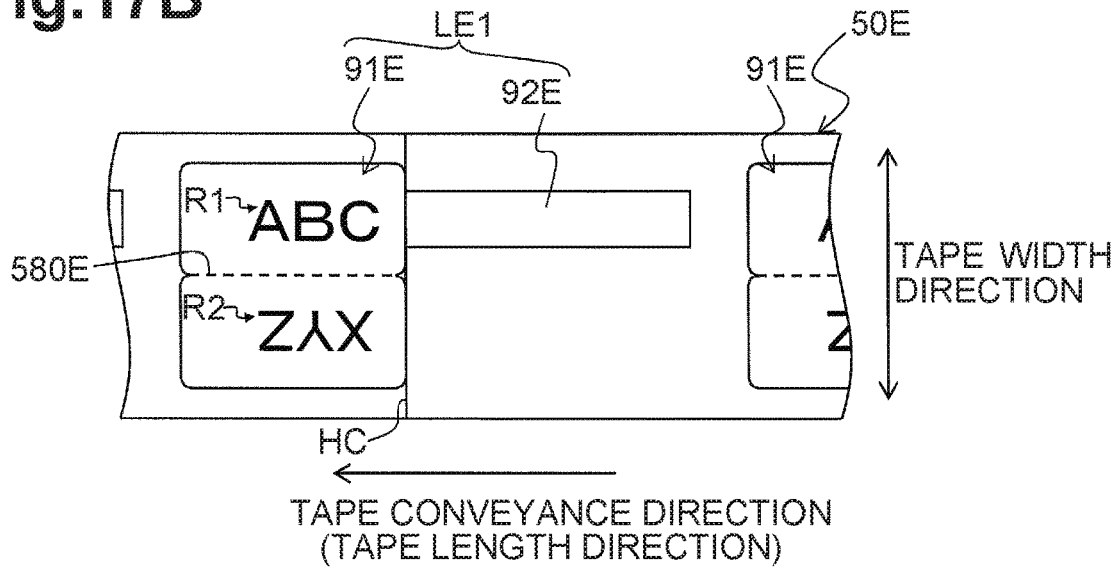
FIG. 17B is a partial plan view of the printing tape having printed labels of one example variety in the sixth illustrative embodiment according to one or more aspects of the disclosure.

FIG. 17B is a partial plan view of the printing tape 50E having printed labels of one example type according to the sixth illustrative embodiment.

In this example, in each of the inside portions 58E of the printing tape 50E, the one-end side section 581*a* of the first inside portion 581 has a print content R1 printed based on the print content data. Likewise, the other-end side section 581*b* of the first inside portion 581 has a print content R2 printed based on the print content data. As illustrated in FIG. 17B, as the print content R1 (e.g., a letter string "ABC"), is printed in the upright position along the tape conveyance direction. As the print content R2 (e.g., another letter string "XYZ"), is printed in the inverted orientation (e.g., in a 180°-rotated orientation relative to the orientation of R1) along the conveyance direction. In this example, the printing tape 50E has a half cut line HC that extends along a boundary between the first inside portion 581 and the second inside portion 582 of each of the inside portions 58E. Thus, the inside portion 58E is divided into two portions, e.g., the first inside portion 581 and the second inside portion 582. The first inside portion 581 that may be the one-end side portion serves as a label body 91E, which corresponds to the printed tape portion. The second inside portion 582 that may be the other-end side portion serves as an attaching portion 92E, which corresponds to the attaching tape portion. In this example, a single label body 91E and a single attaching portion 92E constitute a printed label LE1.

<Another Example of Printed Labels to be Created>

Figure 17C:
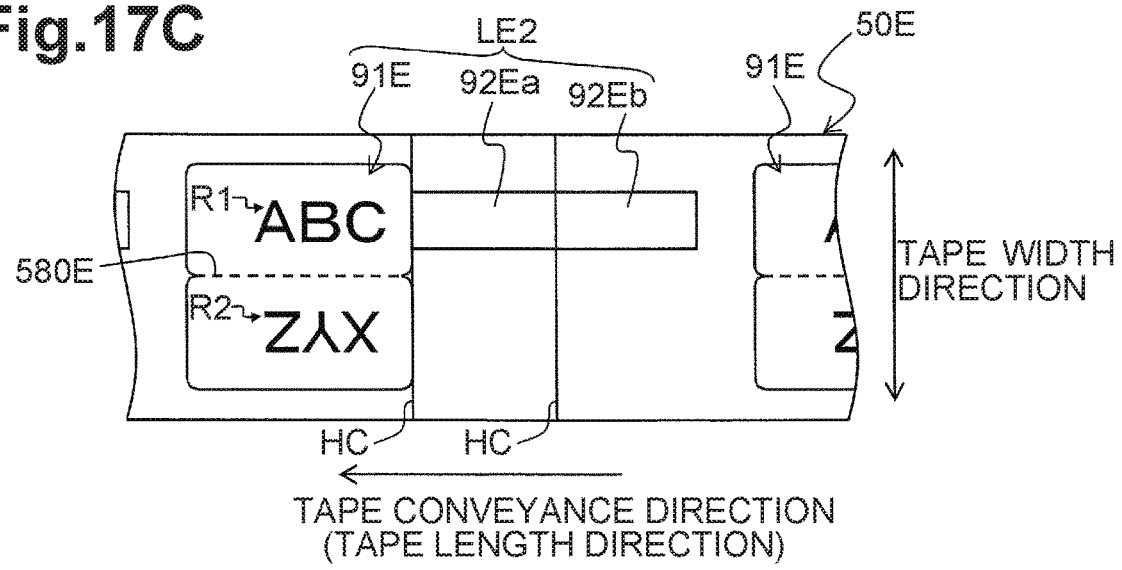
FIG. 17C is a partial plan view of the printing tape having printed labels of another example variety that is different from the variety of the printed labels of FIG. 17B in the sixth illustrative embodiment according to one or more aspects of the disclosure.

FIG. 17C is a partial plan view of the printing tape 50E having printed labels of another example type that is different from the variety of the printed labels LE1, according to the sixth illustrative embodiment.

Similar to the example illustrated in FIG. 17B and as illustrated in FIG. 17C, in this example, the one-end side section 581*a* of the first inside portion 581 of each of the inside portions 58E has a print content R1, e.g., a letter string "ABC". Likewise, the other-end side section 581*b* of the first inside portion 581 of each of the inside portions 58E has a print content R2, e.g., another letter string "XYZ". In this example, similar to the example illustrated in FIG. 17B, the printing tape 50E has a half cut line HC that extends along a boundary between the first inside portion 581 and the second inside portion 582 of each of the inside portions 58E. In addition, the printing tape 50E has another half cut line HC that passes a middle portion of the second inside portion 582 of the inside portion 58E. That is, the number of half cut lines and the intervals of half cut lines HC formed in the printing tape 50E are different between the example of FIG. 17B and the example of FIG. 17C. Thus, the inside portion 58E is divided into two portions, e.g., the first inside portion 581 and the second inside portion 582, and the second inside portion 582 is further divided into two portions, e.g., attaching portions 92Ea and 92Eb, each of which corresponds to an attaching tape portion. The attaching portion 92Ea may be a downstream portion (e.g., a right portion) of the second inside portion 582 in the tape conveyance direction. The attaching portion 92Eb may be an upstream portion (e.g., a left portion) of the second inside portion 582 in the tape conveyance direction. In this example, a single label body 91E and two attaching portions 92Ea and 92Eb constitute a printed label LE2 that is different from the printed label LEE <Effects Achieved by Sixth Illustrative Embodiment>

In the sixth illustrative embodiment, similar to the first illustrative embodiment, while the predetermined number of printed labels are created, cutting might not be performed if unnecessary and/or the intervals of cutting performed by the half cutter 42 or the full cutter 41 may be changed appropriately. This may therefore enable creation of multiple types of printed labels using the single printing tape 50E.

Seventh Illustrative Embodiment

Hereinafter, a seventh illustrative embodiment will be described. An explanation will be given for the components that differ from the first illustrative embodiment, and an explanation will be omitted for the common components by assigning the same reference numerals thereto.

<Printing Tape Structure>

Figure 18A:
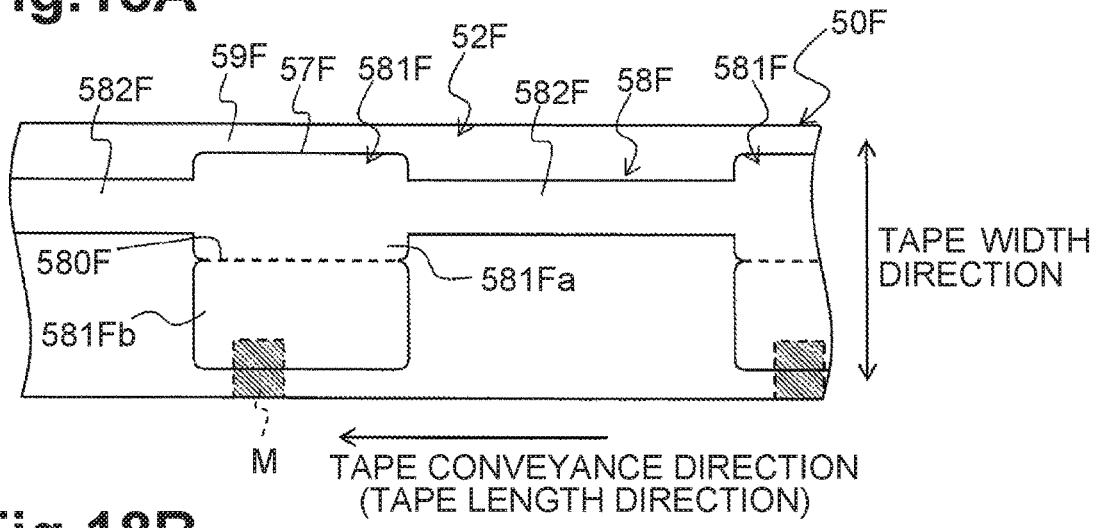
FIG. 18A is a partial plan view of a printing tape in a seventh illustrative embodiment according to one or more aspects of the disclosure.

Referring to FIG. 18A, a structure of a printing tape according to the seventh illustrative embodiment will be described.

As illustrated in FIG. 18A, a printing tape 50F has a similar structure to the printing tape 50 of the first illustrative embodiment. More specifically, the printing tape 50F includes an adhesive sheet 52F and a release sheet 54. The adhesive sheet 52E has a base 52*b* on its front side and an adhesive layer 52*a* on its back side. The adhesive sheet 52E is adhered to a surface Ma of the release sheet 54 removably.

As illustrated in FIG. 18A, the adhesive sheet 52F of the printing tape 50F has a pre-cut contour 57F enclosing a predetermined area to define a boundary between an inside portion 58F and an outside portion 59F. The pre-cut contour 57F penetrates the adhesive sheet 52F in the tape thickness direction. The adhesive sheet 52F has the inside portion 58F and the outside portion 59F (which is the portion of sheet 52F other than the inside portion 58F). The inside portion 58F extends along the tape conveyance direction. The inside portion 58F is defined by the pre-cut contour 57F.

Similar to the printing tape 50D, the release sheet 54 of the printing tape 50F has sensor marks M on its back side. The sensor marks M are spaced apart from each other at predetermined intervals along the tape conveyance direction. The interval between sensor marks M may be equal to the interval between first inside portions 581F.

The inside portion 58F has a one piece structure including a plurality of first inside portions 581F, each of which corresponds to the first area, and a plurality of second inside portions 582F, each of which corresponds to the second area. The first inside portions 581F are spaced apart from each other at regular intervals in the tape conveyance direction. Each of the second inside portions 582G is disposed between each adjacent two of the first inside portions 581 and contiguous to each of the adjacent first inside portions 581.

The first inside portions 581F each have a perforation line 580F preformed at a middle portion in the tape width direction. The perforation line 580F extends along the tape conveyance direction. The perforation line 580F penetrates the adhesive sheet 52F in the tape thickness direction. In other embodiments, for example, each of the first inside portions 581F may have a perforation line at a middle portion in the tape conveyance direction, and the perforation line may extend along the tape width direction. The first inside portion 581F is symmetrical with respect to the perforation line 580F. The perforation line 580F divides the first inside portion 581F into a plurality of sections, for example, a one-end side section 581Fa and an other-end side section 581Fb. The one-end side section 581Fa is positioned on the one-end side of the first inside portion 581F relative to the perforation line 580F in the tape width direction. The other-end side section 581Fb is positioned on the other-end side of the first inside portion 581F relative to the perforation line 580F in the tape width direction. The one-end side section 581Fa and the other-end side section 581Fb have an equal dimension in the tape width direction. The one-end side section 581Fa and the other-end side section 581Fb each have a rectangular shape with its longer sides extending along the tape conveyance direction and its shorter sides extending along the tape width direction.

Between adjacent two first inside portions 581F, a second inside portion 582F extends along the tape conveyance direction between an upstream end of the one-end side section 581Fa of a downstream first inside portion 581F and a downstream end of the one-end side section 581Fa of an upstream first inside portion 581F in the tape conveyance direction. Nevertheless, in other embodiments, for example, between adjacent two first inside portions 581F, a second inside portion 582F may extend along the tape conveyance direction between an upstream end of the other-end side section 581Fb of the downstream first inside portion 581F and a downstream end of the other-end side section 581Fb of the upstream first inside portion 581F in the tape conveyance direction. The second inside portion 582F has a rectangular shape with its longer sides extending along the tape conveyance direction and its shorter sides extending along the tape width direction.

<Printed Label Creation>

In the seventh illustrative embodiment, based on control of the CPU 82 in response to the print instruction signal, one or more printed labels each including a label body and an attaching portion may be created based on the label quantity data. More specifically, while the thermal head 22 prints, based on the print content data, a print content on each first inside portion 581F of the printing tape 50F being conveyed by the platen roller 25, the half cutter 42 or the full cutter 41 cuts the printing tape 50F to divide a second inside portion 582F of the printing tape 50F into two portions. While the one or more printed labels are created, cutting might not be performed if unnecessary and/or cutting intervals may be changed. Such a control may enable creation of multiple varieties of printed labels using the same printing tape 50.

<One Example of Printed Labels to be Created>

Figure 18B:
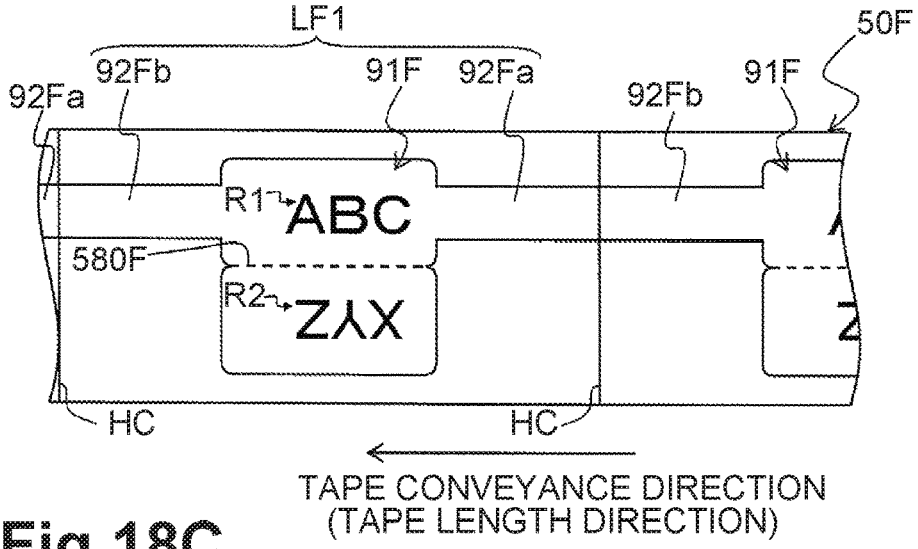
FIG. 18B is a partial plan view of the printing tape having printed labels of one example variety in the seventh illustrative embodiment according to one or more aspects of the disclosure.

FIG. 18B is a partial plan view of the printing tape 50F having printed labels of one example type according to the seventh illustrative embodiment.

In this example, the one-end side section 581Fa of each of the first inside portions 581F of the inside portion 58F has a print content R1. Likewise, the other-end side section 581Fb of each of the first inside portions 581F of the inside portion 58F has a print content R2. Each first inside portion 581F having the print contents R1 and R2 may constitute a label body 91F, which corresponds to the printed tape portion. As illustrated in FIG. 18B, as the print content R1 (e.g., a letter string "ABC"), is printed in the upright position along the tape conveyance direction. As the print content R2 (e.g., another letter string "XYZ"), is printed in the inverted orientation (e.g., in a 180-rotated orientation), relative to the orientation of content R1, along the conveyance direction. The printing tape 50F has a half cut line HC at a middle portion of the second inside portion 582F in the tape conveyance direction. The half cut line HC divides the second inside portion 582F into a downstream portion and an upstream portion that serve as attaching portions 92Fa and 92Fb, respectively. In this example, a single label body 91F and two attaching portions 92Fa and 92Fb may constitute a printed label LF1. In this case, the attaching portions 92Fa and 92Fb are inseparable from the label body 91F and disposed upstream and downstream, respectively, from the label body 91F.

<Another Example of Printed Labels to be Created>

Figure 18C:
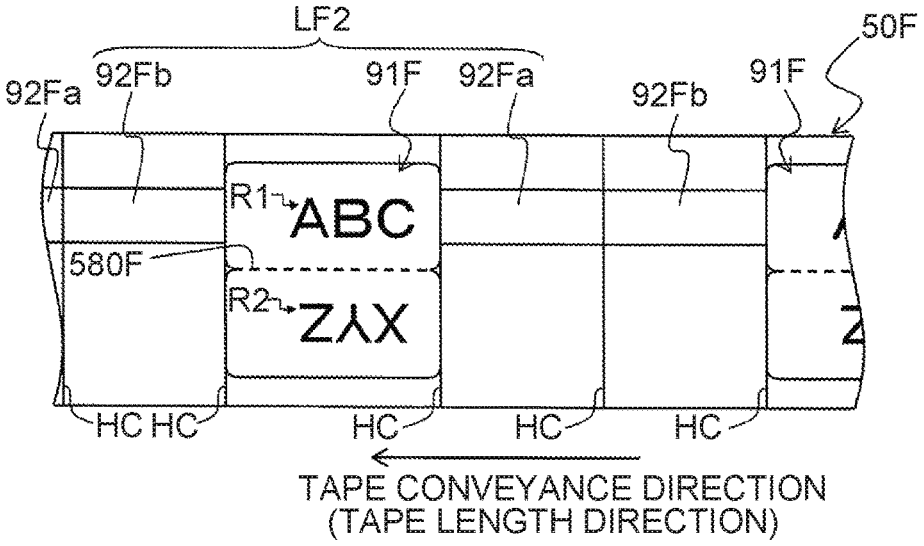
FIG. 18C is a partial plan view of the printing tape having printed labels of another example variety that is different from the variety of the printed labels of FIG. 18B in the seventh illustrative embodiment according to one or more aspects of the disclosure.

FIG. 18C is a partial plan view of the printing tape 50F having printed labels of another example variety that is different from the variety of the printed labels LF1, according to the seventh illustrative embodiment.

Similar to the example illustrated in FIG. 18B and as illustrated in FIG. 18C, in this example, the one-end side section 581Fa of each of the first inside portions 581F of the inside portion 58F has a print content R1, e.g., a letter string "ABC". Likewise, the other-end side section 581Fb of each of the first inside portions 581G of the inside portions 58G has a print content R2, e.g., another letter string "XYZ". This may constitute a label body 91F. Similar to the example illustrated in FIG. 18B, the printing tape 50F has a half cut line HC at a middle portion of the second inside portion 582F in the tape conveyance direction. The half cut line HC divides the second inside portion 582F into a downstream portion and an upstream portion that serve as attaching portions 92Fa and 92Fb, respectively. In this example, the printing tape 50F has another half cut line HC that extends along a boundary between the first inside portion 581F and the second inside portion 582F. Thus, the label body 91F and the attaching portions 92Fa and 92Fb are separated from each other. That is, the number of half cut lines and the intervals of half cut lines HC formed in the printing tape 50F are different between the example of FIG. 18B and the example of FIG. 18C. In this example, a single label body 91F and two attaching portions 92Fa and 92Fb may constitute a printed label LF2 that is different from the printed label LF1. In this case, the attaching portions 92Fa and 92Fb are separate pieces from the label body 91F and are disposed upstream and downstream, respectively, from the label body 91F.

<Effects Achieved by Seventh Illustrative Embodiment>

In the seventh illustrative embodiment, similar to the first illustrative embodiment, while the predetermined number of printed labels are created, cutting might not be performed if unnecessary and/or the intervals of cutting performed by the half cutter 42 or the full cutter 41 may be changed appropriately. This may therefore enable creation of multiple varieties of printed labels using the single printing tape 50F.

Eighth Illustrative Embodiment

Hereinafter, an eighth illustrative embodiment will be described. An explanation will be given for the components that differ from the first illustrative embodiment, and an explanation will be omitted for the common components by assigning the same reference numerals thereto.

<Printing Tape Structure>

Figure 19A:
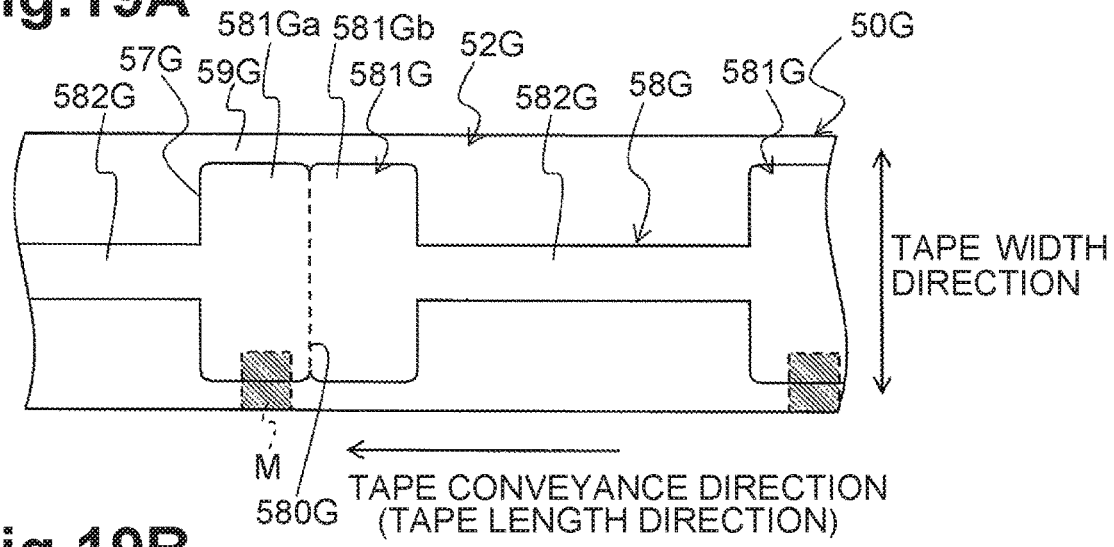
FIG. 19A is a partial plan view of a printing tape in an eighth illustrative embodiment according to one or more aspects of the disclosure.

Referring to FIG. 19A, a structure of a printing tape according to the eighth illustrative embodiment will be described.

As illustrated in FIG. 19A, a printing tape 50G, which corresponds to the tape, has a similar structure to the printing tape 50 of the first illustrative embodiment. More specifically, the printing tape 50G includes an adhesive sheet 52G and a release sheet 54. The adhesive sheet 52G has a base 52*b* on its front side and an adhesive layer 52*a* on its back side. The adhesive sheet 52G is adhered to a surface 54*a* of the release sheet 54 removably.

As illustrated in FIG. 19A, the adhesive sheet 52G of the printing tape 50G has a pre-cut contour 57G enclosing a predetermined area to define a boundary between an inside portion 58F and an outside portion 59F. The pre-cut contour 57G penetrates the adhesive sheet 52G in the tape thickness direction. The adhesive sheet 52G has the inside portion 58G and the outside portion 59G that is the other portion than the inside portion 58G in the adhesive sheet 52G. The inside portion 58G extends along the tape conveyance direction. The inside portion 58F is defined by the pre-cut contour 57G.

Similar to the printing tape 50D, the release sheet 54 of the printing tape 50G has sensor marks M on its back side. The sensor marks M are spaced apart from each other at predetermined intervals along the tape conveyance direction. The interval between sensor marks M may be equal to the interval between first inside portions 581G.

The inside portion 58G has a one piece structure including a plurality of first inside portions 581G, each of which corresponds to the first area, and a plurality of second inside portions 582G, each of which corresponds to the second area. The first inside portions 581G are spaced apart from each other at regular intervals in the tape conveyance direction. Each of the second inside portions 582G is disposed between each adjacent two of the first inside portions 581 and contiguous to each of the adjacent first inside portions 581.

The first inside portions 581G each have a perforation line 580G at a middle portion in the tape conveyance direction, and the perforation line 580G extends along the tape width direction. The perforation line 580G penetrates the adhesive sheet 52G in the tape thickness direction. Nevertheless, in other embodiments, for example, each of the first inside portions 581G may have a perforation line at a middle portion in the tape width direction, and the perforation line may extend along the tape conveyance direction. The first inside portion 581G is symmetrical with respect to the perforation line 580G. The perforation line 580G divides the first inside portion 581G into a plurality of sections, for example, a downstream section 581Ga and an upstream section 581Gb. The downstream section 581Ga is positioned on a downstream side of the first inside portion 581G relative to the perforation line 580G in the tape conveyance direction. The upstream section 581Gb is positioned on an upstream side of the first inside portion 580G relative to the perforation line 580G in the tape conveyance direction. The downstream section 581Ga and the upstream section 581Gb have equal dimensions in the tape conveyance direction. The downstream section 581Ga and the upstream section 581Gb each have a rectangular shape with its shorter sides extending along the tape conveyance direction and its longer sides extending along the tape width direction.

Between adjacent two first inside portions 581G, a second inside portion 582G extends along the tape conveyance direction between an upstream end of an upstream section 581Gb of a downstream first inside portion 581G and a downstream end of a downstream section 581Ga of an upstream first inside portion 581G in the tape conveyance direction. The second inside portion 582G has a rectangular shape with its longer sides extending along the tape conveyance direction and its shorter sides extending along the tape width direction.

<Printed Label Creation>

In the seventh illustrative embodiment, based on control of the CPU 82 in response to the print instruction signal, one or more printed labels each including a label body and an attaching portion may be created based on the quantity data. More specifically, while the thermal head 22 prints, based on the print content data, a print content on each first inside portion 581G of the printing tape 50G being conveyed by the platen roller 25, the half cutter 42 or the full cutter 41 cuts the printing tape 50G to divide a second inside portion 582G of the printing tape 50G into two portions. While the one or more printed labels are created, cutting might not be performed if unnecessary and/or cutting intervals may be changed. Such a control may enable creation of multiple types of printed labels using the same printing tape 50.

<One Example of Printed Labels to be Created>

Figure 19B:
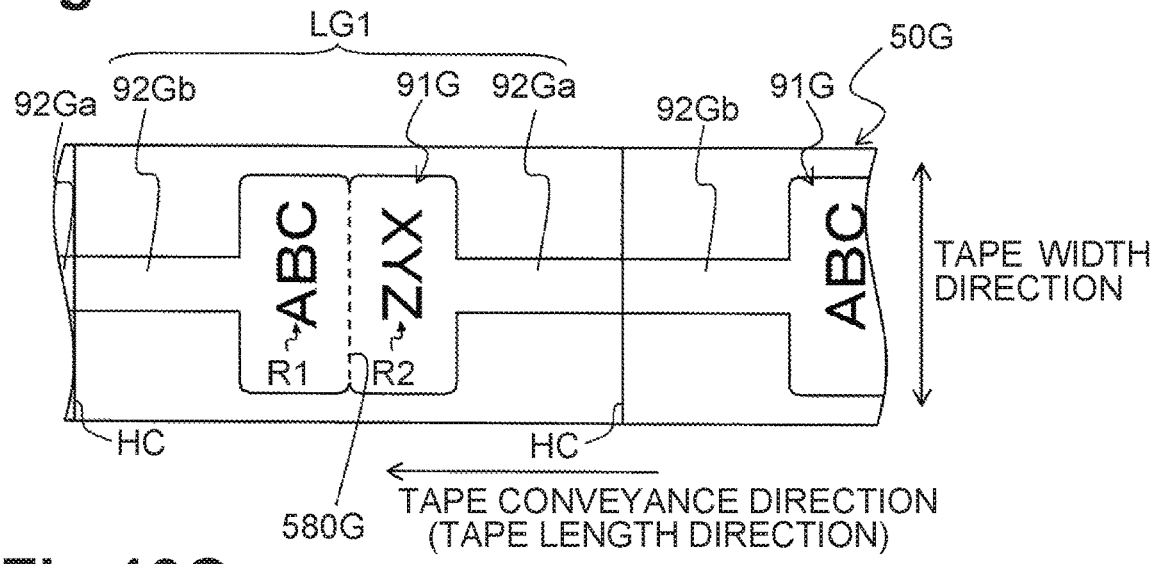
FIG. 19B is a partial plan view of the printing tape having printed labels of one example variety in the eighth illustrative embodiment according to one or more aspects of the disclosure.

FIG. 19B is a partial plan view of the printing tape 50G having printed labels of one example type according to the eighth illustrative embodiment.

In this example, the downstream section 581Ga of each of the first inside portions 581G of the inside portion 58G has a print content R1. Likewise, the upstream section 581Gb of each of the first inside portions 581G of the inside portion 58F has a print content R2. Each first inside portion 581G having the print contents R1 and R2 may constitute a label body 91G, which corresponds to the printed tape portion. As illustrated in FIG. 19B, as the print content R1 (e.g., a letter string "ABC"), is printed in a 90°-rotated orientation in a counterclockwise direction relative to the upright position so as to extend along the conveyance direction. As the print content R2, another letter string, e.g., "XYZ", is printed in a 90°-rotated orientation in the clockwise direction relative to the upright position so as to extend along the conveyance direction. The printing tape 50G has a half cut line HC at a middle portion of the second inside portion 582G in the tape conveyance direction. The half cut line HC divides the second inside portion 582G into a downstream portion and an upstream portion that serve as attaching portions 92Ga and 92Gb, respectively. In this example, a single label body 91G and two attaching portions 92Ga and 92Gb may constitute a printed label LG1. In this case, the attaching portions 92Ga and 92Gb are inseparable from the label body 91G and are disposed upstream and downstream, respectively, from the label body 91G.

<Another Example of Printed Labels to be Created>

Figure 19C:
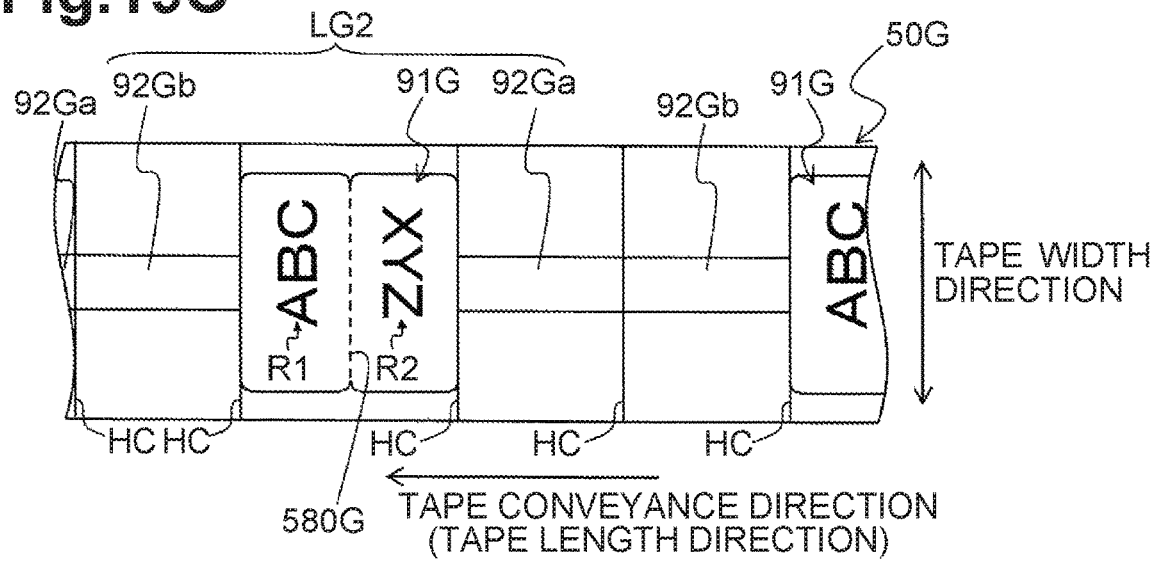
FIG. 19C is a partial plan view of the printing tape having printed labels of another example variety that is different from the variety of the printed labels of FIG. 19B in the eighth illustrative embodiment according to one or more aspects of the disclosure.

FIG. 19C is a partial plan view of the printing tape 50G having printed labels of another example type that is different from the variety of the printed labels LG1, according to the eighth illustrative embodiment.

Similar to the example illustrated in FIG. 19B and as illustrated in FIG. 19C, in this example, the downstream section 581Ga of each of the first inside portions 581G of the inside portion 58G has a print content R1, e.g., a letter string "ABC". Likewise, the upstream section 581Gb of each of the first inside portions 581G of the inside portions 58G has a print content R2, e.g., another letter string "XYZ". This may constitute a label body 91G. The printing tape 50G has a half cut line HC at a middle portion of the second inside portion 582G in the tape conveyance direction. The half cut line HC divides the second inside portion 582G into a downstream portion and an upstream portion that serve as attaching portions 92Ga and 92Gb, respectively. In this example, the printing tape 50G has another half cut line HC that extends along a boundary between the first inside portion 581G and the second inside portion 582G. Thus, the label body 91G and the attaching portions 92Ga and 92Gb are separated from each other. That is, the number of half cut lines and the intervals of half cut lines HC formed in the printing tape 50G are different between the example of FIG. 19B and the example of FIG. 19C. In this example, a single label body 91G and two attaching portions 92Ga and 92Gb may constitute a printed label LG2 that is different from the printed label LG1. In this case, the attaching portions 92Ga and 92Gb are separate pieces from the label body 91G and are disposed upstream and downstream, respectively, from the label body 91G.

<Effects Achieved by Eighth Illustrative Embodiment>

In the eighth illustrative embodiment, similar to the first illustrative embodiment, while the predetermined number of printed labels are created, cutting might not be performed if unnecessary and/or the intervals of cutting performed by the half cutter 42 or the full cutter 41 may be changed appropriately. This may therefore enable creation of multiple varieties of printed labels using the single printing tape 50G.

The arrow indicated in FIG. 4 is merely an example direction in which a signal may be transmitted, and does not limit the signal transmitting direction.

The flowchart of FIG. 10 does not limit the execution order of steps of the disclosure. In other embodiments, for example, one or more steps may be added and/or omitted, and/or the execution order of steps may be changed without departing from the spirit and scope of the disclosure.

The illustrative embodiments and variations may be combined appropriately in another manner.

While the disclosure has been described in detail with reference to the specific embodiments thereof, these are merely examples, and various changes, arrangements and modifications may be applied therein without departing from the spirit and scope of the disclosure.

What is claimed is:

1. A tape comprising:

a plurality of first areas and a second area, the second area having a first end in a first direction and a second end in the first direction, wherein the first end of the second area is connected to one of the first areas and the second end of the second area is connected to another one of the first areas, each of the plurality of first areas having a respective pre-formed line at a respective middle portion thereof, at least a part of the pre-formed line having a different thickness than a remainder of the corresponding first area, the second area being shorter than each of the first areas in a second direction perpendicular to the first direction, and an entirety of the second area having a same thickness in a third direction perpendicular to the first and second directions, wherein the first areas are positioned between a pair of pre-cut lines spaced apart from each other in the second direction, the pair of pre-cut lines extending in the first direction, a dimension of each of the first areas in the second direction being defined by a distance between the pair of pre-cut lines in the second direction, and wherein the second area is positioned between another pair of pre-cut lines spaced apart from each other in the second direction, the another pair of pre-cut lines extending in the first direction, a dimension of the second area in the second direction being defined by a distance between the another pair of pre-cut lines in the second direction.

2. The tape according to claim 1, wherein the entirety of the second area is devoid of cuts.

3. The tape according to claim 1, further comprising:

a first sensor indicator overlapping the one of the first areas in the third direction; and a second sensor indicator overlapping the another one of the first areas in the third direction.

4. The tape according to claim 3, wherein:

the one of the first areas includes a mid-point in one of the first direction and the second direction, the another one of the first areas includes a mid-point in one of the first direction and the second direction, the first sensor indicator does not overlap, in the third direction, the mid-point of the one of the first areas, and the second sensor indicator does not overlap, in the third direction, the mid-point of the another one of the first areas.

5. The tape according to claim 4, wherein the pre-formed line is formed at the mid-point of the one of the first areas.

6. A printer comprising:

a conveyor configured to convey the tape according to claim 1;

a print head configured to print on the first areas of the tape;

a cutting unit configured to cut the tape in the second area in the third direction along the second direction; and a controller configured to control at least one of the conveyor, the print head, and the cutting unit.

7. The printer according to claim 6, wherein:

the conveyor is configured to convey a first sheet and a second sheet of the tape, the first sheet having a first surface, the first sheet having a length in the first direction greater than a width in the second direction, the second sheet is attached to the first surface of the first sheet, and the controller is configured to:

print in the first area on the second sheet of the tape; and partially cut through one or more portions of the tape in the third direction, the one or more portions partially cut being outside of the first area in the second sheet.

8. The printer according to claim 6, wherein the controller is configured to control the cutting unit to:

form a first cut by partially cutting through, in the third direction, a first portion of the tape; and form a second cut by partially cutting through, in the third direction, a second portion of the tape, and wherein the first cut and the second cut are made between the one of the first areas and the another one of the first areas, and are spaced apart from each other in the first direction.

9. The printer according to claim 8, wherein the controller is configured to further control the cutting unit to form a third cut by partially cutting through, in the third direction, a third portion of the tape, and wherein the third cut is made between the one of the first areas and the another one of the first areas, and is spaced apart from the first and second cuts.

10. The printer according to claim 6, wherein the controller is configured to:

create a label body by controlling the print head to print on the one of the first areas of the tape; and create an attaching tape portion in the second area of the tape, the attaching tape portion being upstream or downstream from the label body in the first direction.

11. A printing system comprising:

a tape including:

a plurality of first areas and a second area, the second area having a first end in a first direction and a second end in the first direction, wherein the first end of the second area is connected to one of the first areas and the second end of the second area is connected to another one of the first areas, each of the plurality of first areas having a respective pre-formed line at a respective middle portion, the second area being shorter than each of the first areas in a second direction perpendicular to the first direction, and an entirety of the second area having a same thickness in a third direction perpendicular to the first and second directions, wherein the first areas are positioned between a pair of pre-cut lines spaced apart from each other in the second direction, the pair of pre-cut lines extending in the first direction, a dimension of each of the first areas in the second direction being defined by a distance between the pair of pre-cut lines in the second direction, and wherein the second area is positioned between another pair of pre-cut lines spaced apart from each other in the second direction, the another pair of pre-cut lines extending in the first direction, a dimension of the second area in the second direction being defined by a distance between the another pair of pre-cut lines in the second direction; and a printer including:

a conveyor configured to convey the tape;

a print head configured to print on the first areas of the tape;

a cutting unit configured to cut the tape in the second area in the third direction along the second direction; and a controller configured to control at least one of the conveyor, the print head, and the cutting unit.

12. The printing system according to claim 11, wherein:

the pair of pre-cut lines and the other pair of pre-cut lines are connected together to form a pair of pre-cut contours defining an inside portion and an outside portion surrounding the inside portion, the first areas and the second area are disposed within the inside portion of the tape, and the controller is further configured to:

control the conveyor to convey the tape; and control the cutting unit to create an attaching tape portion by cutting the inside portion of the tape.

13. The printing system according to claim 12, wherein:

the inside portion has a one piece structure including the first areas and the second area, the controller is configured to control the print head to create a label body by printing on one of the first areas of the inside portion, and creating the attaching tape portion includes cutting the second area of the inside portion while maintaining a one piece structure with the label body.

14. A tape comprising:

a plurality of first areas and a second area, the second area having a first end in a first direction and a second end in the first direction, wherein the first end of the second area is connected to one of the first areas and the second end of the second area is connected to another one of the first areas, each of the plurality of first areas having a respective pre-formed line at a respective middle portion thereof, at least a part of the pre-formed line having a different thickness than a remainder of the corresponding first area, the second area being shorter than each of the first areas in a second direction perpendicular to the first direction, and an entirety of the second area is not cut in a third direction perpendicular to the first and second directions, wherein the first areas are positioned between a pair of pre-cut lines spaced apart from each other in the second direction, the pair of pre-cut lines extending in the first direction, a dimension of each of the first areas in the second direction being defined by a distance between the pair of pre-cut lines in the second direction, and wherein the second area is positioned between another pair of pre-cut lines spaced apart from each other in the second direction, the another pair of pre-cut lines extending in the first direction, a dimension of the second area in the second direction being defined by a distance between the another pair of pre-cut lines in the second direction.

* * * * *